US006381430B1

(12) United States Patent
Yokomori et al.

(10) Patent No.: US 6,381,430 B1
(45) **Date of Patent: *Apr. 30, 2002**

(54) ASSEMBLING AND DISASSEMBLING METHODS FOR DEVELOPING CARTRIDGE

(75) Inventors: Kanji Yokomori; Kazuhiko Kanno; Tachio Kawai, all of Odawara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/386,437

(22) Filed: Aug. 31, 1999

(30) Foreign Application Priority Data

Aug. 31, 1998 (JP) ..... 10-262469

(51) Int. Cl.[7] ..... G03G 15/00; G03G 15/04
(52) U.S. Cl. ..... 399/119; 399/109
(58) Field of Search ..... 399/107, 109, 399/110, 111, 113, 114, 119, 120

(56) References Cited

U.S. PATENT DOCUMENTS 5,739,796 A * 4/1998 Miura et al. ..... 399/114

(List continued on next page.)

FOREIGN PATENT DOCUMENTS

| | | |
|---|---|---|
| EP | 0 758 105 A1 | 2/1997 |
| EP | 0 889 375 A2 | 1/1999 |
| JP | 3-126056 | 5/1991 |
| JP | 6-130745 | 5/1994 |

OTHER PUBLICATIONS

Patent Abstracts of Japan, vol. 15, No. 338, Aug. 27, 1991, (JP–03–126056).
Patent Abstracts of Japan, vol. 18, No. 423, Aug. 8, 1994, (JP–6–130745).

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An assembling method of a cartridge detachably mountable to a main assembly of an image forming apparatus and having a developing device, the method including the steps of: preparing a container unit provided with a developing frame; mounting a toner supplying roller to the developing frame, wherein the toner supply roller is effective to supply the toner to the developing roller, and the developing roller is effective to carry the toner to a developing position; mounting a toner layer thickness regulating member to the developing frame, wherein the toner layer thickness regulating member is effective to regulate a thickness of a layer of the toner applied on the developing roller; supporting a shaft of the developing roller at one longitudinal end thereof and a shaft of the toner supplying roller at the one longitudinal end by a side cover, and mounting the side cover to the container unit, after the step of mounting the supplying roller and after the step of mounting the toner layer thickness regulating member; and supporting a shaft of the developing roller at one longitudinal end thereof and a shaft of the toner supplying roller at the one longitudinal end by a bearing unit, and mounting the bearing unit to the container unit, after the step of mounting the supplying roller and after the step of mounting the toner layer thickness regulating member.

16 Claims, 56 Drawing Sheets

U.S. PATENT DOCUMENTS 5,768,658 A * 6/1998 Watanabe et al. ..... 399/111
5,774,766 A * 6/1998 Karakama et al. ..... 399/111
5,815,644 A * 9/1998 Nishiuwatoko et al. ..... 399/113
5,839,028 A * 11/1998 Nomura et al. ..... 399/109
5,870,655 A * 2/1999 Nishiuwatoko et al. ..... 399/111
5,878,309 A * 3/1999 Nomura et al. ..... 399/111
5,893,006 A * 4/1999 Kanno et al. ..... 399/13
5,903,803 A * 5/1999 Kawai et al. ..... 399/116
5,920,754 A * 7/1999 Chung et al. ..... 399/119
5,926,666 A * 7/1999 Miura et al. ..... 399/25
5,937,240 A * 8/1999 Kanno et al. ..... 399/111
5,940,657 A * 8/1999 Yokomori et al. ..... 399/119
5,943,528 A * 8/1999 Akutsu et al. ..... 399/110
5,950,049 A * 9/1999 Yokomori et al. ..... 399/119
5,953,562 A * 9/1999 Kawaguchi et al. ..... 399/117
5,966,568 A * 10/1999 Numagami et al. ..... 399/111

* cited by examiner

ASSEMBLING AND DISASSEMBLING METHODS FOR DEVELOPING CARTRIDGE

FIELD OF THE INVENTION AND RELATED ART

The present invention relates to an assembling method and a disassembling method for a cartridge having a developing device, the cartridge being detachably mountable to a main assembly of an image forming apparatus.

The cartridge is, for example, a developing cartridge which integrally contains a developing means for developing with toner an electrostatic latent image formed on an electrophotographic photosensitive member and a toner accommodating portion for accommodating the toner to be supplied to the developing means, the cartridge being detachably mountable to a main assembly of an image forming apparatus.

The image forming apparatus may be an electrophotographic copying machine, an electrophotographic-printer (an LED printer, an laser beam printer or the like), an electrophotographic-printer type facsimile machine and an electrophotographic word processor, or the like.

Conventionally, the structure of an apparatus for forming multi-color images through and electrophotographic image forming process, includes a photosensitive drum (electrophotographic photosensitive member), and a developing rotary member carrying a plurality of developing cartridges which contains different color toner materials. A developing cartridge accommodating a predetermined color toner faces to the photosensitive drum. By doing so, the electrostatic latent image is developed. Then, the toner image is transferred onto a recording material. The steps are repeated for different colors to provide a multi-color image. In such a color image forming apparatus, the developing cartridge is detachably mountable to the main assembly of the image forming apparatus. The developing cartridge may be exchanged by the user. By doing so, the maintenance operation of the main assembly of the apparatus is eased.

A simple assembling method for such a cartridge is desired from the standpoint of improvement in the productivity, and more efficient mounting of the parts are also desired.

Furthermore, in terms of reuse of the cartridge by exchanging a part of the parts after the toner therein is used up, a simple and efficient disassembly method and assembling method are desired.

SUMMARY OF THE INVENTION

Accordingly, it is a principal object of the present invention to provide an assembling method of a cartridge wherein parts such as a developing roller, a toner supplying roller or other parts are easily and efficiently mounted to a main assembly unit of a cartridge.

It is another object of the present invention to provide a simple and efficient disassembling method for a cartridge to permit exchange of parts of the cartridge.

These and other objects, features and advantages of the present invention will become more apparent upon a consideration of the following description of the preferred embodiments of the present invention taken In conjunction with the accompanying drawings.

DESCRIPTION OF THE PREFERRED EMBODIMENTS

A developing cartridge and an electrophotographic image forming apparatus according to embodiments of the present invention will be described. In the following description, the longitudinal direction of a developing cartridge is a direction which is substantially perpendicular to a feeding direction of a recording material and which is substantially parallel with a surface of a recording material.

First Embodiment

Figure 1:
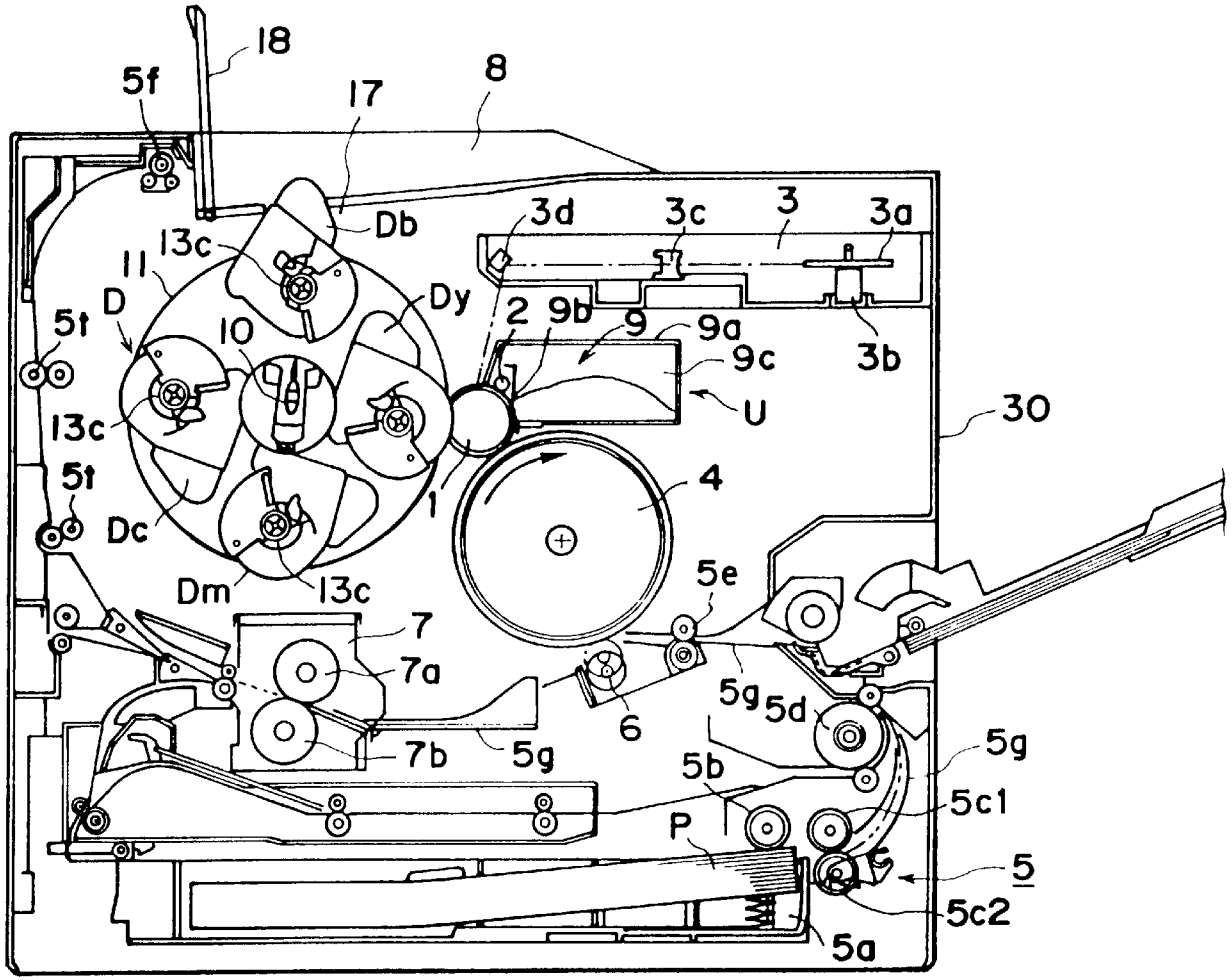
FIG. 1 is an illustration of an electrophotographic image forming apparatus according to an embodiment of the present invention.
Figure 2:
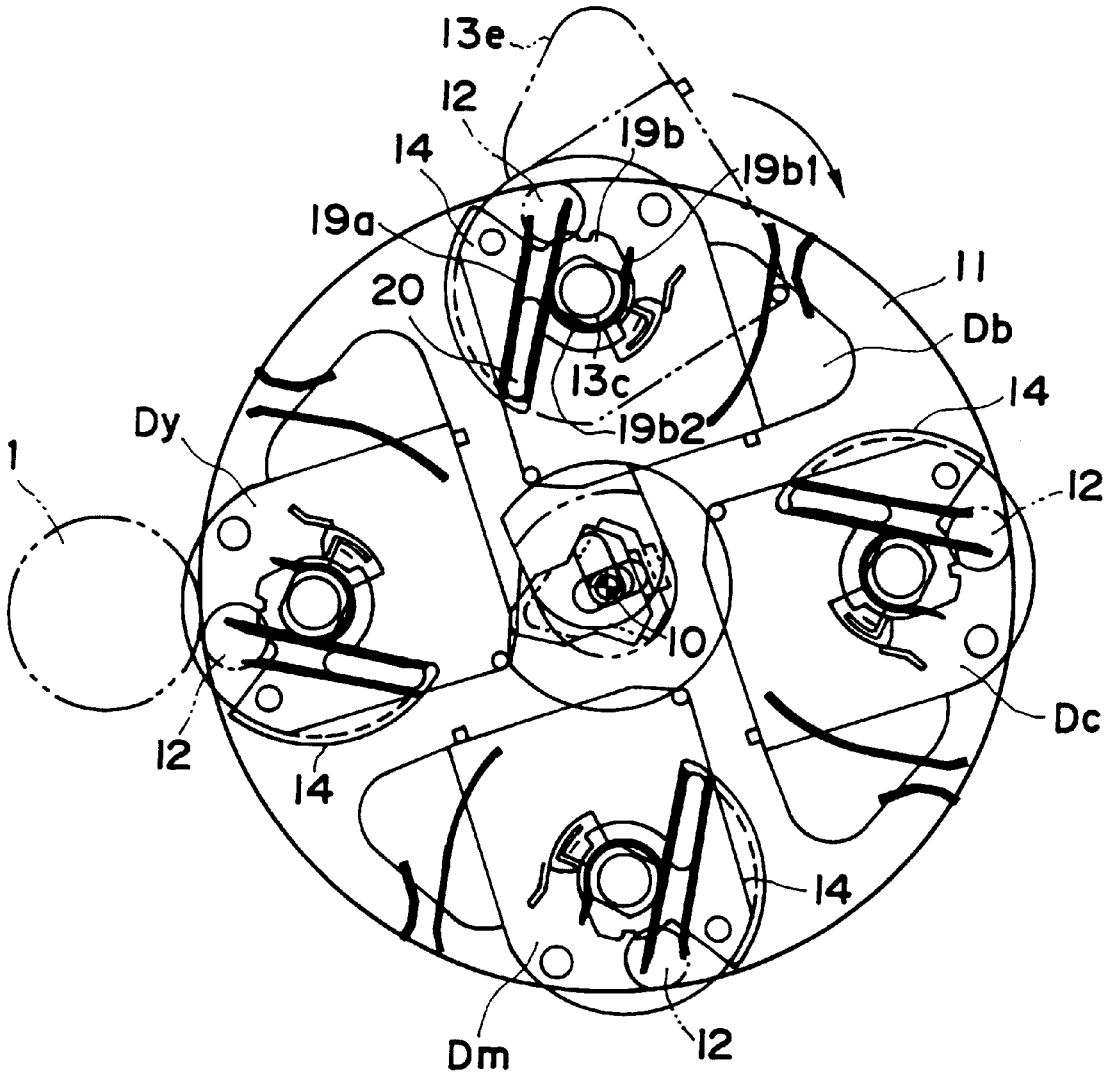
FIG. 2 is illustrations of a rotary unit and a developing cartridge.
Figure 3:
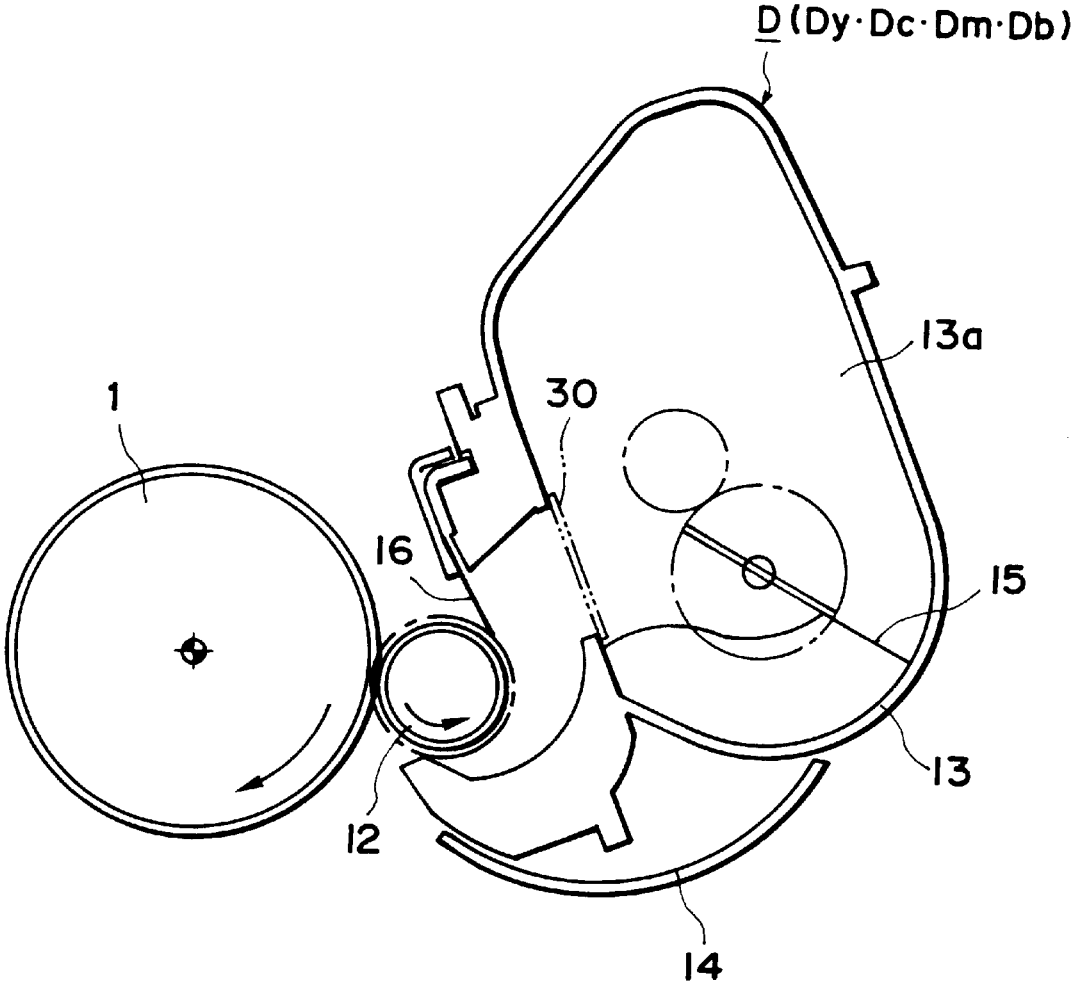
FIG. 3 is an illustration of a developing cartridge.
Figure 4:
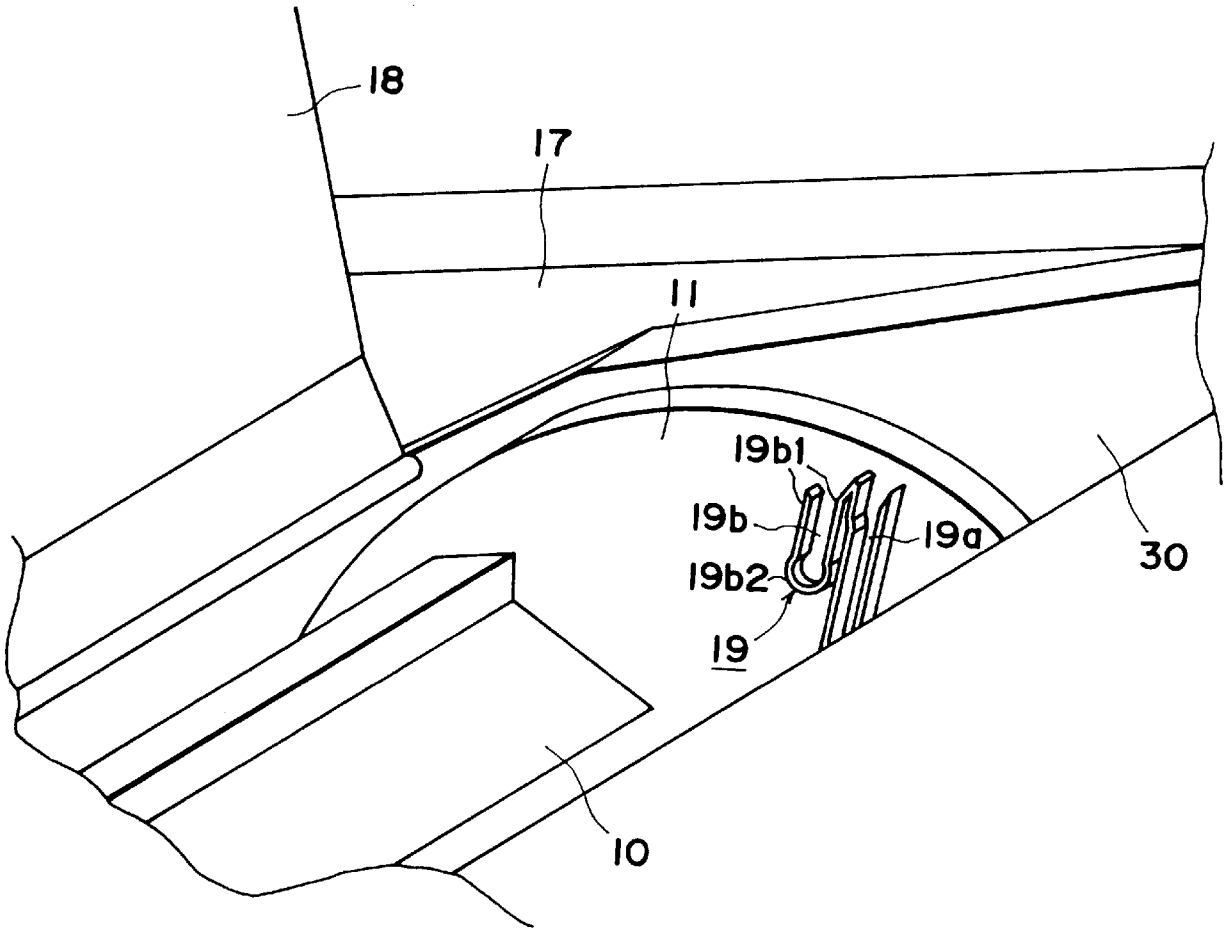
FIG. 4 is an illustration of a mounting means for a developing cartridge, provided in the main assembly of an image forming apparatus.
Figure 5:
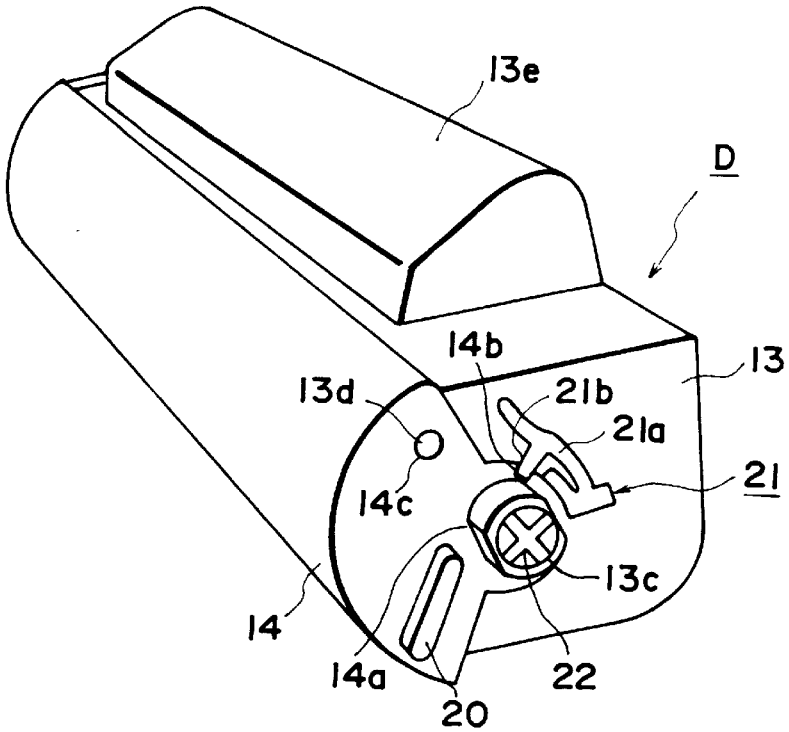
FIG. 5 is a perspective view of a developing cartridge when the shutter is closed.
Figure 9:
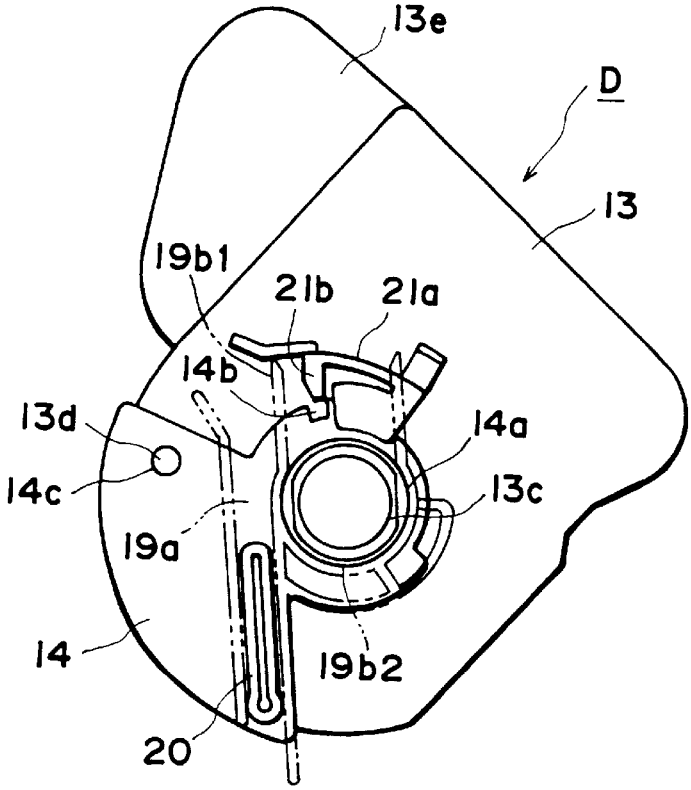
FIG. 9 is an illustration of a developing cartridge when it is inserted into a main assembly.
Figure 10:
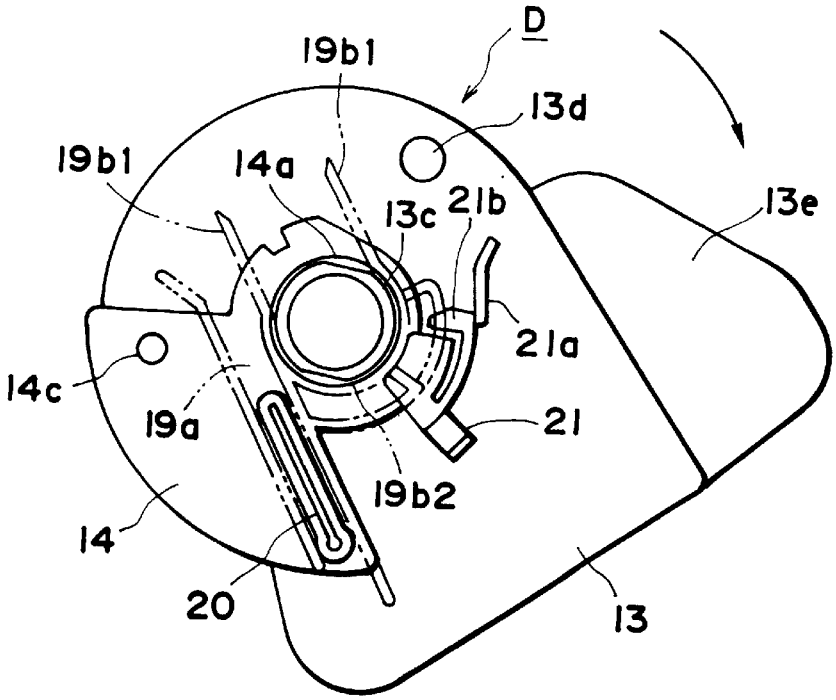
FIG. 10 is an illustration of a developing cartridge when it is inserted into a main assembly.
Figure 11:
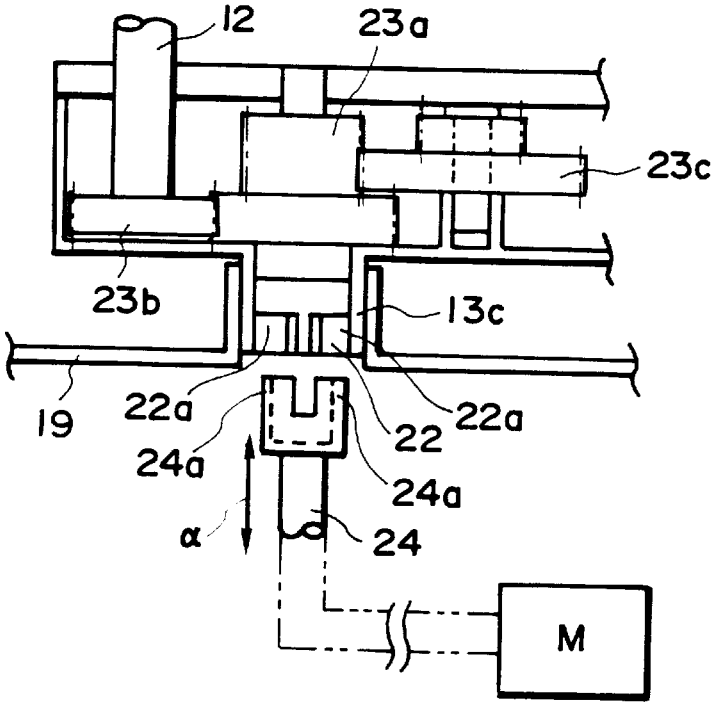
FIG. 11 is an illustration of the drive transmission structure which stabilizes a positional relation between a developing roller and a photosensitive drum.
Figure 12:
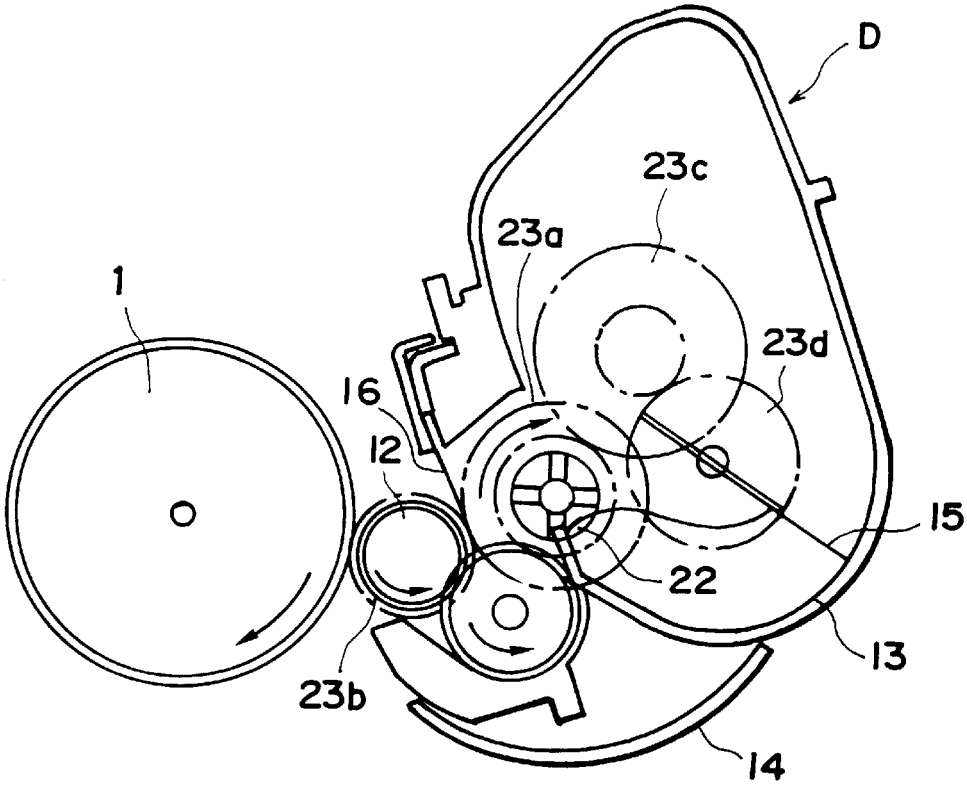
FIG. 12 is an illustration of a drive transmission structure which stabilizes the positional relation between a developing roller and a photosensitive drum.

Referring to FIGS. 1 to 12, the first embodiment of the present invention will be described. FIGS. 1 to FIG. 3 illustrate an electrophotographic image forming apparatus; FIGS. 4 to 5 are perspective view of a developing cartridge; FIGS. 6 to FIG. 10 are a mounting structure of the developing cartridge; and FIGS. 11 and 12, illustrate a drive transmission structure.

First, the description will be made as to a general arrangement of the electrophotographic image forming apparatus, and then as to the structure of the developing cartridge.

(Electrophotographic Image Forming Apparatus)

The description will be made as to a schematic structure of an electrophotographic image forming apparatus in this embodiment. FIG. 1 is a side view of a laser beam printer as an exemplary image forming apparatus for forming a color image through an electrophotographic process. Charging means 2 uniformly charges a surface of an electrophotographic photosensitive member in the form of a drum (photosensitive drum) 1 which rotates at a constant speed. A laser beam corresponding to image information is projected through exposure means 3 onto the photosensitive drum 1 to form latent images thereon, which are developed by developing device Dy, Dm, Dc, Db. The developed images formed on the photosensitive drum 1 are superimposedly transferred sequentially onto an intermediary transfer member 4 so that color image is formed. The color image is transferred by transferring means 6 onto a recording material P, such as recording paper, OHP sheet or the like fed by feeding means 5 from a sheet feeding portion. The recording material P is fed to fixing means 7, where the color image is fixed. The recording material P is then discharged to a discharging portion 8 at an upper surface of the device.

The structures of the respective portions will be described.

The photosensitive drum 1 is integrally mounted to a frame of cleaning means 9 for removing developer(toner) remaining on the photosensitive drum 1 after transfer of the toner image onto the recording material P, thus constituting a process cartridge(drum unit)U. The process cartridge U is demountably mounted to the main assembly of the image forming apparatus, and is exchanged by a user by himself when the lifetime of the photosensitive drum 1 ends The photosensitive drum 1 comprises an aluminum cylinder having a diameter of approx. 150 mm, and an organic photoconductive layer thereon, and is rotatably supported on a frame 9*a* of the cleaning means 9, which frame also functions as a holder for the photosensitive drum 1. Around the photosensitive drum 1, there are provided a cleaning blade 9*b* for scraping and removing the toner remaining on the photosensitive drum 1, and charging means 2. In this example, the photosensitive drum 1, the cleaning means 9 and the charging means 2 are unified into a process cartridge U detachably mountable to the main assembly of the apparatus. The photosensitive drum 1 receives driving force from a driving motor M to rotate in the counterclockwise direction in FIG. 1, in accordance with an image forming operation.

The charging means 2 in this example is of contact-charging type, and comprises a rotatable electroconductive roller in contact with the surface of the photosensitive drum 1, which roller is supplied with a voltage to uniformly charge the surface of the photosensitive drum 1.

In the exposure means 3 for exposing the charged photosensitive drum 1, an image signal is supplied to an unshown laser diode, in response to which the laser diode projects the image light corresponding to the image signal onto the polygonal mirror 3*a*. The polygonal mirror 3*a* is rotated at a high speed by a scanner motor 3*b*, and the image light reflected by the mirror 3*a* is projected onto the photosensitive drum 1 rotating at a constant speed through an imaging lens 3*c* and a reflection mirror 3*d*, so that surface of the photosensitive drum 1 is imagewisely exposed to the light, thus forming an electrostatic latent image.

The latent image is developed for each color by the latent image developing cartridge (developing device). The structure of the developing cartridge will be described, hereinafter.

The toner image developed by the developing cartridge is transferred onto the intermediary transfer member 4. Onto the intermediary transfer member 4, four color toner images on the drum are sequentially and superimposedly transferred. Therefore, the intermediary transfer member 4 is rotated clockwisely in FIG. 1 in synchronism with the outer peripheral speed of the photosensitive drum 1. The intermediary transfer member 4 having the toner images is passed to sandwich the recording material P with a transfer roller 6, as transferring means, supplied with a voltage, by which the toner images are simultaneously transferred from the intermediary transfer member 4 onto the recording material P.

The intermediary transfer member 4 in this example comprises an aluminum cylinder having an outer diameter of approximately 150 mm, and an elastic layer of a material such as an intermediate resistance sponge, an intermediate resistance rubber or the like thereon. It is rotated by a gear fixed thereto.

After the toner image is transferred onto the intermediary transfer member 4, a small amount of toner remains on the surface of the photosensitive drum 1, and is removed by cleaning means 9. The cleaning means 9 has a cleaning blade 9*b*, which contacts the drum surface and which scrapes the toner off the e drum surface. The scraped toner is accumulated in a toner container 9*c*. The capacity of the container 9*c* is such that it is not filled with the removed toner accumulated before the lifetime of the photosensitive drum 1 ends. The removed toner in the container 9*c* is taken out by exchange of the drum unit U when the life of the photosensitive drum 1 ends.

The transferring means for transferring the toner images from the intermediary transfer member 4 onto the recording material P, is in the form of a transfer roller 6 in this example, and the roller 6 comprises a metal shaft and an intermediate resistance foamed-elastic-member thereon, and is vertically movable in FIG. 1.

The transfer roller 6 takes a solid line position in FIG. 1 (lower position) away from the intermediary transfer member 4 so that it does not disturb the image while the four toner images are being transferred thereonto, that is, while the intermediary transfer member 4 is rotated a plurality of times.

After the toner images are superimposedly transferred onto the intermediary transfer member 4, and the color image formation is completed on the intermediary transfer member 4, the transfer roller 6 is moved to the upper position indicated by the chain line in FIG. 1 by an unshown cam at timing for transfer of the color image onto the recording material P. Thus, the roller press-contacts the recording member P to the intermediary transfer member 4 at a predetermined time. Simultaneously with this, the transfer roller 6 is supplied with a bias voltage so that toner image is transferred from the intermediary transfer member 4 onto the recording material P.

The feeding means 5 for feeding the recording material P, comprises a cassette 5*a* accommodating a plurality of recording materials P, a pick-up roller 5*b*, feeding rollers 5*c*1, retarding rollers 5*c*2 for preventing double feeding, a pair of feeding rollers 5*d*, a pair of registration rollers 5*e*, a pair of discharging rollers 5*f*, and a feeding guide 5*g*.

At the time of the image formation, the pick-up roller 5*a* is rotated in the image forming operation, so that recording material P in the cassette 5*a* is separated and fed in seriatim. The recording material is fed out of the cassette 5*a*, and is guided by the feeding guide 5*f*, and then is fed to the pair of registration rollers 5*e* via the pair of feeding rollers 5*d*. In the image forming operation, the registration roller 5*e* is at rest for stopping and retaining the recording material P, and is rotated to feed the recording material P to the intermediary transfer member 4 at a predetermined sequence to align the recording material P with the intermediary transfer member 4 for the transfer process. Then, the color image is transferred by the transferring means.

The recording material P now having the transferred color image is fed to the fixing means 7 where the toner image is fixed. The fixing means 7 comprises a fixing roller 7*a* for applying heat to the recording material P, and a pressing roller 7*b* for press-contacting the recording material P to the fixing roller 7*a*. These rollers 7*a*, 7*b* are hollow rotatable rollers, and have heaters therein. The toner image is fixed on the recording material P while the recording material P is being fed therethrough while being pressed and heated.

The recording material P on which the toner image is fixed, is discharged to the discharging portion 8 by the discharging rollers 5*f* (feeding means).

(Developing Cartridge (Developing Device))

The description will be made as to the developing cartridge for developing the latent image formed on the photosensitive drum 1.

The image forming apparatus has four developing cartridges D (Dy, Dm, Dc, Db) for development in four colors (yellow, magenta, cyan and black) to form a full-color image. The developing cartridges D, as shown in FIGS. 1 and 2, are demountably mounted on a rotary unit 11, which is rotatable about a shaft 10. In the image forming operation, each developing cartridge D is revolved while being supported on the rotary unit 11, about the shaft 10. A developing cartridge D accommodating predetermined color toner is stopped at a development position facing the photosensitive drum 1. The developing roller, which will be described hereinafter, is positioned with small clearance relative to the photosensitive drum 1 (approximately 300 $\mu$m), and then the toner is supplied to the electrostatic latent image on the photosensitive drum 1 to develope the latent image.

During color image formation, the rotary unit 11 is rotated for each rotation of the intermediary transfer member 4 to permit developing operations of the yellow developing cartridge Dy accommodating the yellow color toner, the magenta developing cartridge Dm accommodating the magenta color toner, cyan developing cartridge Dc accommodating the cyan color toner, and the black developing cartridge Db accommodating the black color toner, in this order.

FIG. 3 shows a developing cartridge D (yellow developing cartridge Dy, for example) placed at the development position faced to the photosensitive drum 1. The developing cartridge D comprises a developing roller 12 as a toner carrying member for supplying the toner to the photosensitive drum 1, and a toner accommodating portion 13*a* for accommodating the toner to be supplied to the developing roller 12. It further comprises a frame 13 for supporting the developing roller 12, and a shutter 14 for an opening provided in the frame 13 to expose the developing roller 12. Furthermore, it comprises a toner feeding member 15 in the toner accommodating portion 13*a*. A fresh developing cartridge is provided with a toner seal 30 for preventing leakage of the toner accommodated in the toner accommodating portion 13*a* before the start of use of the cartridge. A user pulls out the toner seal 30 prior to the mounting of the fresh developing cartridge to the main assembly of the apparatus to open the toner accommodating portion 13*a*. By this, the toner in the toner accommodating portion 13*a* is permitted to be supplied to the developing roller 12.

The toner feeding member 15 is rotated by a driving force from the main assembly of the apparatus to feed the toner from the accommodating portion 13*a* to the developing roller 12. The developing roller 12 is a rotatable aluminum roller, and a development blade 16 is press-contacted to the peripheral surface of the developing roller 12 to regulate the thickness of the layer on the developing roller 12. By this, when the developing roller 12 is rotated in the counterclockwise direction in FIG. 3, the toner is applied on the peripheral surface as a thin layer, and the toner is supplied with electric charge (triboelectric charge).

The developing roller 12 facing the photosensitive drum 1 having a latent image, is supplied with a developing bias, so that toner image is formed on the photosensitive drum 1 in accordance with the latent image.

The above-described structure and the developing process are the same in the yellow developing cartridge Dy, the magenta developing cartridge Dm, the cyan developing cartridge Dc and the black developing cartridge Db. The developing roller 12 of each developing cartridge D is connected with the driving source and a high voltage generating source for each color development provided in the main assembly of the image forming apparatus when the developing cartridge D is moved to development position, so that a developing bias voltage for each developing cartridge D is sequentially applied thereto, and the driving force is transmitted to rotate the developing roller 12 or the like.

(Mounting of Developing Cartridge to the Main Assembly of Image Forming Apparatus)

A description will be provided as to the structure for mounting the developing cartridge D to the main assembly 30 of the image formation device. As shown in FIGS. 1 to 4, at a predetermined position of the main assembly 30 of the image forming apparatus, an insertion opening 17 having a width not less than the longitudinal-direction length of the developing cartridge D, is formed, and a cover 18 is openable mounted in the insertion opening 17. The insertion opening 17 is normally closed by a cover 18.

The main assembly of the apparatus 30 is provided with a developing device exchange switch (unshown). When the developing cartridge D is exchanged after the toner therein is consumed, the user actuates the switch. Then, the rotary unit 11 rotates to bring the developing cartridge to be replaced to the position of the insertion opening 17.

When the user opened the cover 18, guides 19, constituting the mounting means for the developing cartridge D, are provided at four positions of the rotary unit 11 (for the four cartridges) in the main assembly 30 of the image forming apparatus. On the other hand, the shutter 14 of the developing cartridge D is provided with guide portions 20 as shown in FIGS. 5 to 10. By inserting the cartridge so that guide portion 70 is the guided along the guide 19, the developing cartridge D is inserted into the main assembly 30 of the image forming apparatus. The guide 19 and the guide portion 20 are extended in the longitudinal direction (the direction of the rotation axial direction of) of the developing cartridge D at both sides (only one side is shown in FIGS. 4 and 5).

After the developing cartridge D is inserted into the main assembly of the apparatus in a direction crossing with the longitudinal direction of the developing roller 12 (from the top side of the main assembly of the apparatus) in this manner, the user rotates the developing cartridge D, the shutter 14 is opened, and the developing roller 12 is faces the photosensitive drum 1 exposed through the frame 13, so that developing operation is enabled.

In this example, the rotary unit 11 as the mounting member carries the black developing cartridge Db for developing the latent image using the black color toner, the yellow developing cartridge Dy for development the latent image using yellow color toner, the magenta developing cartridge Dm for developing the latent image using the magenta color toner, and the cyan developing cartridge Dc for developing the latent image using the cyan color toner.

The structures of the guide 19 and the shutter 14 will be described.

Figure 6:
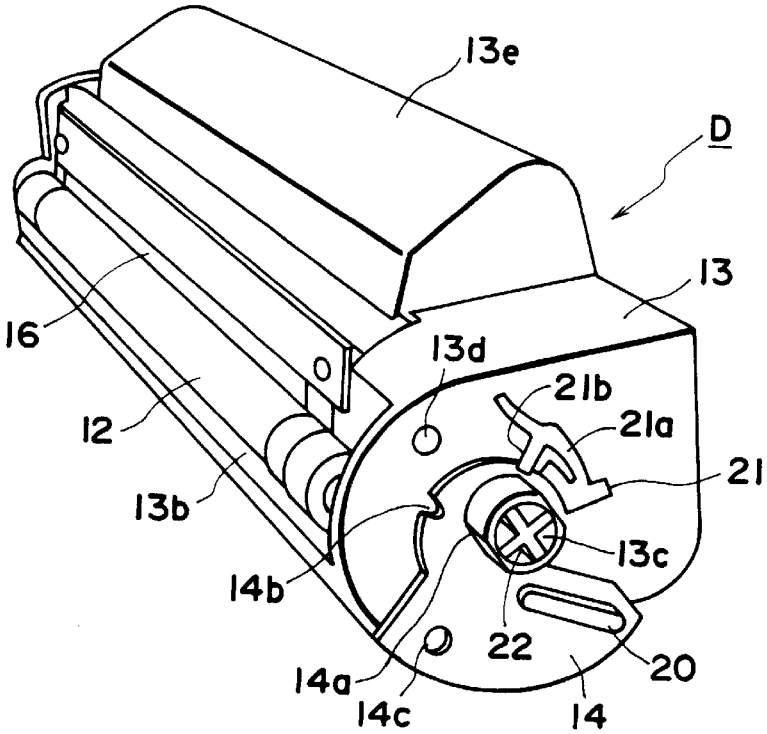
FIG. 6 is a schematic perspective view of a developing cartridge when the shutter is opened.

As shown in FIG. 6, the frame 13 of the developing cartridge D is provided with an opening 13*b* extending in the longitudinal direction, and the developing roller 12 is mounted on the frame 13 so as to be exposed through the opening 13*b*. Substantially at a central portion of each longitudinal end side of the frame 13, a projected portion 13*c* integral with the frame 13 is formed. The projected portion 13*c* functions as a guide when the developing cartridge D is inserted into the main assembly 30 of the image forming apparatus and as a center of rotation for the developing cartridge D. At least one of the projected portions 13*c* is cylindrical.

In both side walls of the shutter 14, round holes 14*a* are formed, and by engaging the projected portion 13*c* with the round hole 14*a*, the shutter 14 is rotatably mounted on the frame 13. As shown in FIG. 5, when the shutter 14 is closed, the opening 13 is closed so that the developing roller 12 is covered by the shutter 14. When the developing cartridge D is out of the main assembly of the apparatus 30, the shutter 14 is closed, so that the developing roller 12 is protected from deposition of foreign matter such as dust, and the roller 12 or the like is protected from damage.

Adjacent to the projected portion 13*c* of the frame 13, there is provided a locking member 21 for locking the shutter 14 in the closed state. The locking member 21 has an engaging portion 21*b* in an arm portion 21*a* as a supporting portion having an elastic. On the other hand, a shutter engagement recess 14*b*, as an engaging portion, is provided at a predetermined position of the shutter side wall.

By this, as shown in FIG. 5, when the shutter 14 is in the closed position, the engaging portion 21*b* is engaged with the engagement recess 14*b* so that shutter 14 is locked in the closed state, thus preventing unintended opening thereof.

When the developing cartridge D is mounted on the main assembly 30 of the image forming apparatus, the locking is automatically released to permit the opening of the shutter 14. This will be described in more detail.

Figure 7:
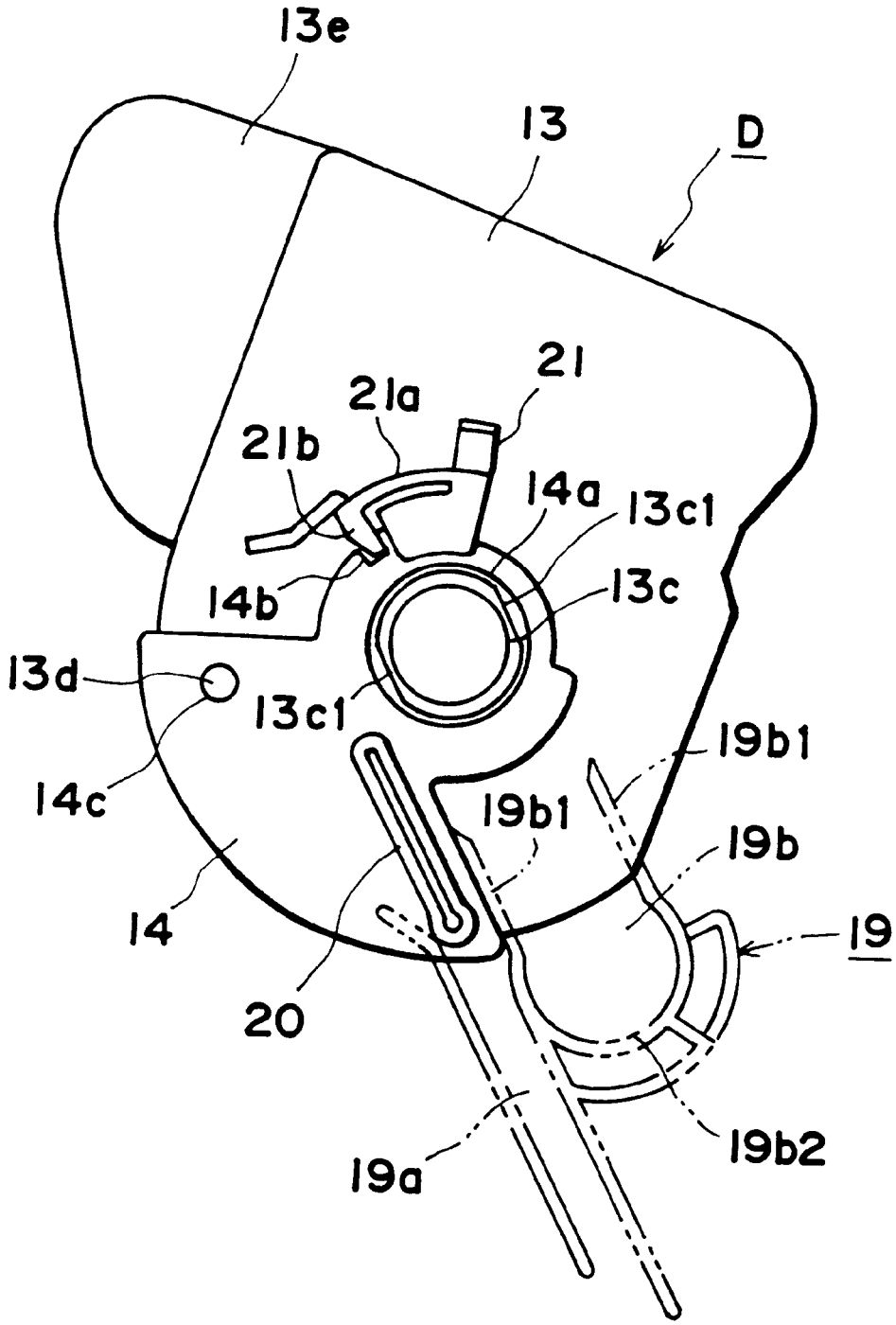
FIG. 7 is an illustration of a developing cartridge when it is inserted into a main assembly.
Figure 8:
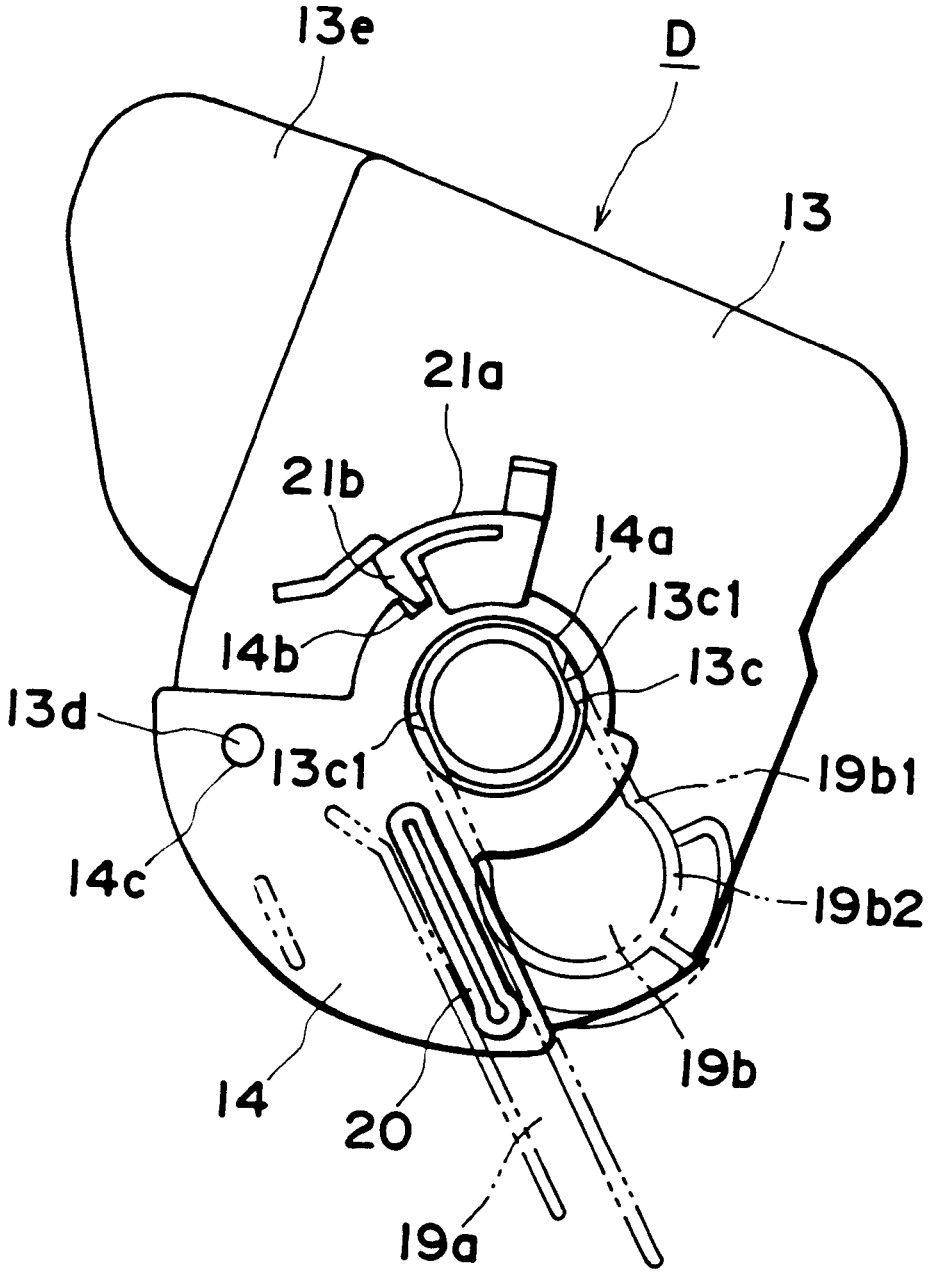
FIG. 8 is an illustration of a developing cartridge when it is inserted into a main assembly.

As shown in FIGS. 4 and 7, the guide 19 provided on the inner wall of the rotary unit 11, comprises two guiding-member inserting portions 19*a* which are substantially parallel with each other, and a projection inserting portion 19*b* comprising a linear rib 19*b*1 and an arcuate rib 19*b*2. When the developing cartridge D is inserted into the main assembly of the apparatus, the user causes the guide portion 20 of the shutter 14 to be guided by the guide inserting portion 19*a*, and inserts the developing cartridge D. When the developing cartridge D is inserted, the projections 13*c* of the developing cartridge D are brought to the linear portions of the projection inserting portions 19*b*, as shown in FIG. 8. The projected portion 13*c* has cutting portions 13*c*1 which are provided by linearly cutting the cylindrical 1 portion in a direction parallel with the linear rib 19*b*1. The two linear ribs 19*b*1 engageable therewith, each have a width for permitting movement of the cutting portion 13*c*1 only in a direction parallel with the cutting portions 13*c*1. Therefore, when the developing device D is inserted into the main assembly of the apparatus 30, it is maintained at a predetermined angle (orientation) by the cutting portions 13*c*1 and the linear ribs 19*b*1. When the projections 13*c* are inserted to the arcuate rib 19*b*2, as shown in FIG. 9, a leading end of one of the linear ribs 19*b*1 abutts the arm portion 21*a*, which locks the shutter 14 to raise it upwardly as shown in FIG. 9. By this, the arm portion 21 is elastically deformed so that the engaging portion 21*b* is releasable from the engagement recess 14*b*, and therefore, the locking of the shutter 14 is released (namely, in this embodiment, the linear rib 19*b*1 is a releasing means for the locking member 21). With this state, the shutter 14 is in a rotatable state relative to the development cartridge frame 13. The arcuate rib 19*b*2 has a radius for permitting rotation of the cylindrical projected portion 13*c*, and the developing cartridge D is in a rotatable state about the cylindrical projected portion 13*c*.

At both longitudinal ends of the developing cartridge frame 13, projections 13*d*, which are semi-spherical engaging portions, are provided as shown in FIG. 9, and correspondingly, the shutter 14 has holes 14*c* that are to be engaged with the projections 13*d*. Therefore, when the shutter 14 is closed, the projections 13*d* are engaged with the holes 14*c*. So, even if the locking by the locking member 21 of the shutter 14 is released, the developing cartridge frame 13 is prevented from rotating to an unstable position relative to the shutter 14.

Subsequently, as shown in FIG. 10, the user presses the grip portion 13*e* of the frame 13. At this time, the cylindrical projected portion 13*c* of the frame 13 is rotatable in the arcuate rib 19*b*2 although the shutter 14 is not, because the guide portion 20 is sandwiched by the guide portion inserting portion 19*a*. Therefore, the semi-spherical projection 13*d* rotates to the predetermined position beyond the hole 14*c* of the shutter 14 (x direction in FIG. 10). Since the shutter 14 is provided with the insertion guide portion 20, the frame 13 is easily rotated while the shutter 14 is in the fixed state. When it is rotated to a predetermined position, the frame 13 is positioning by a positioning means (unshown), so that developing cartridge D is mounted in place.

By this, the shutter 14 is open to expose and face the developing roller 12 to the photosensitive drum 1. During this mounting operation, the user can feel the rotation-start position for the developing cartridge D on the basis of the click feeling provided by the removal of the semi-spherical projection 13*d* from the hole 14*c* the shutter 14.

The diameter of the arcuate portion of the projected portion 13*c* is larger than the distance between the cutting portions 13*c*1, and therefore, the projected portion 13*c* is not disengaged from the linear rib 19*b*1 when the projected portion 13*c* is rotated at the position of the arcuate rib 19*b*2.

On the other hand, when the developing cartridge D is removed from the main assembly 30 of the image forming apparatus, the user rotates the frame 13 in a direction opposite from the foregoing, the cutting portions 13*c*1 become parallel with the linear rib 19*b*1, and the shutter 14 is closed. The user can feel the rotation completion position of the developing cartridge D on the basis of the click feeling upon the engagement of the semi-spherical projection 13*d* into the hole 14*c*. When the developing cartridge D is pulled out of the main assembly of the apparatus 30, the situation is as shown in FIG. 8, so that the arm portion 21*a* of the locking member 21 elastically restores to engage the locking portion 21*b* into the engagement recess 14*b*. By this, the shutter 14 is automatically locked.

By the provision of the shutter 14 in the developing cartridge D, the developing roller 12 is prevented from being contaminated by the dust or the like, Since the shutter 14 is provided with a locking mechanism, the shutter 14 is prevented from inadvertent opening.

When the developing device is inserted into the main assembly 30 of image forming apparatus, the shutter 14 maintains its closed state, and therefore, the developing roller 12 is not damaged during insertion. In addition, the user is not required to remove the developing-roller protection member by his hands before insertion of the developing cartridge as in the conventional system.

Furthermore, the shutter locking is automatically released when the developing cartridge is mounted to the main assembly 30 of the image forming apparatus, and only by rotation thereof after the insertion, the shutter 14 is released, and the developing roller 12 is faced to the photosensitive drum 1, thus completing the mounting operation. Thus, the mounting operativity is improved.

(Driving Mechanism of Developing Cartridge)

A description will be provided as to a drive transmission structure for transmission from the main assembly of the apparatus to the developing cartridge D.

As shown in as shown in FIGS. 11 and 12, a driving force receptor 22 for receiving a driving force from the main assembly of the apparatus 30 to rotate the developing roller 12, is provided in one of the cylindrical projected portions 13*c* at one of the frame ends. The gear 23*a* is meshed with a roller gear 23*b* mounted on the rotation shaft of the developing roller 12. When the driving force is transmitted to the receptor 22, the developing roller 12 rotates. The gear 23*a* is meshed also with the gear 23*b* mounted on the rotation shaft of the toner feeding member 15 through a gear 23*c* to transmit the rotating force to the toner feeding member 15.

The end of the driving force receptor 22 is in the form of a rib, which constitutes a coupling connectable with a drive transmission member of the main assembly of the apparatus.

On the other hand, the rotary unit 11 in the main assembly 30 of the image forming apparatus, is provided with a drive transmission member 24 for transmitting the driving force from a motor N, on the shaft faced to the driving force receptor 22 when the developing cartridge D is mounted in place. The drive transmission member 24, as shown in FIG.

11, is mounted for movement toward the shaft of the driving force receptor portion 22, and the end thereof is formed into a coupling engageable with the rib of the driving force receptor. Here, the term coupling configuration refers to the shape with which the driving force receiving portion 22 and the drive transmission member 24 are coupled when the drive transmission member 24 is moved relative to the driving force receiving portion 22, and when one of them rotates, the other also rotates. In this example, the receptor 22 has a plurality of recesses 22*a*, and the drive transmission member 24 is provided with a plurality of projections 24*a*, correspondingly. By rotation of the drive transmission member 24, while the meshing engagement between the recess 22*a* and the projection 24*a* is maintained, the driving force receptor portion 22 is rotated.

When the developing cartridge D is moved by rotation of the rotary unit 11 for the developing operation for the image formation, the drive transmission member 24 is moved toward the receptor 22 by a moving mechanism (unshown), and is engaged therewith to permit transmission of a driving force to the developing roller 12 or the like. By this structure, even if the stop position of the developing cartridge D relative to the photosensitive drum 1 is more or less deviated, or even if the generating lines of the photosensitive drum 1 and the rotary unit 11, are more or less deviated, the driving force transmission to the developing cartridge D is properly transmitted from the same position, and only the driving torque is transmitted, so that the influence of the meshing off-set between gears due to pitch non-uniformity or the like can be reduced.

Second Embodiment

Figure 13:
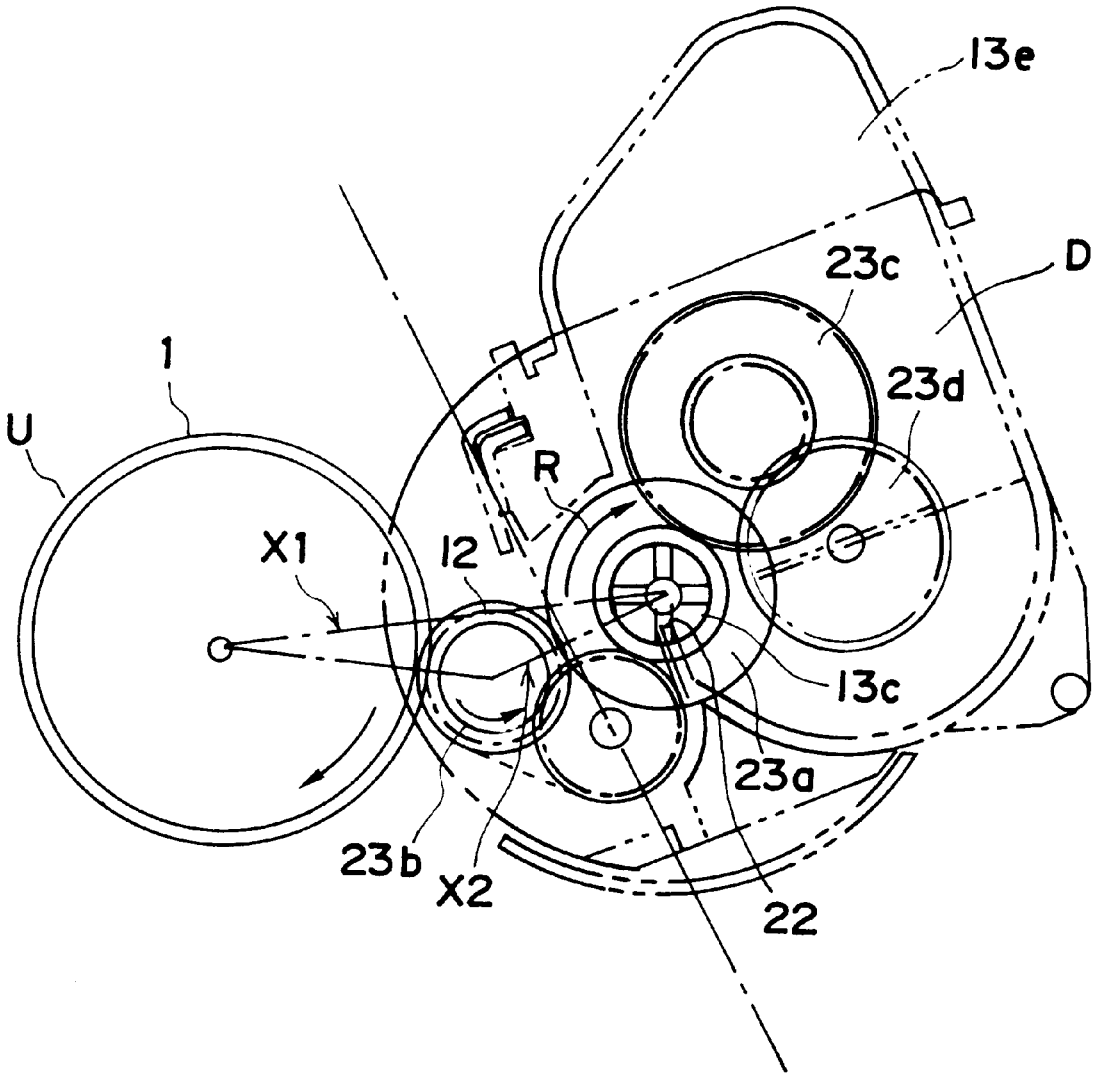
FIG. 13 is an illustration of a structure for stabilizing the pressure of a developing roller relative to a photosensitive drum.
Figure 14:
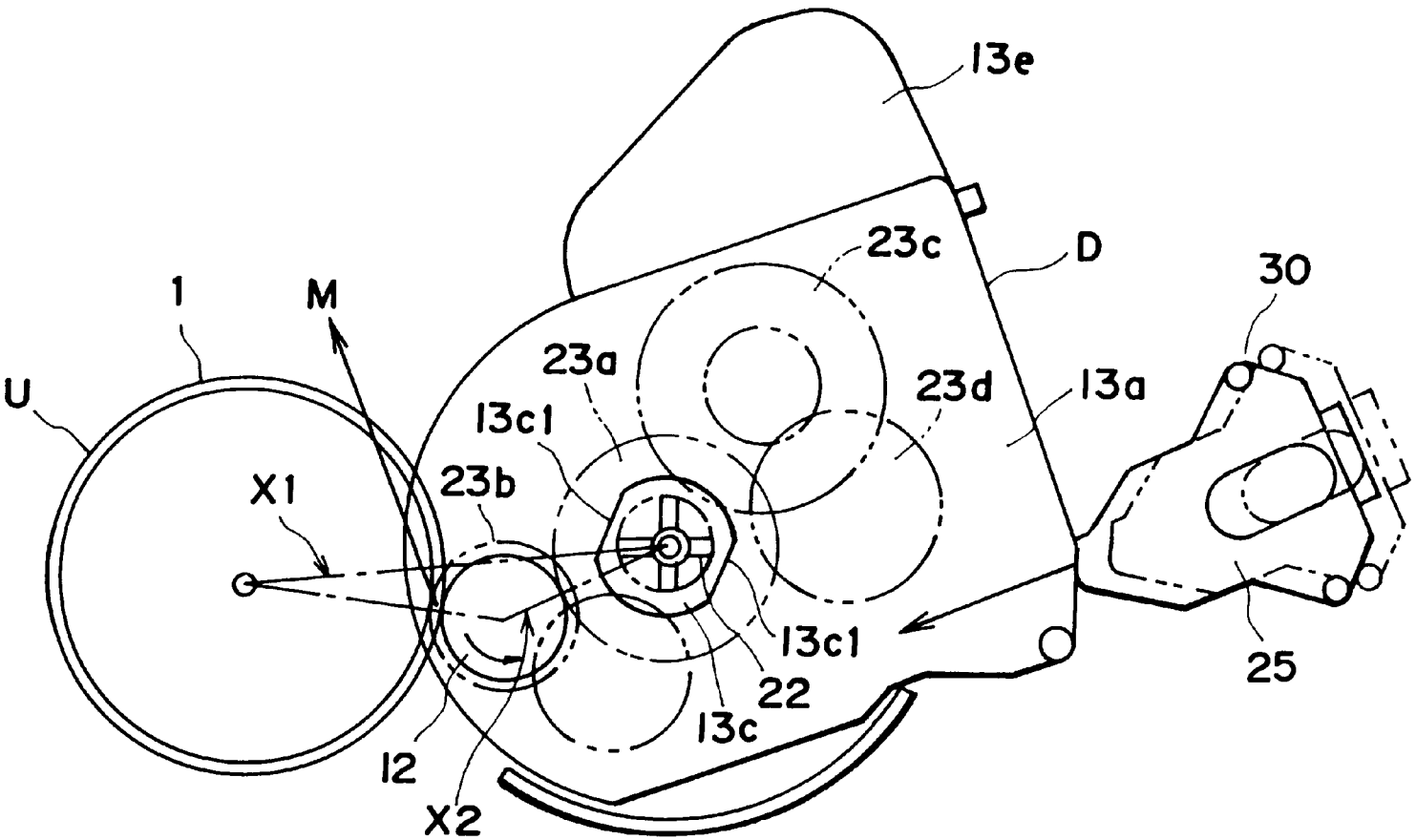
FIG. 14 is an illustration of a structure for stabilizing the pressure of a developing roller relative to a photosensitive drum.

Referring to FIGS. 13 and 14, a description will be provided as to a structure for stabilizing the pressure of the developing roller 12 to the photosensitive drum 1, according to a second embodiment of the present invention. The same reference numerals as in Embodiment 1 are assigned to the elements having the corresponding functions, end detailed descriptions thereof are omitted for simplicity.

As described in the first embodiment, the developing cartridge D receives the rotating force at the driving-force receptor from the drive-transmission member 24 of the main assembly 30 of the image forming apparatus at the development position.

As shown in FIG. 13, a line X1 is defined as a line connecting a rotation center of the developing cartridge D about the projected portion 13*c* and the center of rotation of the photosensitive drum 1, and a line X2 is defined as a line connecting the rotation center of the projected portion 13*c* and the center of rotation of the developing roller 12. When the developing cartridge D is at the development position, the line X2 is located upstream of the line X1 with respect to the driving rotational direction R toward the driving force receptor 22, as seen from the rotation center of the projected portion 13*c*.

By this structure, the developing roller 12 receives normally the force to bite into the photosensitive drum 1, so that developing roller 12 is stably urged toward the photosensitive drum 1 normally. This is advantageous in so-called contact development, but it particularly advantageous in non-contact development, since the gap is stabilized.

As shown in FIG. 14, an urging means is provided to fix the developing cartridge while urging it toward the photosensitive drum 1 when the developing cartridge is at the development position. M is the direction of the moment produced in the developing cartridge D by the urging direction P of the urging means. Designated by X1 is a line connecting the center of rotation of the developing cartridge D provided by the projected portion 13*c* and the center of rotation of the photosensitive drum 1. Designated by X2 is a line connecting the rotation center of the projected portion 13*c* and the center of rotation of the developing roller 12. The hen the line X2 is located upstream of the line X1 with respect to the moving direction M as seen from the rotation center of the projected portion 13*c*. The same effects are provided with this structure, too. The urging means urges the rear surface portion adjacent the toner accommodating portion 130 at each of the longitudinal ends of the developing cartridge D.

Third Embodiment

Referring to FIGS. 15 to 24, another embodiment of the developing cartridge D will be described. In this embodiment, the developing cartridge D is demountably mountable relative to the full-color laser beam printer shown in FIG. 1.

Also, the developing cartridge D comprises a developing roller 12, a development blade 16 and a toner accommodating portion 63*a* in the cartridge frame 63.

Figure 15:
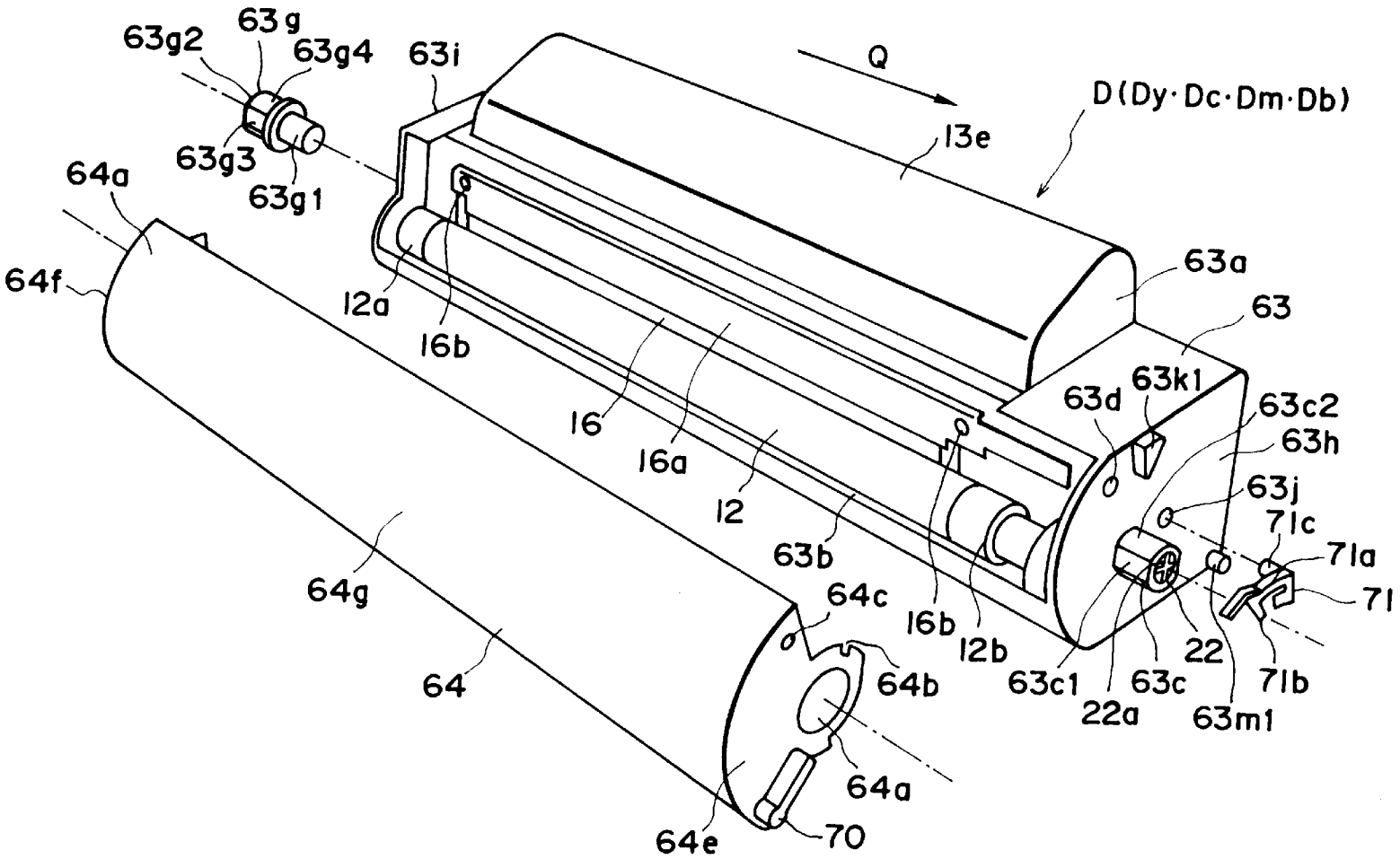
FIG. 15 is an exploded perspective view of a developing cartridge according to another embodiment of the present invention.
Figure 19:
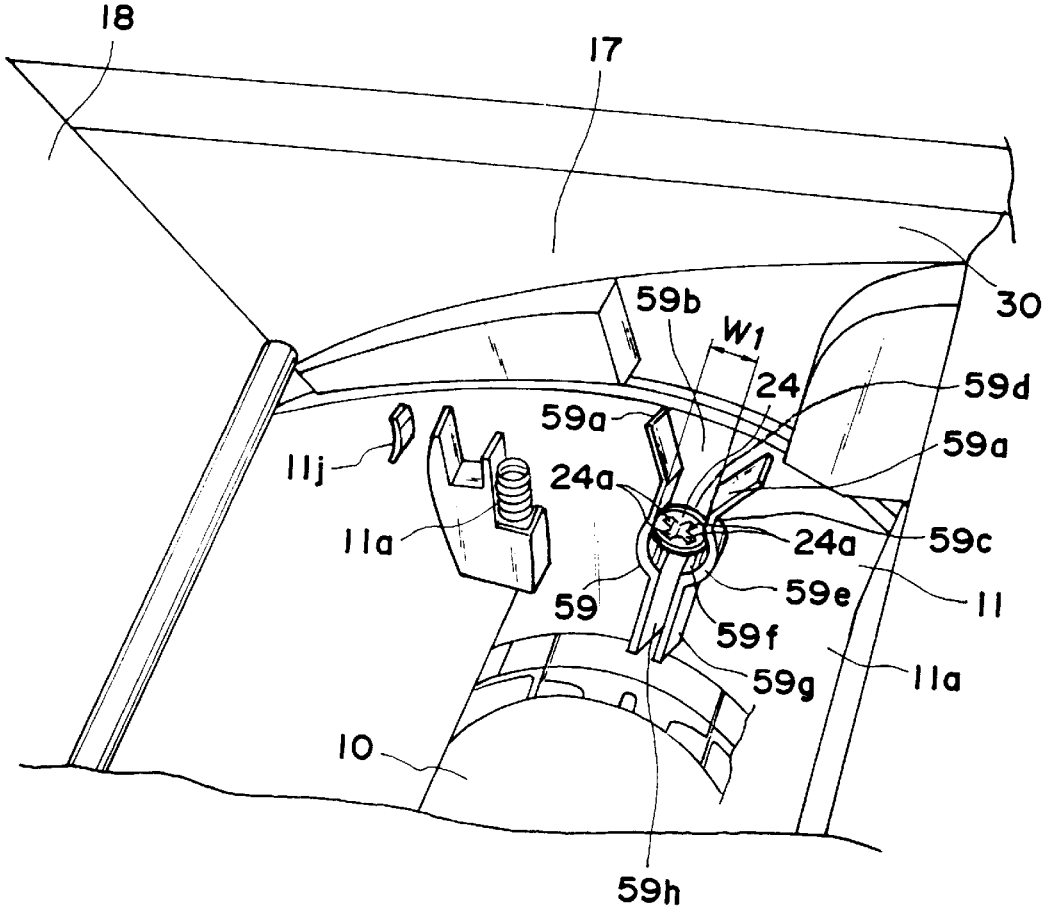
FIG. 19 is a perspective view of a guide portion in the main assembly of the apparatus.

When the user opens the cover 18, guides 59, constituting mounting means for the developing cartridge D,; are provided at four positions 4 of the rotary unit 11 in the main assembly 30 of the image forming apparatus. On the other hand, the shutter 64 of the developing cartridge D is provided with a guide portion 70, as shown in FIGS. 15, 17 and FIG. 18. By inserting the cartridge so that the guide portion 70 is guided along the guide 19, the developing cartridge D is inserted into the main assembly 30 of the image forming apparatus. The guide portion 70 is provided only on one side (in the longitudinal direction or the rotation axial direction of the developing roller 12) of the developing cartridge D. Therefore, the guide 59 is also provided only on one of the wall surfaces 11*a* of the rotary unit 11 (FIG. 19).

The developing cartridge D is inserted to the rotary unit 11 in a direction crossing with the longitudinal direction of the developing roller 12 with the developing roller 12 being at a leading side, while the user grips the grip 63*e*.

After the developing cartridge D is inserted to the main assembly of the apparatus 30, the user rotates the developing cartridge D, by which the shutter 64 is opened to permit the developing roller 12 to be exposed and face through the frame 63 to the photosensitive drum 1, thus enabling the developing operation.

The developing cartridge D mounted to the mounting position of the rotary unit 11 is urged in the longitudinal direction by a spherical urging member 26*b* positioned at the arcuate engaging portion 26*a* of the guide 26 provided on the other wall surface 11*b* of the rotary unit 11 (namely, urged to the side having the driving force receptor 22). The urging member 26*b* is urged elastically by a spring (unshown). The developing cartridge D is urged toward the driving side. Therefore, the developing cartridge D is mounted to the rotary unit 11 (main assembly of the apparatus), using as a reference the side having the driving force receptor member 22 in the longitudinal direction of the developing roller 12.

Figure 16:
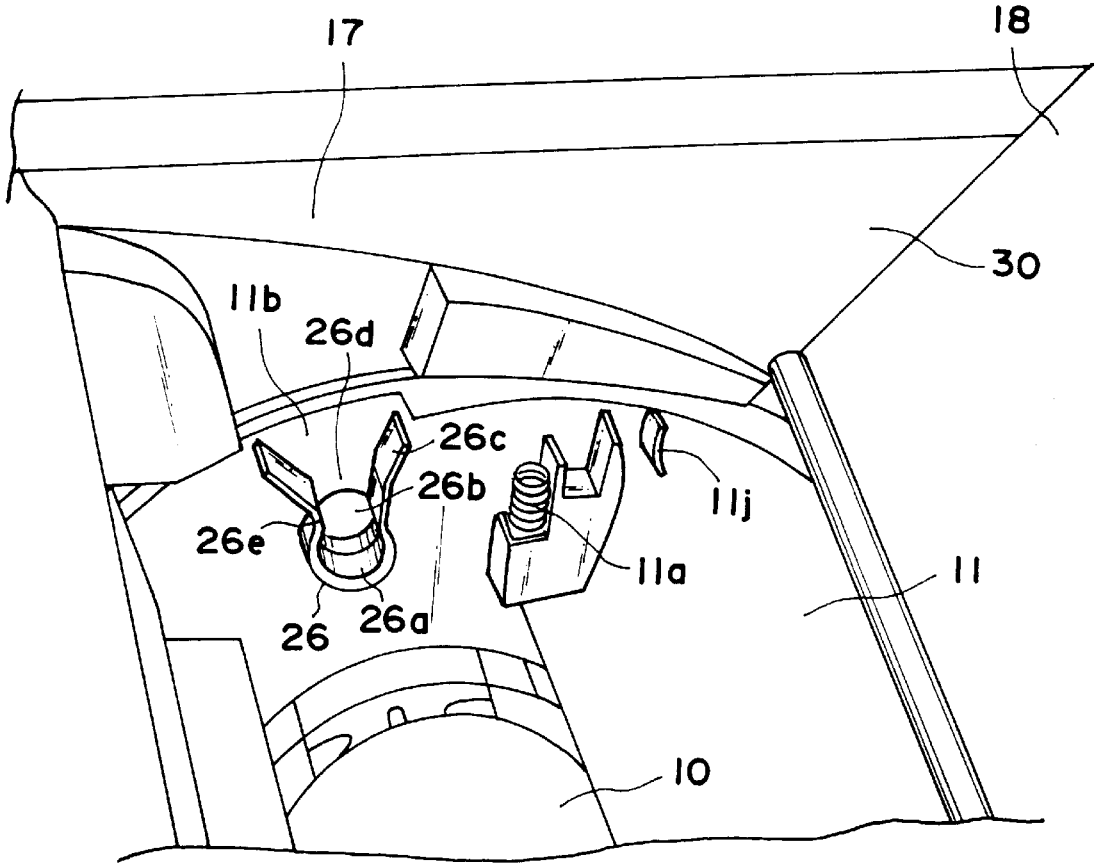
FIG. 16 is a perspective view of a guide portion providing the main assembly of the apparatus.

The developing cartridge D will be described in more detail, referring to FIGS. 15, 17, (*a*), (*b*), and FIGS. 18, (*a*) and (*b*). FIG. 16 is a perspective view of the developing cartridge D wherein shutter 64 or the like is omitted. FIGS. 17(*a*), 17(*b*), are both side views of the developing cartridge D when the shutter 64 is closed, and FIGS. 18, (*a*), 18(*b*), are both side views of the developing cartridge when the shutter 64 are opened.

As shown in FIG. 15, the frame 63 of the developing cartridge D is provided with an opening 63*b* extended in the longitudinal direction, and the developing roller 12 is mounted on the frame 63 so as to be exposed through the opening 63*b*. Substantially at a central portion of one longitudinal direction end side 63*h* of the frame 63, a projected portion 63*c* integral with the frame 13 is formed. The projected portion 63*c* functions as a guide when the developing cartridge D is inserted into the main assembly 30 of the image forming apparatus and as a center of rotation for the developing cartridge D. The projected portions 63*c* is cylindrical.

At substantially the central portion of the other side of the frame 63, a projected portion 63*g* is demountably mounted on the frame 63 (frame 63 shows the demounted state). The projected portion 63*g* is mounted to the frame 63 by inserting the inserting portion 63*g*1 into a hole (unshown) formed in the side 63*i*. The end of the inserting portion 63*g*1 is provided with a claw configuration portion (unshown), and by engaging the claw portion with the frame 63, projected portion 63*g* is mounted on the frame 63. When the developing cartridge D is mounted to the mounting position of the rotary unit 11, the end surface 63*g*2 of the projected portion 63*g* is urged to the member 26*b*. Therefore, the developing cartridge D is urged toward the side 63*h* (in the direction indicated by the arrow Q). The developing cartridge D is mounted to the rotary unit 11 of the main assembly of the apparatus 30, using, as a reference, the side 63*h* of the driving force receptor member 22.

Both of the longitudinal ends of the developing roller 12 are provided with spacer rollers 12*a*, 12*b*, respectively. Therefore, at the development position, the spacer rollers 12*a*, 12*b* are urged to the peripheral surface of the photosensitive drum 1 by the urging force of the urging means 25, similarly to the foregoing, so that a predetermined gap is maintained between the developing roller 12 and the photosensitive drum 1. The developing blade 16 is made of rubber, and is mounted to the frame 63 by mounting a plate 16*a* for supporting the rubber blade to the frame with screws 16*b*.

A locking member 71 is mounted to one side of the developing cartridge D (in FIG. 16, it is omitted) The locking member 71 is mounted on a cartridge frame portion 63*h* at one longitudinal end portion of the developing roller 12 as the developing means. It comprises a locking engaging portion 71*b* engageable with the shutter engaging portion 64*b* provided in the shutter portion 64, a supporting portion 71*a* for supporting the locking engaging portion 71*b*, and a mounting portion 71*c* mounted to the cartridge frame portion 63*h*. Designated by 63*j* is a hole into which the mounting portion is inserted. The locking member 71 is an integrally-molded product made of plastic resin material, and locks the shutter at the closing position by engagement between the locking; engaging portion 71*h* and the shutter-engaging portion 64*b*. In the process of mounting the developing cartridge D to the mounting position of the main assembly of the apparatus 30, a part of the locking member 71 contactsa fixing portion provided in the main assembly of the apparatus 30, by which the supporting portion 71*a* is elastically deformed, so that locking-engaging portion 71*b* is disengaged from the shutter-engaging portion 64*b* to release the locking of the shutter 64.

A projection 63*d*, as a semi-spherical engaging portion, is provided only on one longitudinal end of the developing cartridge frame 63, as shown in FIG. 18. Correspondingly, the shutter 64 is provided with an engaging portion in the form of a hole 64*c* engageable with the projection 63*d*. Therefore, when the shutter 64 is in the closing position, the projection 63*d* is engaged in hole 64*c*. So, even if the locking by the locking member 21 of the shutter 14 is released, the developing cartridge frame 13 is prevented from rotating to an unstable position relative to the shutter 14.

One and the other ends of the cartridge frame 63 are provided with an orientation determination boss 63*m* and a spring receptor portion 63*k* in the form of projections.

As shown in FIG. 17, (*a*), designated by 73 is a grip for pulling a toner seal out, and it is used when it is to be removed.

The shutter 64 will be described.

Both side walls 64*e*, 64*f* of the shutter 64 are provided with round holes 640*a*, which are engaged with the projected portion 63*c*, and 63*g*, by which the shutter 64 is rotatably mounted to the frame 63. As shown in FIG. 17, when the shutter 64 is closed, the opening 63*b* is closed, and the developing roller 12 is covered by the shutter 64. When the developing cartridge D is out of the main assembly of the apparatus 30, the shutter 64 is closed, so that developing roller 12 is protected from the deposition of foreign matter such as dust, and the roller 12 or the like Is protected from damage. In addition, foreign matter does not enter the developing cartridge D As shown in FIG. 17, when the shutter 64 is in the closing position by the locking portion 71, the shutter 64 is locked at the closing position by the locking of the engaging portion 71*b* band the engagement recess 64*b*, so that it is prevented from unintentional opening.

When the developing cartridge D is mounted on the main assembly 30 of the image forming apparatus, the locking is automatically released to permit the opening of the shutter 64.

Referring to FIG. 19-FIG. 24, a description will be provided as to a process of mounting the developing cartridge D to the main assembly of the apparatus 30, and a process of positioning the main assembly of the apparatus 30.

As shown in FIG. 19, a guide 59 as a supporting member provided in one of the inner walls 11*a* of the rotary unit 11, comprises a guide-inserting portion 59*b* having an inclined portion 59*a* inclined and open upwardly, a projected-portion inserting portion 59*d* having substantially parallel linear ribs 59*c*, an engaging portion 59*f*, as a supporting member, having an arcuate rib 59*e*, and guide-portion inserting portion 59*h* having substantially parallel DC ribs 59*g* continuing to the engaging portion 59*f*.

Figure 20:
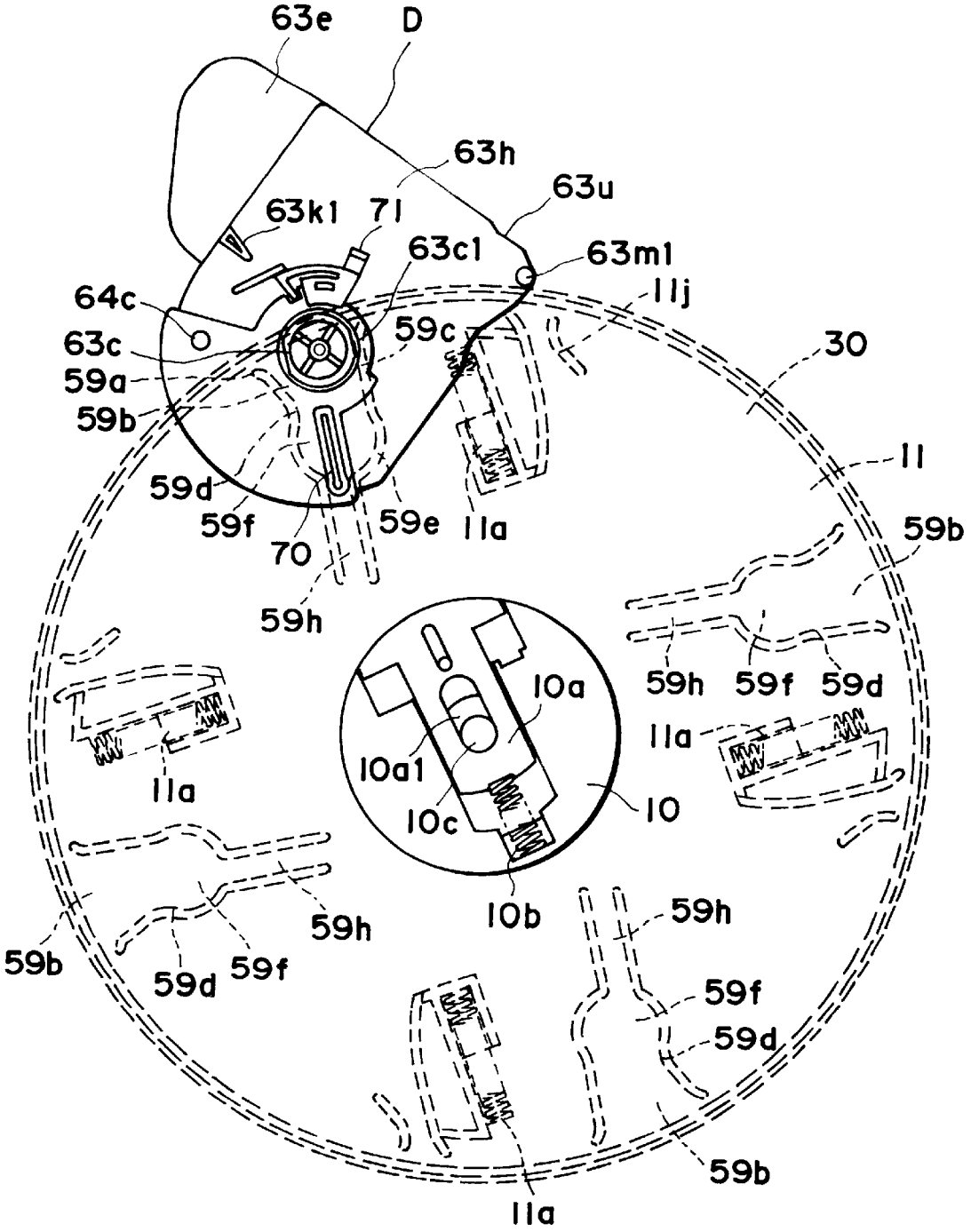
FIG. 20 is a side view showing a process of mounting a developing cartridge to a rotary unit.

When the developing cartridge D is inserted to the main assembly of the apparatus 30, the user inserts the developing cartridge D while guiding the guide portion 70 and projected portion 63*c* of the shutter 64 along the guide inserting portion 59*a* (FIG. 20).

Figure 21:
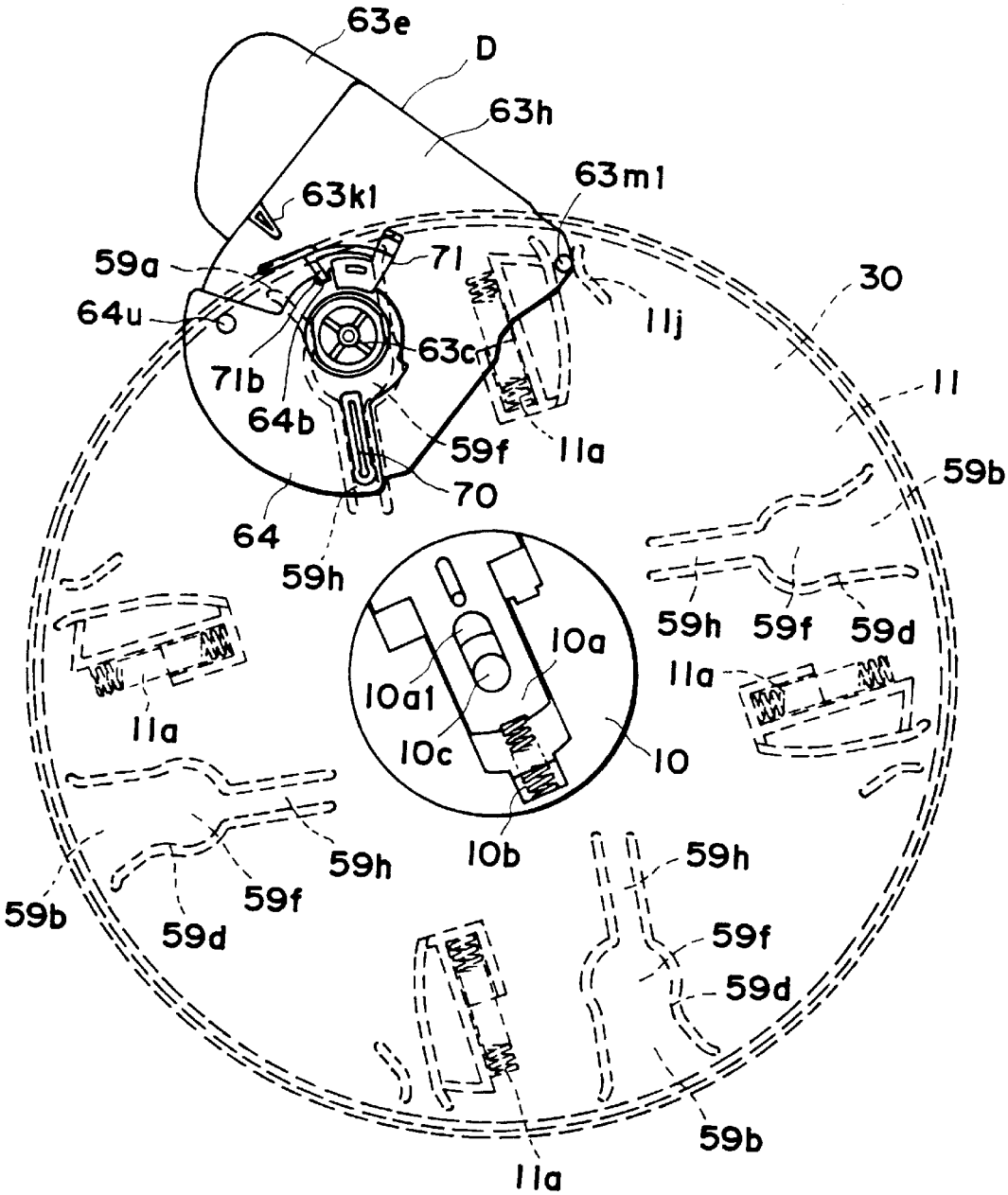
FIG. 21 is a side view showing a process of mounting a developing cartridge to a rotary unit.

When the developing cartridge D is inserted, as shown in FIG. 21, the projected portion 63*c* at one end of the developing cartridge D enters the linear portion of the projected portion inserting portion 59*d*. The projected portion 63*c* is provided with a cutting portion 63*c*1 which is provided by linearly cutting a cylinder at an angle parallel the linear rib 59*c*. The two linear ribs 59*c* which are engageable therewith have a width that permits only the parallel translational motion of the cutting portion 63*c*1 (direction W1 in FIG. 19). Therefore, when the developing cartridge D is inserted while the cutting portion 63*c*1 is engaged with the linear rib 59*c*, the developing cartridge D maintains a predetermined angle (orientation).

Figure 22:
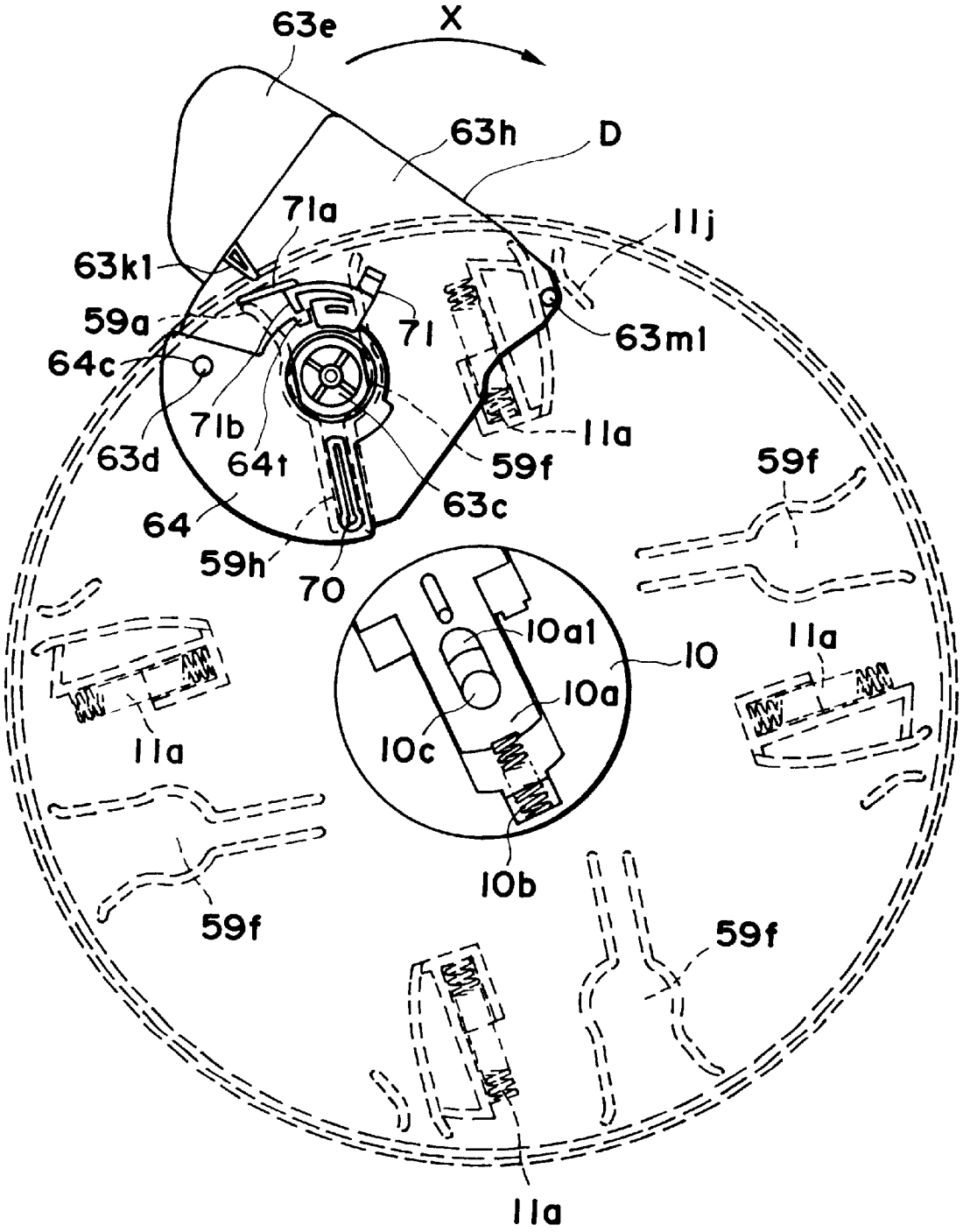
FIG. 22 is a side view showing a process of mounting a developing cartridge to a rotary unit.
Figure 23:
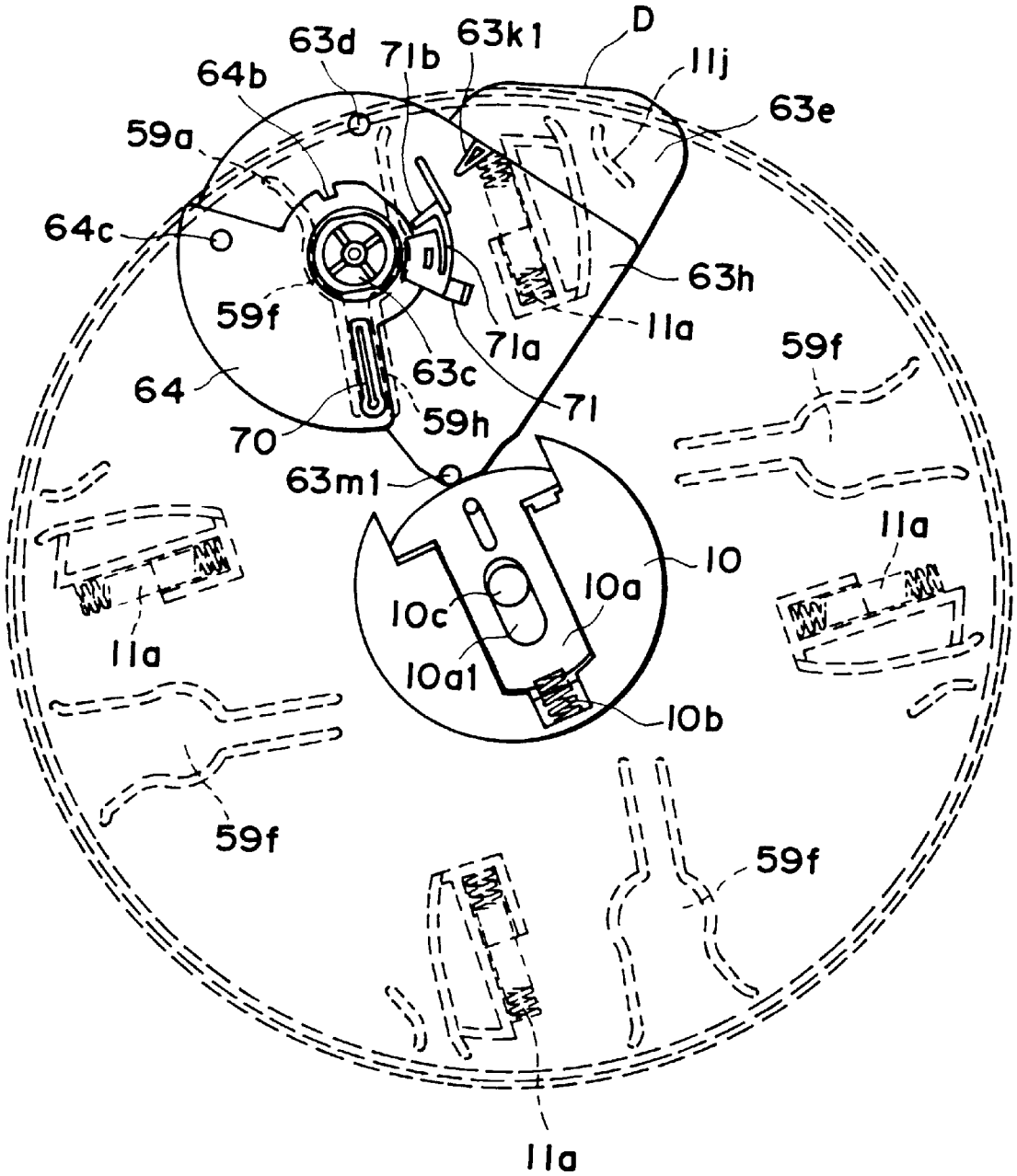
FIG. 23 is a side view showing a process of mounting a developing cartridge to a rotary unit.

As shown in FIG. 22, when the projected portion 63*c* is inserted to the arcuate rib 59*e* an end of one of the two inclined portions 59*a*, abutts an arm portion 71*a* locking the shutter 64 and raises it, as shown in FIG. 22 By this, the arm portion 71*a* elastically deforms so that engaging portion 71*b* is disengaged from the engagement recess 64*b* to release the locking of shutter 64 (in this embodiment, the inclined portion 59*a* also functions to release the locking member 21). Thus, the shutter 64 becomes rotatable relative to the developing cartridge frame 63. The arcuate rib 59*e* has a radius for permitting rotation of the cylindrical projected portion 63*c*, and the developing cartridge D is in a rotatable state about the cylindrical projected portion 63*c*.

On the other hand, the projected portion 63*g* at the other side 63*i* of the developing cartridge D, is guided by the inclined portion 26*c* of the guide 26 and enters the guide inserting portion 26*d* When the developing cartridge D is inserted further, the cutting portion 63*g*3 is engaged with the linear rib 26*e*, and the developing cartridge D is inserted, maintaining the predetermined angle (orientation), similarly to the case of the projected portion 63*c*. It is inserted until the projected portion 63*g* reaches the arcuate rib (engaging portion) 26*a*. The arcuate rib 26*a* has a radius for permitting rotation of the projected portion 63*g*. Therefore, the projected portion 63*c* of one longitudinal end of the frame 63 is supported by the arcuate rib 59*c* of the guide 59, and the projected portion 63*g* at the other end is supported by the arcuate rib 26*a* of the guide 26, and the developing cartridge D is supported on the rotary unit 11 for rotation about the both projected portions 63*c* and 63*g*.

The user pushes by hand the grip portion 63*e* of the frame 63 in the state shown in FIG. 22. The shutter 64 is fixed since the guide portion 70 is sandwiched by the guide portion inserting portion 59*h*, but the frame 63 is rotatable since the cylindrical projected portion 63*c* is rotatable in the arcuate rib 59*e*. Since the projected portion 63*g* is rotatable at the arcuate rib 26*a*, the semi-spherical projection 63*d* rotates beyond the hole 64*c* of the shutter 64 to a predetermined position(in the direction of an arrow X in FIG. 22). As described above in the foregoing, in this example, the shutter 64 is provided with an insertion guide portion 70, and therefore, the frame 63 is easily rotated while the shutter 64 is stationary. When it is rotated to the predetermined position, the frame 63 is positioned by positioning means, which will be described hereinafter, and the developing cartridge D is mounted in place.

Figure 24:
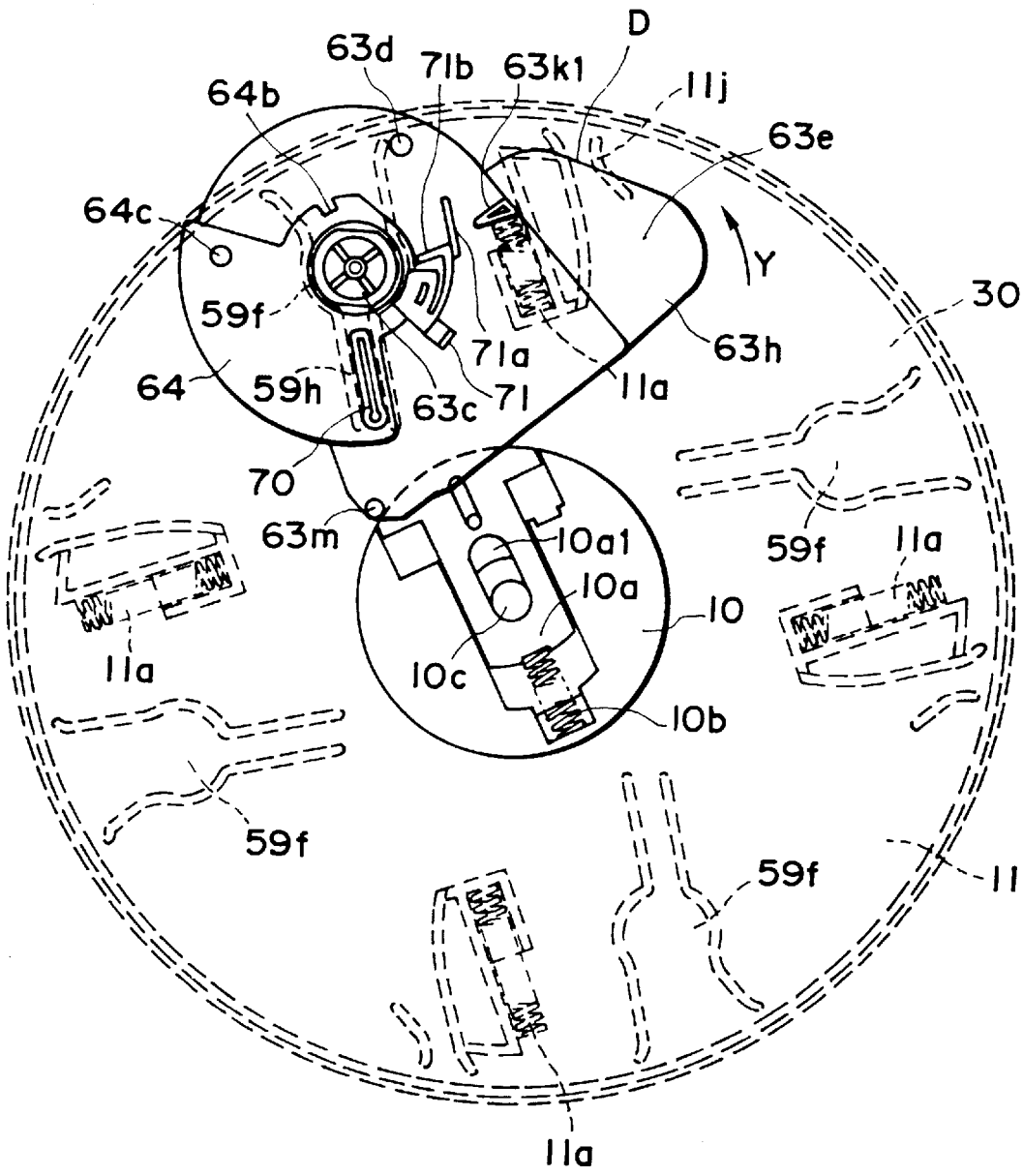
FIG. 24 is a side view showing a process of mounting a developing cartridge to a rotary unit.

When the developing cartridge D is rotated in the direction indicated by the arrow X in the state shown in FIG. 22, the orientation determination bosses 63*m,;* provided on the ends 63*h*, i of the developing device frame 63, lowers translatable slide members 10*a* provided on the opposite ends of the center shaft 10 of the rotary unit and urged by springs 10*b*. The slide portion 10*a* is slidable by engagement between the elongated hole 10*a*1 and the shaft 10*c*. When the frame 63 is further rotated, as shown in FIG. 24, the spring receptor portion 63*k,;* provided on the opposite lateral ends of the frame 63, are pressed by the spring 11*a* provided at the end portions of the rotary unit. By this, the frame 63 is urged in the direction of rotation in the direction of arrow Y (FIG. 24). However, since the orientation determination bosses 63*m* abut the center shaft 10 of the rotary unit 11, the orientation of the frame 63 is stabilized at the mounting position shown in FIG. 24.

Thus, the developing cartridge D is mounted at a predetermined position of the rotary unit 11.

Designated by 11*j* is a guide portion for guiding the boss 63*m*.

By this, the shutter 64 is opened relative to the frame 63 to permit exposure of developing roller 12 and so that it faces the photosensitive drum 1. During this mounting operation, the user can feel the rotation-start position for the developing cartridge D on the basis of the click feeling provided by the removal of the semi-spherical projection 63*d* from the hole 64*c* the shutter 64.

The diameter of the arcuate portion of the projected portion 63*c* is larger than the distance between the cutting portions 63*c*1, and therefore, the projected portion 63*c* is not disengaged from the linear rib 59*c* when the projected portion 63*c* is rotated at the position of the arcuate rib 59*c*.

On the other hand, when the developing cartridge D is taken out of the main assembly 30 of the image forming apparatus, the user rotates the frame 63 in a opposite direction, by which the cutting portion 63*c*1 is brought parallel with the linear rib 59*c*, and the shutter 64 is closed. The user can feel the rotation-completion position of the developing cartridge D on the basis of the click feeling upon the engagement of the semi-spherical projection 63*d* into the hole 64*c*. When the developing cartridge D is taken out of the main assembly of the apparatus, the arm portion 71*a* of the locking member 71 elastically restores, and the engaging portion 71*b* enters the engagement recess 64*b*, as shown in FIG. 21. By this, the shutter 64 is automatically locked.

Since the developing cartridge D is provided with a shutter 64, the developing roller 12 is protected from the deposition of foreign matter,; such as dust, and since the shutter 64 is provided with the locking mechanism, the shutter 64 is prevented from unintentionally opened.

When the developing device is inserted into the main assembly 30 of image forming apparatus, the shutter 64 maintains its closed state, and therefore, the developing roller 12 is not damaged during insertion. Additionally, it is not necessary for the user to remove a developing-roller protection member or the like before insertion of the developing device.

Furthermore, the shutter locking is automatically released when the developing cartridge is mounted to the main assembly 30 of the image forming apparatus, and only by rotation thereof after the insertion, the shutter 64 is released, and the developing roller 12 faces the photosensitive drum 1, thus completing the mounting operation. Thus, the mounting operativity is improved.

A description will be provided as to positioning of the developing cartridge D.

Figure 25:
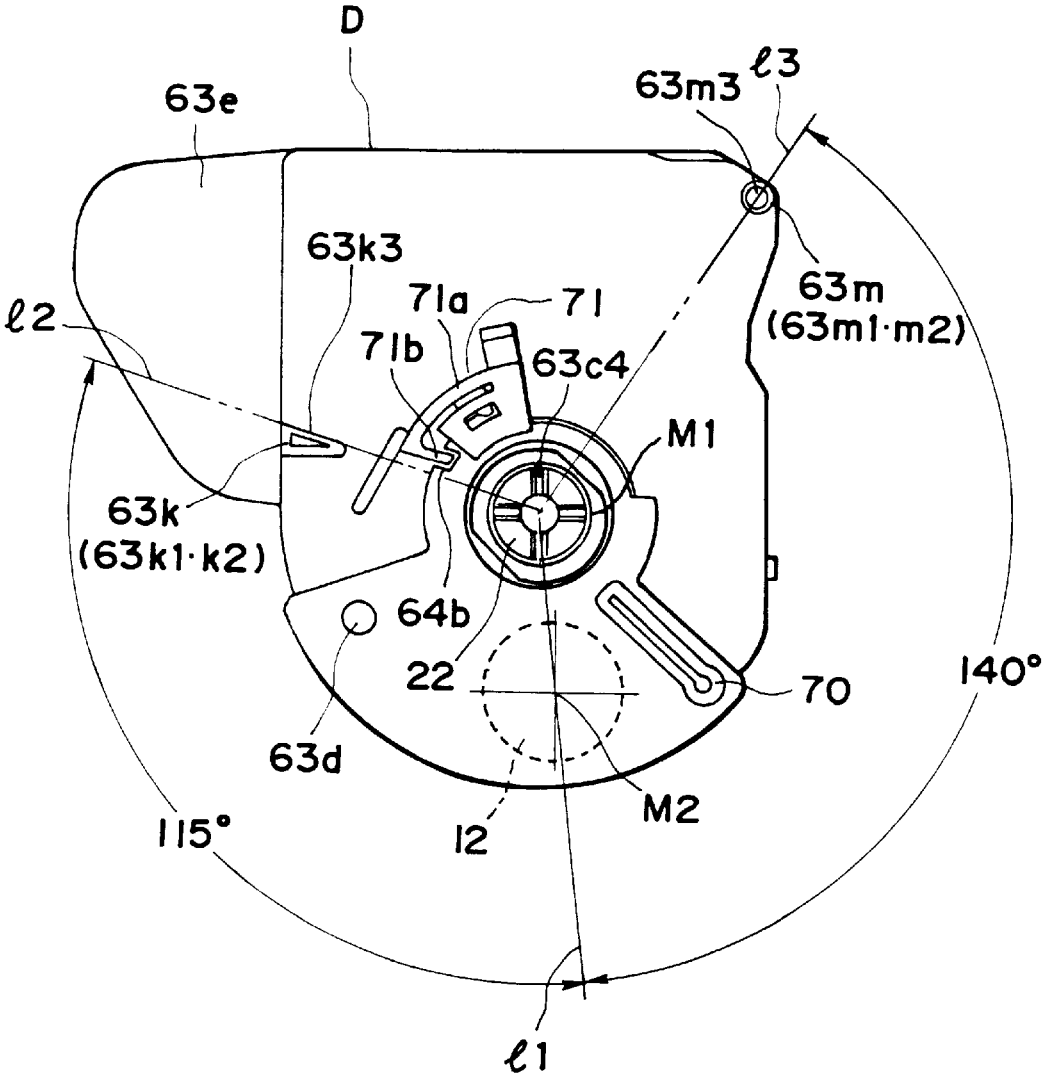
FIG. 25 is a side view showing a positional relation between a spring receptor and a boss.

Referring to FIG. 25, the arrangements of the spring receptor portion 63*k* (63*k*1, 63*k*2) and the orientation determination boss 63*m*, will be described.

One longitudinal end portion 63*h* of the developing roller 12 will be described, and the same applies to the other end portion 63*i*.

In this example, the spring receptor portion 63*k* is disposed within a range of approximately 100–130 degrees from a line 11 connecting a center of rotation M1 of the developing roller 12 and the center of rotation M2 of the driving force receptor portion 22 as seen in the longitudinal direction of the developing roller 12.

More particularly, in this example, the spring receptor portion 63*k*1 (63*k*2) is disposed at such a position that the angle formed between the line 11 connecting the center of rotation M1 of the developing roller 12 and the center of rotation M2 of the driving force receptor member 22, and the line 12 connecting the spring receptor surface 63*k*3 and the center of rotation M1, is approximately 100–130 degrees. In this example, the angle is approximately 115 degrees.

The boss 63*m* (63*m*1, 63*m*2) is disposed within a range of approximately 130–150 degrees from the line 11 across the line 11 from the spring receptor portion 63*k*.

More particularly, in this example, the angle formed between the line 11 and a line 13 connecting the center of the boss 63*m* and the center of rotation M1, is approximately 130–150 degrees. In this example, the angle is approximately 140 degrees.

By disposing the spring receptor portion 63*k* (63*k*1, 63*k*2) and the boss 63*m* (63*m*1, 63*m*2), the spring receptor portion 63*k* can properly receive the elastic force of the spring 11*a* provided in the main assembly of the apparatus 30. In addition, the boss 63*m* properly abuts the shaft 10 Therefore, the developing cartridge D is accurately positioned to the mounting position.

The boss 63*m* (63*m*1, 63*m*2) is projected outwardly from the side surface 63*h*, i of the frame 62 by approximately 2 mm–15 mm. In this embodiment, the boss 63*m* is projected by approximately 4 mm.

The spring receptor portion 63*k* (63*k*1, 63*k*2) is projected outwardly from the side surface 63*h*, i by approximately 2 mm–20 mm. In this embodiment, the spring receptor portion 63*k*1 is projected by approximately 10 mm, and 63*k*2 is projected by approximately 6 mm. Therefore, a projection length is larger in the spring receptor portion 63*k*1 provided at a driving-force receiving side.

The features of the shutter of the developing cartridge D are summarized as follows.

A developing cartridge D for developing a latent image formed on the photosensitive member 1, wherein said developing cartridge is detachably mountable to a main assembly 30 of an electrophotographic image forming apparatus, and wherein the main assembly 30 includes a main assembly guide 59 for guiding said developing cartridge D toward a mounting position in the main assembly, and includes a fixed portion 59. The developing cartridge comprises a cartridge frame 63 of made plastic resin material; and a developing roller 12 for developing, with toner, the latent image formed on the photosensitive member 1 of the main assembly 30 of the apparatus, when mounted to the main assembly of the electrophotographic image forming apparatus, wherein said developing roller carries on its peripheral surface, an amount of toner thereon is regulated by a development blade 16. It further comprises a driving; force receptor member 22 for receiving, from the main assembly of said device, driving force and for rotating the developing roller when said cartridge is mounted to the main assembly 30, the driving force receptor means 22 is provided exposed adjacent one end of said cartridge frame portion 63*h* in a longitudinal direction made of said developing roller; a toner accommodating portion 63*a* for accommodating the toner; a shutter 64 made of plastic resin material,; which is movable between a closing position for covering a portion of the developing roller exposed from the cartridge frame portion 63 and an opening position for exposing said developing roller; and a cartridge guide 70 for guiding said developing cartridge toward the mounting position by cooperation with said main assembly guide 26, 59 when said developing cartridge is to be mounted to the mounting position, said cartridge guide being provided on said shutter portion 64*e* which is movable along said cartridge frame portion 63*h* provided adjacent said one end, wherein said cartridge guide has an elongated shape and is extended toward said driving force receptor member 22. It further comprises a locking member 71, of plastic resin material, for releasably locking said shutter at said closing position, said locking member 71 including locking engaging portion 71*b* engageable with a shutter engaging portion 64*b* provided in said shutter portion, a supporting portion 71*a* for supporting said locking engaging portion 71*b*, and a mounting portion 71*c* mounted on said cartridge frame portion, wherein said locking member is an integrally-molded product of plastic resin material, and said shutter is locked at said closing position by engagement between said locking engaging portion 71*b* and said shutter engaging portion 64*b*. In the process of mounting of said developing cartridge to a mounting position of the main assembly of the apparatus, a part of said locking member is contacted to a fixed portion 59*a* of the main assembly of the apparatus, so that supporting portion 71*a* is flexed to disengage said locking engaging portion from said shutter engaging portion, thus releasing locking of said shutter. In the process of mounting of said developing cartridge to a mounting position of the main assembly of the apparatus, a part of said locking member 71 is contacted to a fixed portion 59*a* of the main assembly 30 of the apparatus, so that supporting portion 71*a* is flexed to disengage said locking engaging portion 71*b* from said shutter engaging portion 64*b*, thus releasing locking of said shutter 64. The shutter is positioned at said opening position by a user rotating said cartridge frame to mount the developing cartridge at the mounting position while said guide is in engagement with a main assembly guide of the e main assembly of the apparatus.

The shutter 64 includes an arcuate portion 64*g* extended along the longitudinal direction of the developing roller 12 to cover the exposed portion of the developing roller 12, and a support portions 64*e*, f at one and the other longitudinal ends of the arcuate portion 64*g* to rotatably support the arcuate portion 64*g* on the cartridge frame 63, wherein the support portions 64*e*, f are rotatable mounted to the portions 63*h* and i of the cartridge frame at the longitudinal one and the other ends. The cartridge guide 70 is provided on the support portion 64*e* provided at the one end.

The supporting portion 64*e* is rotatable about the same axis as that of said driving force receptor member 22.

The cartridge guide 70 has an elongated shape, and is extended toward said driving force receptor means 22.

The cartridge D further comprises an urged portion 63*g* on said cartridge frame portion adjacent said one end, wherein said urged portion is urged by elastic force of a spring member provided in the main assembly of the apparatus, wherein said developing cartridge is urged toward said one end by the elastic force of said spring member. The developing cartridge D is urged toward one end in the longitudinal direction of the developing roller 12 by the elastic force of the spring member.

The features of the structure for the mounting of the developing cartridge D to the main assembly of the apparatus 30 are summarized as follows.

The developing cartridge D for developing a latent image formed on the photosensitive member 1, wherein said developing cartridge is detachably mountable to a main assembly 30 of an electrophotographic image forming apparatus, said developing cartridge comprises: a cartridge frame 63; developing means (roller 12) for developing, with toner, the latent image formed on the photosensitive member of the main assembly of the apparatus, when mounted to the main assembly of the electrophotographic image forming apparatus; a first projected portion 63*c* projected from a frame portion 63*h* of said cartridge adjacent one longitudinal end of said developing means, wherein said first projected portion is supported by a first supporting member 59 provided in the main assembly, when the cartridge is mounted to the main assembly of the electrophotographic image forming apparatus; a second projected portion 63*g* projected from the frame portion 63*i* adjacent the other longitudinal end of the developing means, wherein said second projected portion is supported by a second supporting member 26 provided in the main assembly, when the cartridge is mounted to the main assembly of the electrophotographic image forming apparatus; a driving force receptor member 22 for receiving, from the main assembly of the device, driving force for rotating the developing means, when said cartridge is mounted to the main assembly, wherein said driving force receptor member is exposed from said frame portion 63*h* adjacent said one end; and a guide 70 for guiding said developing cartridge toward a mounting position when said cartridge is mounted to the main assembly.

The guide 70 is movable along an outside of said frame portion 63*g* adjacent said one end.

The guide 70 has an elongated shape, and is rotatable about said driving force receptor member 22. A longitudinal direction of said guide 70 is directed to said driving force receptor member 22.

The cartridge further comprises a rotatable member (shutter 64) rotatably mounted on said frame portion 63. said guide is provided on said rotatable member. said guide 70 is provided on said rotatable member 64.

The rotatable member 64 includes a shutter 64 for covering a portion of said developing means exposed from said cartridge frame 63. said shutter 64 is movable between a closing position for covering said exposed portion and an opening position for exposing said developing means. Said guide 70 is projected longitudinally outwardly and is provided on said shutter 64.

The guide 70 is provided on a portion of said shutter 64 which is movable along an outside of said cartridge frame portion 63*h* adjacent said one end.

The first projected portion 63*c* includes two flat surface portions 63*c*1, opposed to each other, for guiding said developing cartridge toward the mounting position in the main assembly when said cartridge is mounted to said main assembly, and two curved surface portions 63*c*2, opposed to each other, for engaging with a recess 59*f* of said first supporting member 59.

The second projected portion 63*g* includes two flat surface portions 63*g*3, opposed to each other, for guiding said developing cartridge toward the mounting position in the main assembly when said cartridge is mounted to said main assembly, and two curved surface portions 63*g*4, opposed to each other, for engaging with a recess 26*a* of said second supporting member 26. A distance L1 (FIG. 17, (*b*)) between outside surfaces of said flat surface portion 63*c*1 of said first projected portion 63*c*, is larger than a distance L2 (FIG. 17, (*a*)) between outside surfaces of said flat surface portion 63*g*3 of said second projected portion 63*g*.

A distance L1 between outer surfaces of said flat surface portions 63*c*1 of said first projected portion is approx. 13 mm–15 mm, and a distance L2 between outer surfaces of said flat surface portions 63*g*3 of said second projected portion 63*g* is approx. 2 mm–9 mm. In this embodiment, L1 is approx. 15 mm, and L2 is approx. 9 mm.

A distance L3 (FIG. 17, (*b*)) between remotest outer surface portions of said curved surface portions 63*c*2 of said first projected portion 63*c* is approx. 13 mm–17 mm, and a distance L4 (FIG. 17, (*a*)) between remotest outer surface portions of said curved surface portions 63*g*4 of said second projected portion 63*g* is approx. 7 mm–11 mm. In this embodiment, L3 is approx. 17 mm, and L4 is approx. 11 mm.

The driving force receptor member 22 is enclosed by said first projected portion 63*c*. The driving force receptor member 22 is provided with a recess 22*a* for engagement with a projection 24*a* of the main assembly of the apparatus, wherein by engagement between said projection and said recess, driving force is transmitted from the main assembly to said developing means.

The curved surface portion is of continuous arcuate configuration.

When said developing cartridge D rotates from said mounting position (FIG. 24) to a development position (FIGS. 13 and 14) for developing a latent image formed on the photosensitive member, said developing cartridge rotates about said first projected portion 63*c* and second projected portion 63*g*.

The developing cartridge reaches said mounting position (FIG. 24) by approx. 90–120 degrees rotation from a mounting-and-demounting position (FIG. 22) about said first projected portion 63*c* and said second projected portion 63*g*. said mounting-and-demounting position (FIG. 22) is a position where said first projected portion 63*c* and said second projected portion 63*g* enters said first supporting member 59 and said second supporting member 26, and where said flat surface portion 63*g*3 is opposing to engaging portions of said first supporting member and said second supporting member, respectively. In this embodiment, it is rotated through approx. 105 degrees.

The developing cartridge reaches a developing position by approx. 5–10 degrees rotation from said mounting position about the first projected portion 63*c* and the second projected portion 63*g*. said developing position is a position where spacer rollers 12*a* of said developing member is urged to said electrophotographic photosensitive member 1. In this embodiment, it is rotated through approx. 7 degrees.

The guide 70 functions to guide the developing cartridge D into the main assembly, and is displaceable relative to the first projection. Thus, in this embodiment, the guide 70 is displaceable so that when the developing cartridge is mounted to or demounted from the main assembly of the apparatus, the developing cartridge can be smoothly rotated. Additionally, when the developing cartridge is mounted to or demounted from the main assembly of the apparatus, the developing cartridge can be smoothly mounted or demounted by the combination of the substantially linear motion and the substantially rotational motions.

The guide 70 has an elongated shape, and rotates through approx. 90–120 degrees the first projected portion 63*c* to mounted the developing cartridge at the mounting position in main assembly of the apparatus.

The cartridge further comprises a driving force receptor member 22 for receiving, from the main assembly of said device, driving force for rotating said developing roller 12 when said developing cartridge is mounted to the main assembly of said device, wherein said driving force receptor member 22 is provided on the same longitudinal end as having said first projected portion 63*c*, and wherein said guide is provided only of the same side. Thus, the guide 70 is provided only on one side 63*h*, and therefore, the developing cartridge D can be smoothly mounted.

The mounting position of the developing cartridge is a position where the developing cartridge is correctly positioned in place in the main assembly of the apparatus.

The development position of the developing cartridge is a position where the developing cartridge is positioned for effecting the developing operation.

The mounting-and-demounting position of the developing cartridge is a position where the developing cartridge is mounted to or demounted from the supporting member provided in the main assembly of the apparatus. The supporting member is a member for supporting the developing cartridge when the developing cartridge is to be mounted to the mounting position.

The features for the positioning of the developing cartridge D relative to the main assembly of the apparatus are summarized as follows.

The developing cartridge D for developing a latent image formed on the photosensitive member 1, wherein said developing cartridge is detachably mountable to a main assembly 30 of an electrophotographic image forming apparatus, said developing cartridge comprises: a cartridge frame 63; developing roller 12 for developing, with toner, the latent image formed on the photosensitive member 1 of the main assembly of the apparatus, when mounted to the main assembly of the electrophotographic image forming apparatus; a first projected portion 63*c* outwardly projected from said cartridge frame portion 63*h* adjacent one longitudinal end of said developing means, wherein said first projected portion is supported by a first supporting member (guide) 59 provided in the main assembly 30 of the apparatus when said cartridge is mounted to the main assembly. It further comprises a second projected portion 63*g* outwardly projected from said cartridge frame portion adjacent the other longitudinal end of said developing means, wherein said second projected portion is supported by a second supporting member (guide) 26 provided in the main assembly of the apparatus when said cart ridge is mounted to the main assembly 30 It further comprises a first urging force receptor portion (spring receptor) 63*k*1 outwardly projected from said cartridge frame portion 63*h* adjacent one longitudinal end of said developing means, wherein said first urging force receptor portion receives urging force by a first elastic member 11*a* provided in the main assembly 30 when said cartridge is mounted to the main assembly. The first urging force receptor portion is integrally molded with said cartridge frame. A second urging force receptor portion 63*k*2 outwardly projected from said cartridge frame portion 63*i* adjacent the other longitudinal end of said developing means, wherein said second urging force receptor portion receives urging force by a second elastic member 11*a* provided in the main assembly when said cartridge is mounted to the main assembly. The second urging force receptor portion is integrally molded with said cartridge frame. It further comprises a first contact portion 63*m*1 outwardly projected from said cartridge frame portion 63*h* adjacent one longitudinal end of said developing means, wherein said first contact portion contacts a first fixed portion 10 provided in the main assembly when said cartridge is mounted to the main assembly. The first contact portion is integrally molded with said cartridge frame. It further comprises a second contact portion 63*m*2 outwardly projected from said cartridge frame portion 63*i* adjacent one longitudinal end of said developing means, wherein said second contact portion contacts a second fixed portion 10 provided in the main assembly when said cartridge is mounted to the main assembly. The second contact portion is integrally molded with said cartridge frame.

It further comprises a driving force receptor member 22 for receiving, from the main assembly 30, driving force for rotating said developing means when said cartridge is mounted to the main assembly, wherein said driving force receptor member is exposed from said cartridge frame portion adjacent one longitudinal end of said developing roller.

As seen in a direction substantially perpendicular to the longitudinal direction of said developing means, said first urging force receptor portion and second urging force receptor portion are within a range of approx. 100–130 degrees from a line connecting a center of rotation of said developing means and a center of rotation of said driving force reception member. The first contact portion and second contact portion are within a range of approx. 130–150 degrees.

The first receptor portion 63*k* and the second one 63*k* are flat in shape, and receive the urging forces from the first urging member 11*a* and the second one 11*a*.

The first contact portion 63*m*1 and second contact portion 63*m*2 are in the form of circular columns, and its peripheral surface portions are contacted to said first fixed portion 10 and second fixed portion 10.

The structures of the cartridge frame, the developing roller, the driving force receptor member, the toner accommodating portion, the shutter, cartridge guide, the locking member, the fixing portion, the first projected portion, the second projected portion, the first and second urging force receptors, the portion, the second urging force receptor, the portion, the first contact portion, the second contact portion, the first fixing portion, and second fixing portion, are not limited to those described above, but may be modified A further embodiment will be described.

Figure 26:
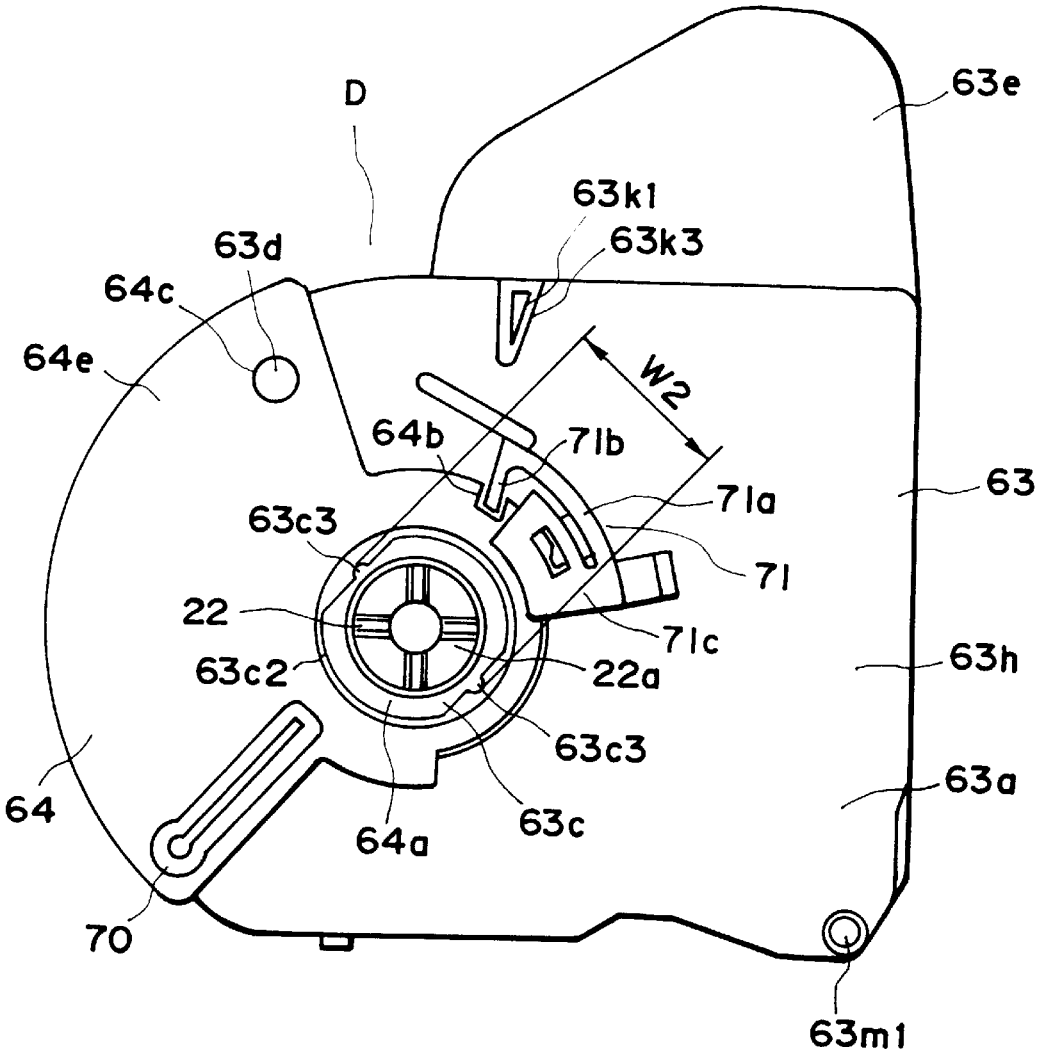
FIG. 26 is a side view of a developing cartridge according to another embodiment.

FIG. 26 is a side view of one end of the developing cartridge D.

In this example, another shape of the projected portion 63*c* is used.

It is not inevitable to cut a cylindrical portion provided on an end surface of the frame 63 of the developing cartridge D to provide the projected portion 63*c*. As shown in FIG. 25, the linear portion 63*c*1 may be provided with at least one projection 63*c*3 so that width is smaller than the rib clearance W1 (FIG. 19) of the inlet of the guide 59. The insertion is possible with the structure.

By this, the contact resistance with the rib of the guide 59 can be reduced to make the insertion of the developing cartridge D smoother.

Figure 27:
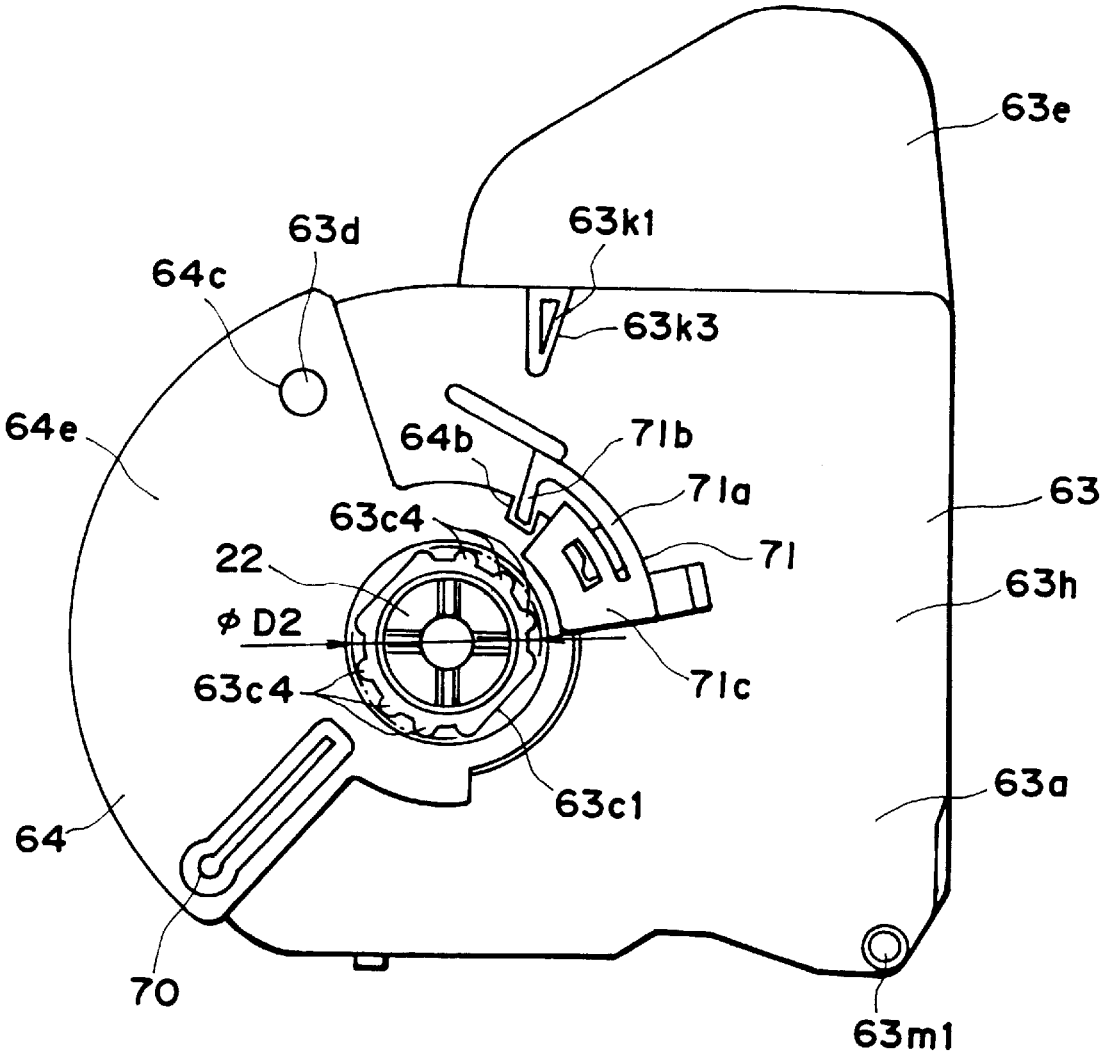
FIG. 27 is a side view of a developing cartridge according to another embodiment.

Referring to FIG. 27, a further embodiment will be described.

In FIG. 27, cylindrical projection 63*c* provided on a side 63*h* of the frame 63 of the developing cartridge, has a configuration having a plurality of projections 63*c*4 contactable to the arcuation of such a diameter D2 as is engageable with the diameter D1 (FIG. 19) of the arcuate rib of the guide 59.

By this, the contact resistance with the rib of the guide 59 can be decreased to make smooth the rotation upon mounting of the developing cartridge D to the main assembly of the apparatus 30.

Figure 28:
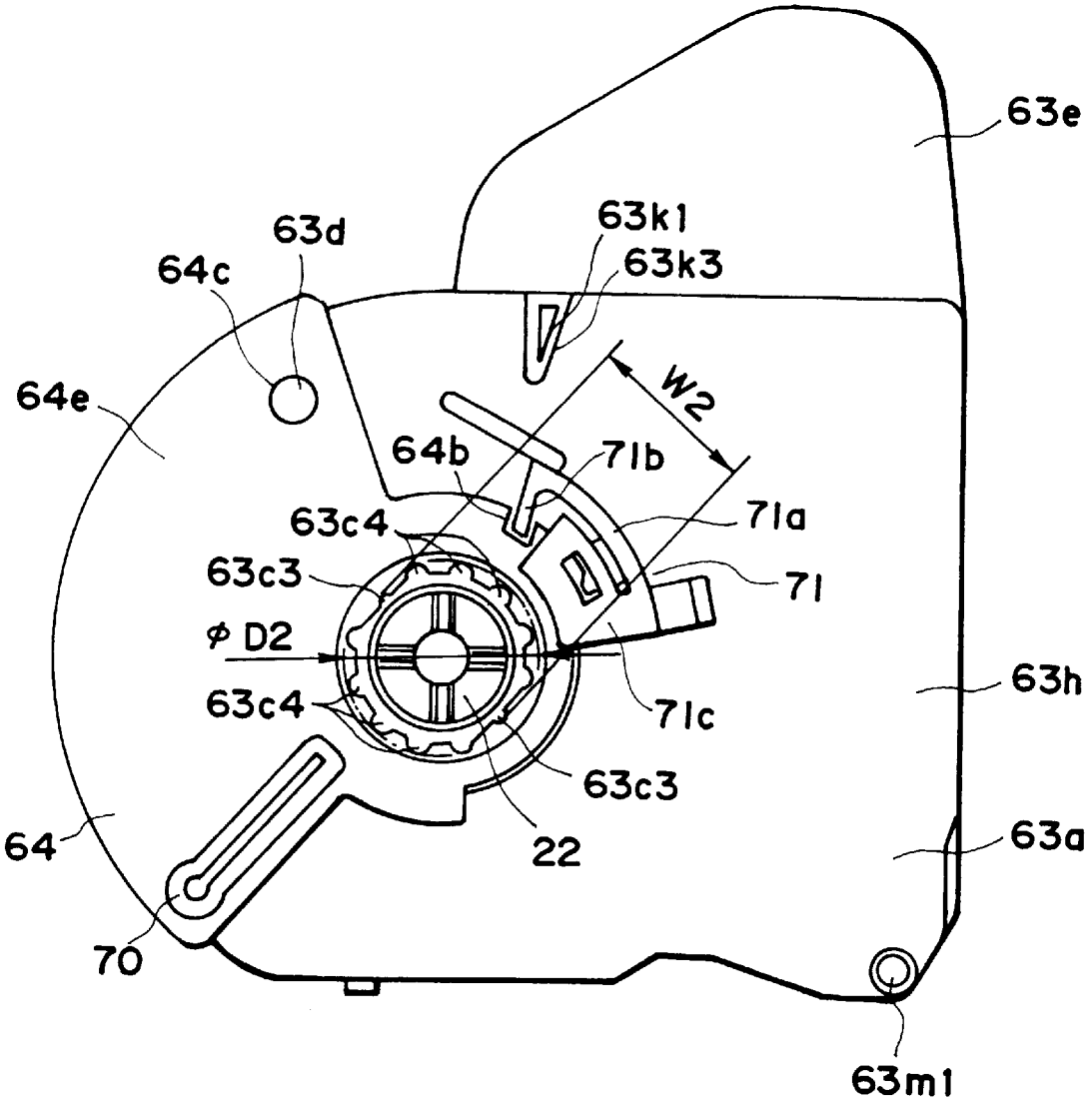
FIG. 28 is a side view of a developing cartridge according to another embodiment.

FIG. 28 shows a further example wherein the structures of FIGS. 26 and 27 are used in combination, as will be understood from this Figure.

Figure 29:
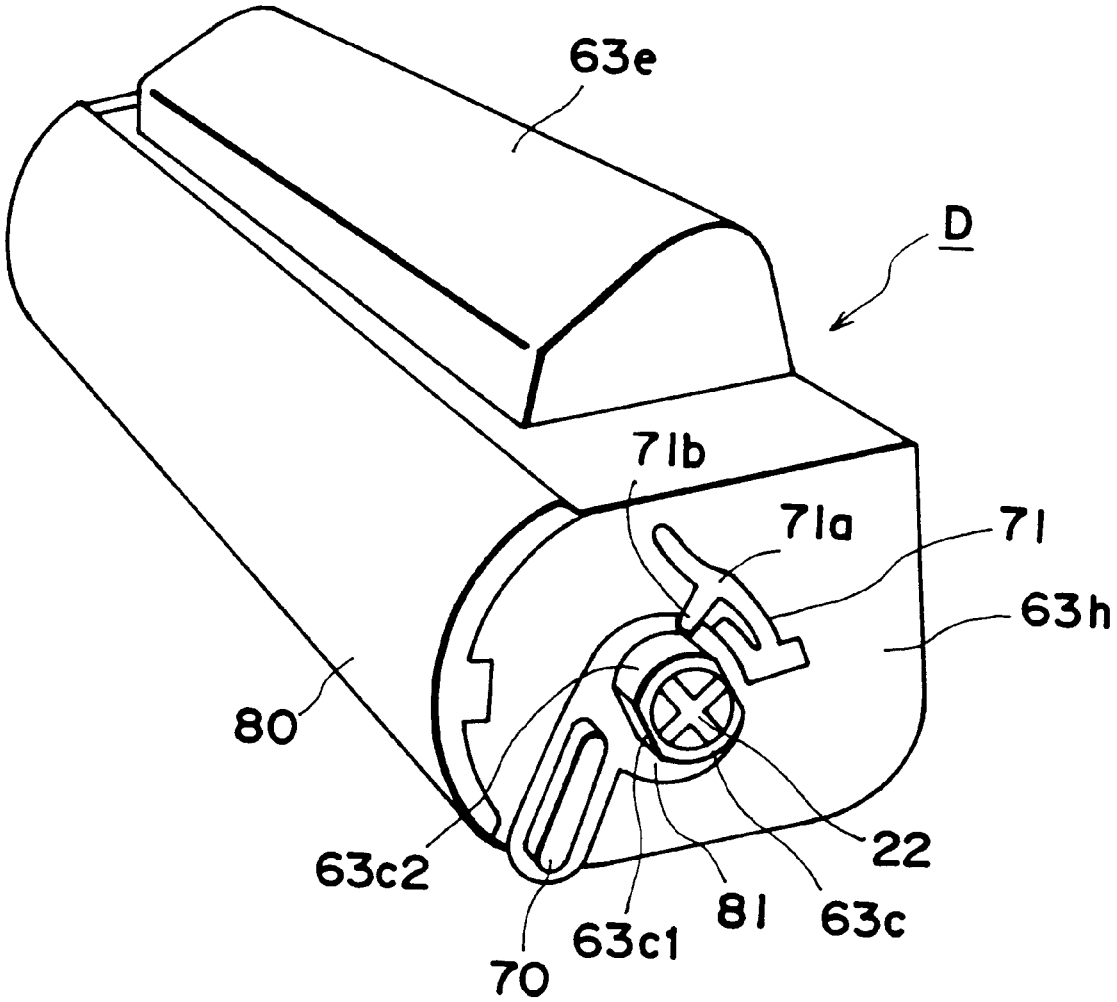
FIG. 29 is a side view of a developing cartridge according to another embodiment.

Referring to FIG. 29, a further embodiment will be described.

In FIG. 29 embodiment, the user dismounts the shutter 80 from the cartridge frame 63, or mounts it therefrom. The guide 70 is provided on the rotatable member 81 rather than on the shutter 80. The rotatable member 81 is rotatable about the projected portion 63C along the side surface 63*h* of the cartridge frame 63. It is locked by the above-described locking member 71. Therefore, the guide 70 functions as in the foregoing embodiment so that developing cartridge D can be mounted to the main assembly 30 of the apparatus.

The shutter 80 is dismounted from the frame 63 by the user prior to mounting of the developing cartridge D to the main assembly 30 of the apparatus. When the developing cartridge D is dismounted from the main assembly 30 of the apparatus, it is mounted to the frame 63 by the user if necessary. The shutter 80 is not inevitable, and may be omitted.

The guide 70 is not inevitably provided on the rotatable member 81, and may be directly mounted to the cartridge frame 63. In such a case, the guide is movably mounted to the cartridge frame 63.

According to the foregoing embodiments, the projections on longitudinal end surfaces of the developing cartridge frame, are guided when the developing cartridge is mounted to the main assembly of the image forming apparatus, so that developing cartridge can be inserted in a direction perpendicular to the longitudinal direction, and therefore, the insertion stroke can be reduced to improve the insertion operativity.

The driving connection between the developing cartridge and the main assembly, is effected with the coupling configuration, so that decrease of the driving accuracy due to the driving gear pitch non-uniformity, for example, can be prevented.

The foregoing cartridge frame, shutter or the like are of plastic resin material such as polystyrene, ABS resin, polycarbonate, polyethylene, polypropylene, or the like.

The process cartridge is not limited to those described in the foregoing, but may contain as a unit at least one process means such as charging means, cleaning means or the like, and an electrophotographic photosensitive member, wherein cartridge is detachably mountable relative to the main assembly of an electrophotographic image forming apparatus.

As described in the foregoing, according to the embodiments of the present invention, the mounting operativity of the developing cartridge can be improved.

According to this embodiment, the developing cartridge can be mounted to the main assembly of the electrophotographic image forming apparatus with high positioning accuracy.

In this embodiment wherein the urging force receptor portion and the contact portion are projected outwardly from the cartridge frame portion, the configuration of the cartridge frame can be selected independently of the configurations or the like of the urging force receptor portion and the contact portion.

Fourth Embodiment

Referring to FIGS. 30–33, the description will be made as to a further embodiment of a developing cartridge. In this embodiment, the developing cartridge D can be mounted demountably to the full-color laser beam printer shown in FIG. 1 In this embodiment, the developing cartridge D has a cartridge frame 63 containing the developing roller 12, the developing blade 16 and the toner accommodating portion 63*a*.

Figure 33:
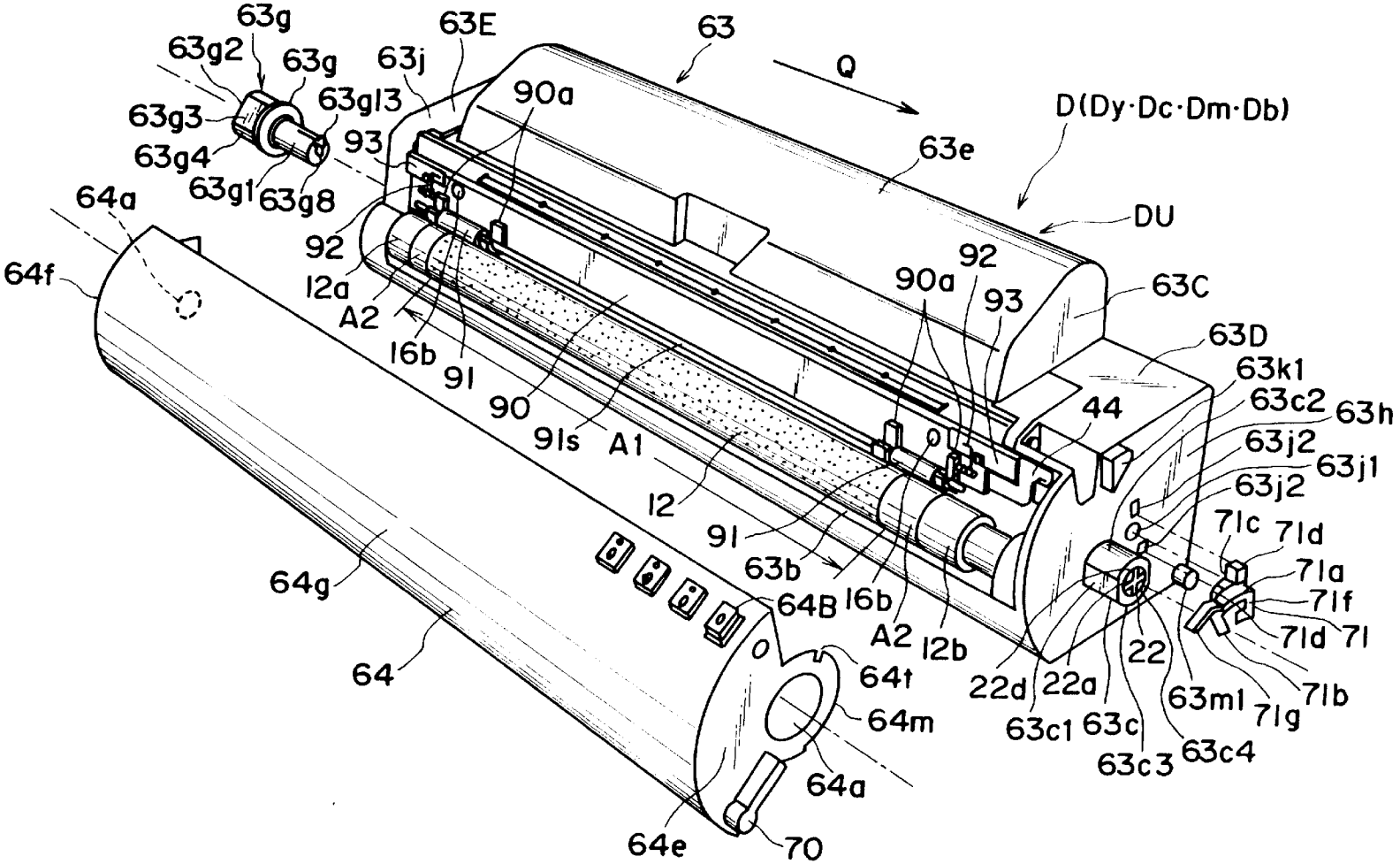
FIG. 33 is an exploded perspective view of a developing cartridge wherein the shutter and parts therearound are disassembled.

Referring to FIG. 33, the cartridge frame 63 of the development cartridge D is provided with an opening 63*b*, which extends in the longitudinal direction of the cartridge frame 63. The development roller 12 is attached to the cartridge frame 63 in such a manner that developing roller 12 is exposed through the opening 63*b*. Further, the cartridge frame 63 is provided with a projection 63*c*, which is integrally formed with the cartridge frame 63, and projects outward from the approximate center of a longitudinal end wall 63*h* of the cartridge frame 63. The projection 63 acts as a guide when the development cartridge D is inserted into the apparatus main assembly 30, and also acts as a rotational axis when the development cartridge D is installed, or removed from, the apparatus main assembly 30. The projection 63*c* is in the form of a circular cylinder.

The development cartridge D comprises a projection 63*g* as a shutter pin, which is removably attached to the approximate center of the longitudinal end wall 63*i* of the cartridge frame 63, that is, the counterpart of the wall 63*h* (FIG. 33 depicts the projection 63*g* which has been removed from the cartridge frame 63). The projected portion 63*g* is mounted to the cartridge frame 63 by inserting the inserting portion 63*g*1 (pin mounting portion) into a hole 63Eq (FIG. 56) formed in the side surface 631. The projected portion 63*g* is provided with an electroconductive portion 63*g*8, as will be described, and provided for only the magenta developing cartridge Dm, cyan developing cartridge Dc and yellow developing cartridge Dy using non-magnetic toners of magenta color, cyan color and yellow color, respectively but the projected portion 63*g* for the black developing cartridge Db using magnetic toner of black color is not provided with the electroconductive portion 63*g*8. This is because the magenta developing cartridge Dm, the cyan developing cartridge Dc and the yellow developing cartridge Dy are provided with charging rollers 91 as charging members. When the developing cartridge D (Dm, Dc, Dy Db) is mounted to the main assembly 30, the projected portion 63*g* functions as a pivot. The projected portion 63*g* is mounted to the cartridge frame 63 by inserting the pin mounting portion 63*g*1 into the hole 63Eq formed in the side surface 631. At the end of the pin mounting portion 63*g*1, there is provided a claw portion 63*b*13 (opposite claw-like), and by the opposite claw portion 63*b*13 engaging with the cartridge frame 63, the projected portion 63*g* is secured to the cartridge frame 63. When the developing cartridge D is mounted to the mounting position of the rotary member unit, the free end surface 63*g*2 of the projected portion 63*g* is pressed against the press-contact member 26*b* projected elastically from the other wall surface of the rotary member unit. Therefore, the developing cartridge D is urged toward the side surface 63*h* (arrow Q in FIG. 33). Therefore, the developing cartridge D is mounted to the rotary member unit (main assembly 30 of the apparatus) with the side surface 63*h* having the driving force receiving member 22 functioning as a reference.

(Structure of the Projected Portion (Shutter Pin))

Figure 53:
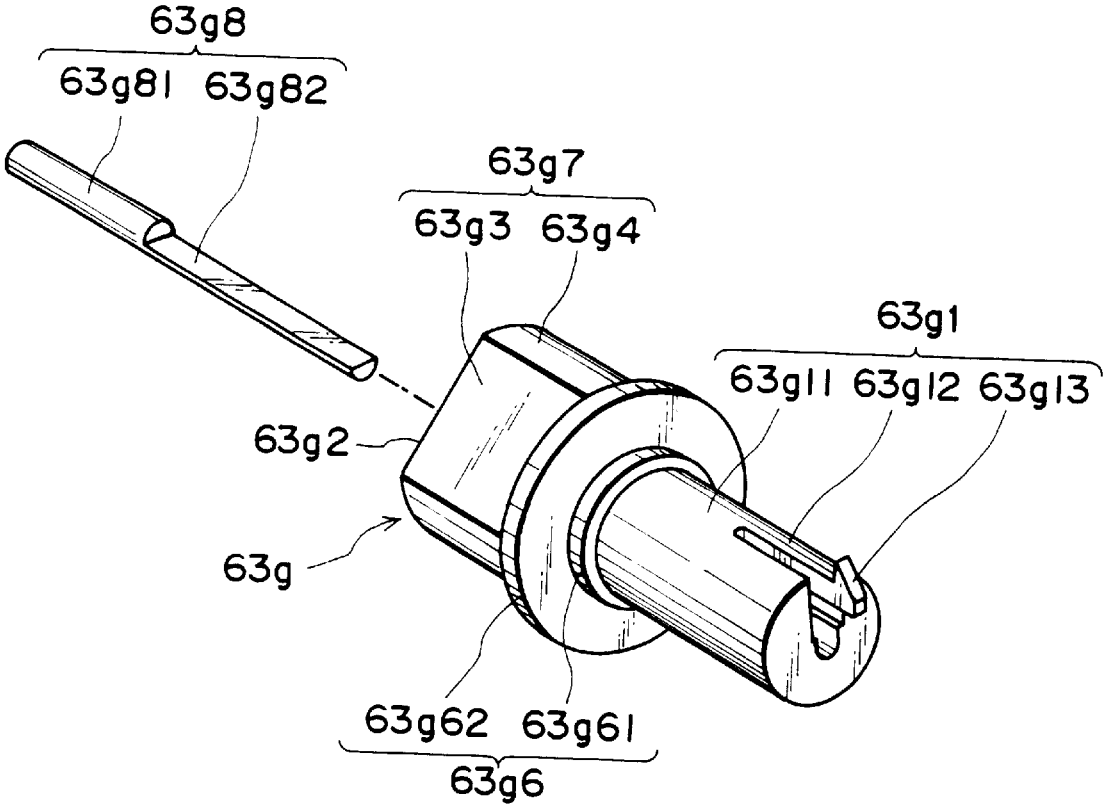
FIG. 53 is an exploded perspective view of a shutter pin.

Referring to FIGS. 33, 53, the description will be made as to the structure of the projected portion 63*g* (shutter pin).

The projected portion (shutter pin) 63*g* includes a pin mounting portion 63*g*1, a shutter mounting portion 63*g*6 and a head portion 63*g*7 in this order from one longitudinal end to the other end. The pin mounting portion 63*g*1 functions to mount the projected portion 63*g* to the cartridge frame 63, and the shutter mounting portion 6386 functions to the shutter 64 which will be described hereinafter to the cartridge frame 63. The head portion 63*g*7 is located outside of the cartridge frame 63 when the projected portion 63*g* is mounted to the cartridge frame 63.

The mounting portion 63*g*1 includes a cylinder configuration portion 63*g*11 inserted into the inside of the cartridge frame 63 and a locking portion 63*b*12 for locking with the cartridge frame 63 to secure the projected portion 63*g* to the cartridge frame 63. The locking portion 63*b*12 has a claw portion 63*b*13 elastically engaged with the cartridge frame 63. The claw 63*b*13 is in the form of an opposite claw-like provided at the end of the projected portion 63*g*, and is engaged elastically with the cartridge frame 63.

The shutter mounting portion 63g6 includes an engaged portion 63g61 for engaging with the round hole 64a of the shutter 64, and a regulating portion 63g62 for preventing the engaging portion 63g61 from disengaging from the round hole 64a. The shutter mounting portion 63g6 constitutes a first circle by the engaging portion 63g61 formed in a circle, and the regulating portion 63g62 is formed into a circle having a diameter than that of the engaging portion 63g61 to constitute a second circle. When the projected portion 63g is mounted to the cartridge frame 63, the regulating portion 63g62 as the second circle is opposed to a side surface of the shutter 64.

The peripheral surface of the head portion 63g7 has diagonally opposed cut portions (flat surface portions) 63g3 and cylindrical portions (arcuate surface portions) 64g4.

The projected portion 63g has an electroconductive portion 63g8 for electrically grounding the developing cartridge D(Dm, Dc, Dy) to the main assembly 30 of the apparatus, when the developing cartridge D(Dm, Dc, Dy) is mounted to the main assembly 30 of the apparatus. The electroconductive portion 63g8 is of metal, and has a columnar portion 63g81 and a cutting portion 63g82, and is press-fitted into the insides of the pin mounting portion 63g1, the shutter mounting portion 63g6 and the head portion 63g7 to penetrate them in the longitudinal direction.

The pin mounting portion 63g1 of the projected portion 63g, the shutter mounting portion 63g6 and the head portion 63g7 are integrally molded of a plastic resin material such as polystyrene or the like. The electroconductive portion 63g8 is of metal such as iron or the like.

Spacer rollers 12a, 12b are mounted at each side of the developing roller 12. Therefore, in the developing position, a predetermined gap is maintained between the developing roller 12 and the photosensitive drum 1 by pressing the spacer rollers 12a, 12b against the peripheral surface of the photosensitive drum 1 by the urging force of the compression coil spring urging the sliding member or the urging means of the first embodiment.

Figure 30:
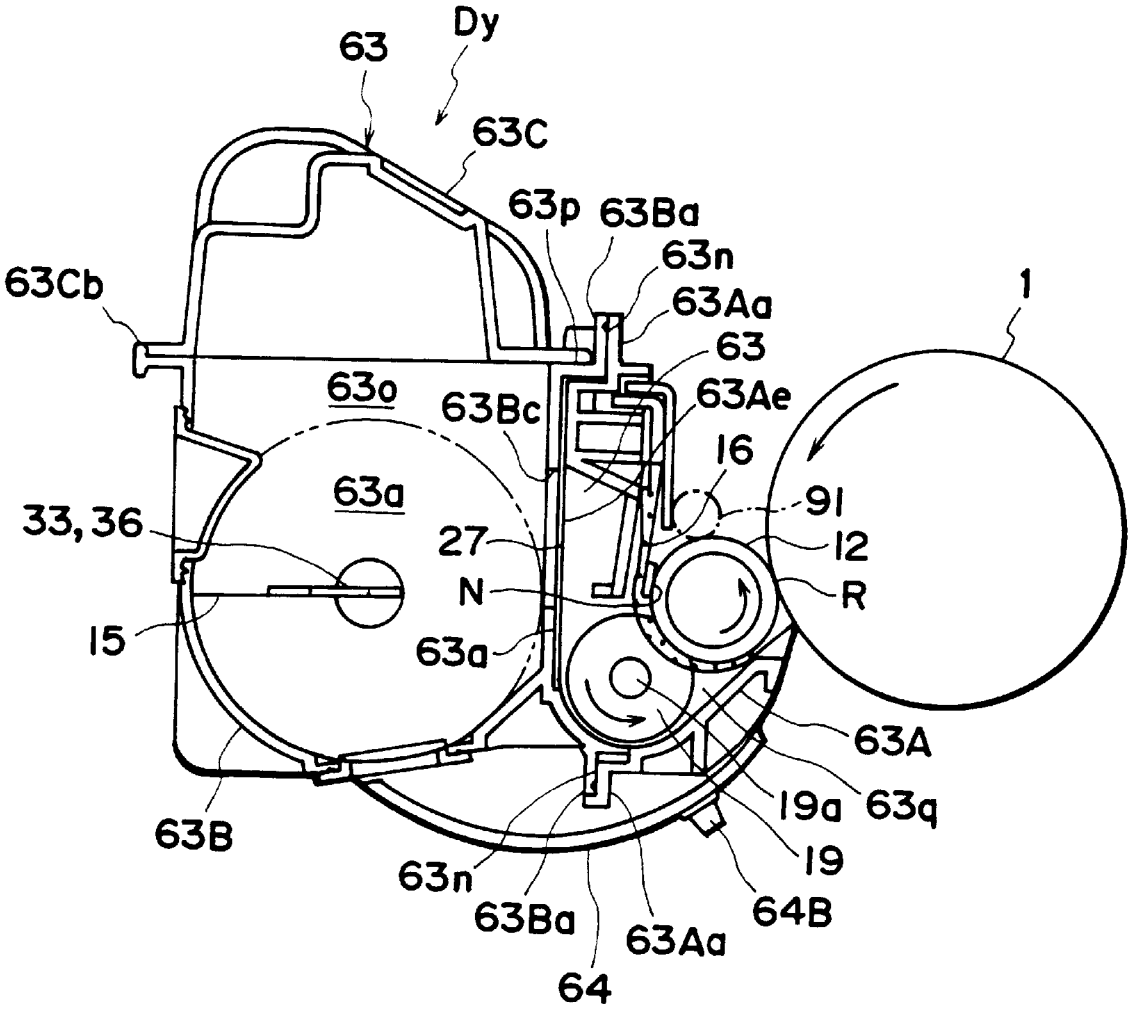
FIG. 30 is a longitudinal sectional view of a color developing cartridge according to an embodiment of the present invention.

The developing blade 16 of rubber or the like (FIG. 30) is mounted to the cartridge frame 63 by mounting the supporting metal plate 16a for the blade with small screws 16b. The developing blade 16 of the developing cartridge Dy shown in FIG. 30, is mounted to the plate 16a at a back side of the holding member 90 holding the charging roller for applying electric charge to the toner on the developing roller 12. The holding member 90 and the plate 16a are mounted to the cartridge frame 63 by small screws 16b. The developing blade 16 will be described in detail hereinafter.

(Developer Charging Roller (Member))

The description will be made as to a developer charging roller 91 (charging roller) for applying electric charge to the one-component non-magnetic toner in the magenta developing cartridge Dm, the cyan developing cartridge Dc and the yellow developing cartridge Dy.

As shown in FIGS. 30 and 33, the charging roller 91 is contacted to the opposite longitudinal end portions of the developing roller 12 and are rotatable. More particularly, it is contacted to the developing roller 12 at a position upstream of the contact portion N between the developing blade 16 and the developing roller 12 in the rotational direction of the developing roller 12 and downstream of the developing means R for developing the electrostatic latent image on the photosensitive drum 1 on the developing roller 12 with the toner, and it electrically charges the toner in the form of a thin layer while being rotated by the developing roller 12.

The charging roller 91 is provided at a position corresponding to each opposite ends of the developing roller 12. The charging rollers 91 are connected with each other by an electroconductive shaft 91s rotatably supported on a hook-like supporting portion provided on the holding member 90. The electroconductive shaft 91s is contacted to the electroconductive plate 93 of the charging roller provided at the opposite longitudinal end portions of the holding member 90 through metal electroconductive spring 92. The charging roller 91 is contacted both to the non-toner coating portion of the peripheral surface of the developing roller 12 (not roughened portion) A2 and to the toner coating portion (roughened portion A1. This is because there is a liability that contact only at the toner coating portion A1 does not assure the driving of the charging roller 91 due to possible slip, since the flowability of the toner (one-component non-magnetic developer) is high. As regards the driving, the charging roller 91 is driven by the developing roller 12 or is rotated at the same peripheral speed as the developing roller 12, since if there is provided a peripheral speed difference between the charging roller 91 and the developing roller 12, the toner coating is non-uniform with the result that toner is transferred onto the photosensitive drum 1 during development (fog) or is scattered.

With the charging roller 91, a contact region of the developing roller 12 includes the longitudinal end portions of the application roller 19 and the gap region between the application roller 19 and the longitudinal side wall of the toner supply opening 63Ae of the developing frame 63A. This is because in the region where there is not application roller 19 or at the ends of the application roller 19, the triboelectric charge amount tends to be insufficient so that electrical attraction force to the developing roller 12 ((mirror force) is weak.

The electroconductive shaft 91s is electrically contacted with the electroconductive plate 93 of the charging roller provided at the opposite longitudinal end portions of the holding member 90, through a metal electroconductive spring 92.

According to this embodiment, there is provided a charging roller 91 with the contact region at the opposite longitudinal end portions of the developing roller 12. Therefore, even if the toner is sandwiched in the contact portion N adjacent the opposite longitudinal end portions of the developing blade 16, by which the developing blade 16 is raised, and the thickness of the toner layer is gradually increased in the form of stripes at the opposite longitudinal end portions of the contact portion N between the developing blade 16 and the developing roller 12 with the result of decreased electrical attraction force to the developing roller 12, the electrical attraction force of the toner to the developing roller 12 is refreshed by the charging to the toner by the charging roller 91, and therefore, fog toner transfer onto the photosensitive drum 1 or the scattering of the toner out of the surface of the developing roller 12 (toner leakage) can be prevented.

Additionally, even if the triboelectric charge amount of the toner becomes insufficient at the gap region between the ends of the application roller 19 and the longitudinal direction side wall of the toner supply opening 63Ae of the developing frame 63A with the result that electrical attraction force to the developing roller 12 decreases, the electrical attraction force of the toner to the developing roller 12 is refreshed by the charging to the toner by the charging roller 91, so that fog toner transfer onto the photosensitive drum 1 or the scattering of the toner out of the surface of the developing roller 12 (toner leakage) can be prevented.

Thus, occurrence of uncharged toner can be assuredly prevented at the opposite longitudinal end portions of the developing roller 12, and the thin layer formation of the toner on the developing roller 12 is stabilized. The charging roller 91 is supplied with a bias voltage from a voltage generating circuit 100 (FIG. 55) provided inside the side cover (first side cover) 63E at the non-driving side which will be described hereinafter, and the voltage generating circuit 100 will be described in detail hereinafter.

A locking member 71 is mounted to a side surface 63*h* of the developing cartridge D (in FIG. 33, it is removed). The locking member 71 is mounted to one side surface 63*h* portion of the cartridge frame 63 provided at one end in the longitudinal direction of the developing roller 12 (developing roller 12). It includes a locking engaging portion 71*b* for engagement with a shutter engagement recess 64*t* provided on the side wall 64*e* of the shutter 64, a supporting portion 71*a* for supporting the locking engaging portion 71*b*, and mounting portions 71*c* and 71*d* mounted to a side surface 63*h* of the cartridge frame 63. Designated by 63*j*1, 63*j*2 are holes formed in the side surface 63*h*, and the mounting portions 71*c* and 71*d* are inserted thereinto. The locking member 71 is of an integrally molded plastic resin material. In the process of mounting it to the mounting position, an arm portion 71*g* which is a part of the locking member 71 is contacted to a fixed portion of the main assembly 30 of the apparatus, so that said supporting portion 71*a* is flexed to disengage the locking engaging portion 71*b* from the shutter engagement recess 64*t*, thus releasing the shutter 64.

(Shutter)

The shutter 64 will be described.

Figure 32:
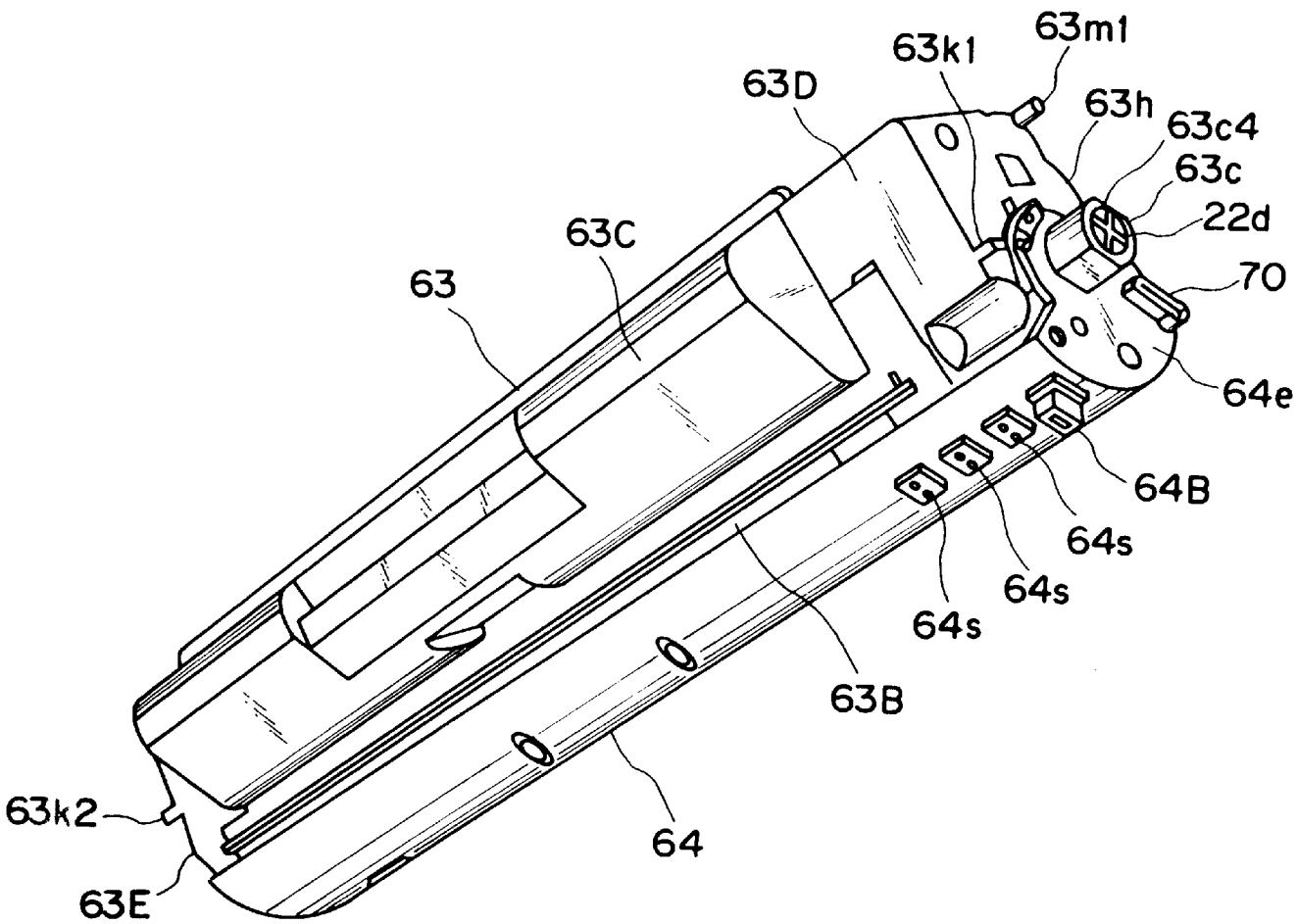
FIG. 32 is a perspective view of a developing cartridge in which the shutter is shown as being in its closed position.
Figure 38:
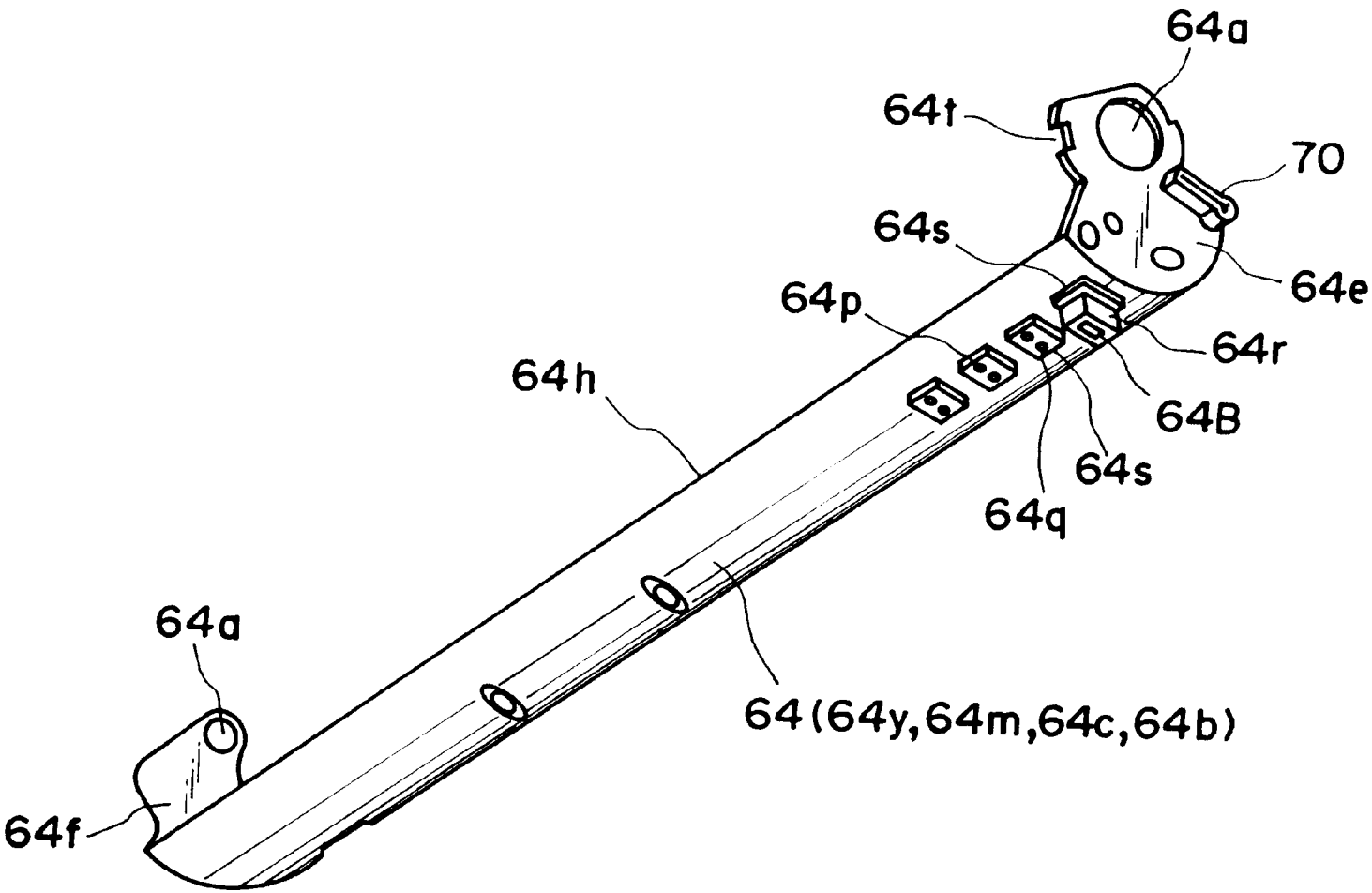
FIG. 38 is a perspective view of a shutter.

Referring to FIG. 38, the longitudinal end walls 67*e* and 64*f* of the shutter 64 are provided with a round hole 64*a*, in which the projections 63*c* and 63*g* are engaged, one for one, so that shutter 64 is rotatably attached to the cartridge frame 63. Referring to FIGS. 32 and 32, as the shutter 64 is closed, the opening 63*b* is covered; the development roller 12 is covered by the shutter 64. When the development cartridge D is out of the apparatus main assembly 30, the shutter 64 is closed. No foreign matter enters the developing cartridge D.

The supporting portion 71*a* of the locking member 71 is shaped in the form of a cantilever, being therefore rendered elastically bendable, by providing the locking member 71 with a groove 71*f*. The base end of the supporting portion 71*a* in the form of a cantilever is the side where the anchoring portions 71*c* and 71*d* are located. The latching portion 71*b* and the lock releasing arm 71*g* are located at the extending end portion of the supporting portion 71*a*. The anchoring or mounting portion 71*c* is cylindrical, extending in the longitudinal direction of the development cartridge D, and fits in the hole 63*j*1. The three anchoring portions 71*d* located adjacent to the anchoring portion 71*c* have a square cross section, extending in the longitudinal direction of the development cartridge D. They each are provided with the aforementioned latching claw (unshown). The locking member 71 is locked with the longitudinal end wall 63*h* of the cartridge frame 63 by engaging the anchoring portions 71*d* in the square holes 63*j*2 cut adjacent to the hole 63*j*1.

Figure 37:
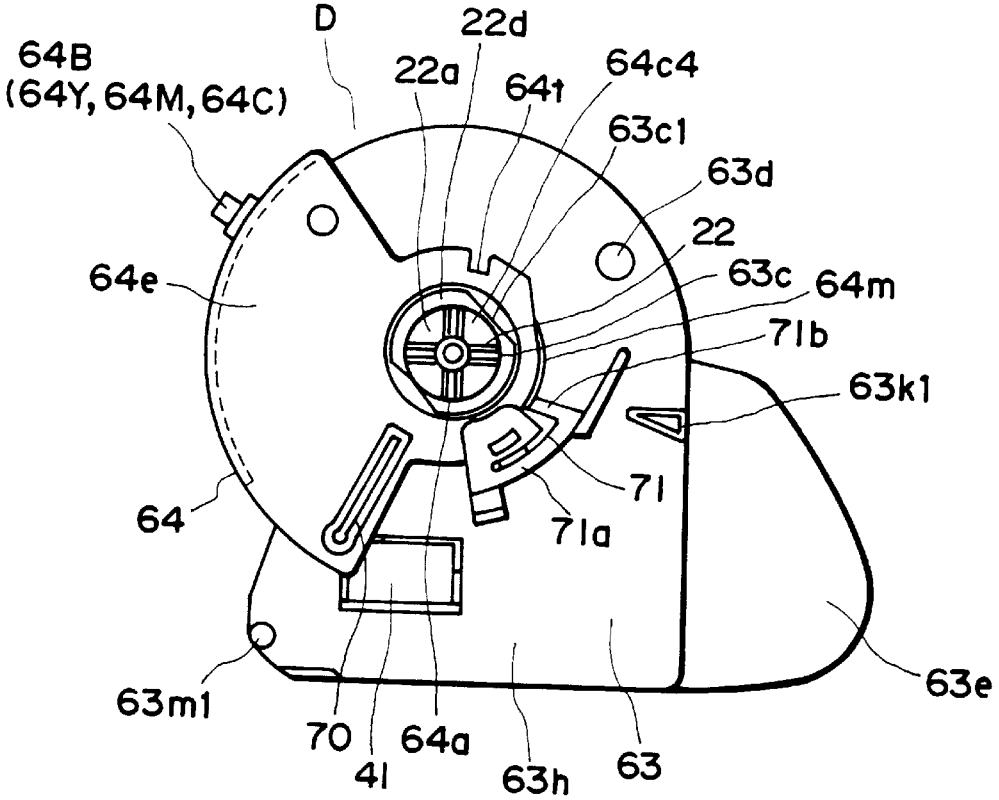
FIG. 37 is a side view of a driving side of a developing cartridge wherein the shutter is opening.

Referring to FIG. 37, when the shutter 64 is open, the tip of the latching portion 71*b* is in contact with the edge portion of a cam 64*n* in the form of an arc that is concentric with the hole 64*a* of the side wall 64*e* of the shutter 64. As the shutter 64 is closed, the latching portion 71*b* engages in the latching portion catching recess 64*t* of the edge portion 64*n* of the cam of the shutter 64, whereby the shutter 64 is locked shut, being prevented from unexpectedly opening. When the developing cartridge D is mounted to the main assembly 30 of the image forming apparatus, the locking is automatically released to open the shutter 64.

(Erroneous Mounting Prevention Means for Developing Cartridges)

Figure 39:
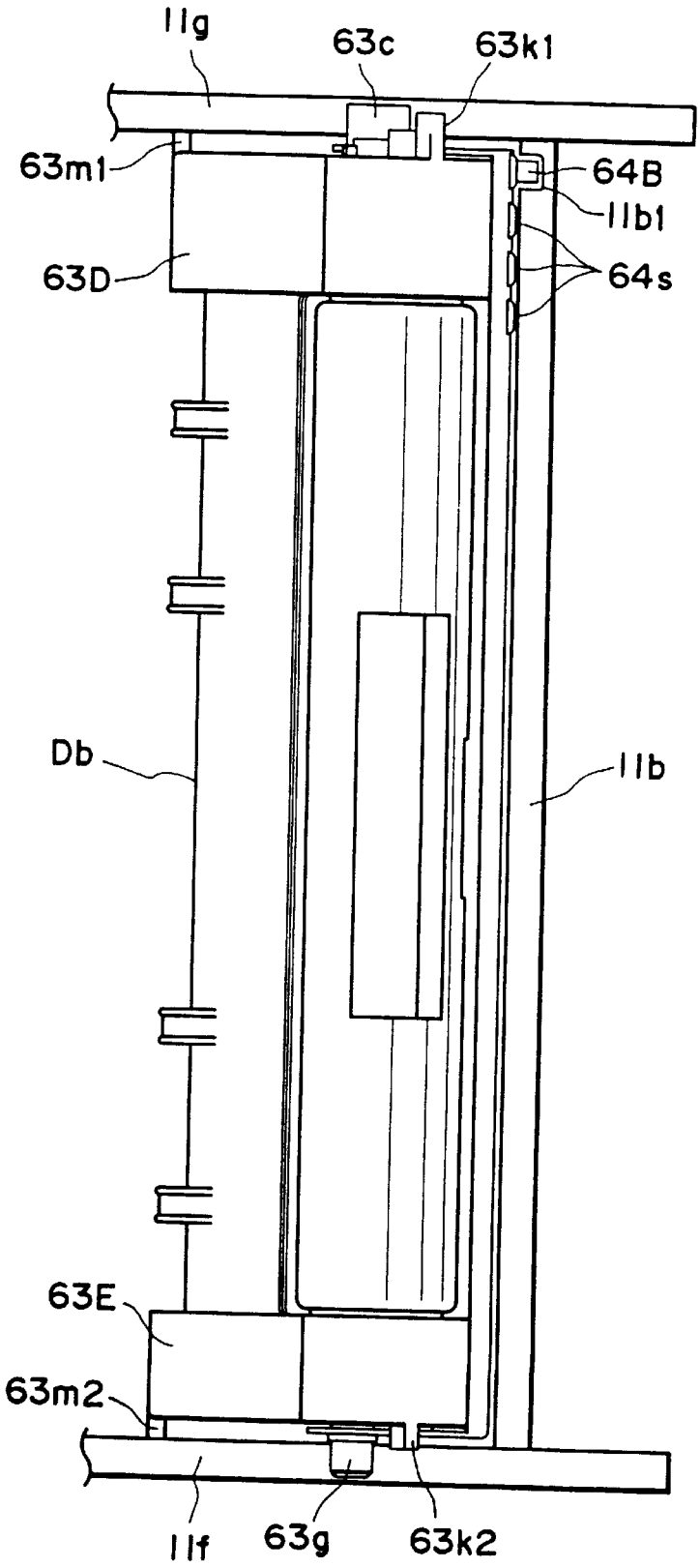
FIG. 39 is top plan view illustrating mounting of a rotary unit of a developing cartridge.

Referring to FIGS. 38 and 39, the description will be made as to an erroneous mounting prevention means for the developing cartridges D.

The developing cartridges D (Dm, Dc, Dy, Db) have the mounting portions which are the same in the configurations, dimensions or the like, and are mountable to any of the cartridge mounting portions of the rotary unit 11. By providing means for preventing the user from mounting an improper developing cartridge to any one of the cartridge mounting portion of the rotary unit 11, the operativity is improved.

In this embodiment, the circumferential direction of the unit is equidistantly divided, into four sections in this embodiment, to provide cartridge mounting portions, and partition plates 11*b* (FIG. 39) are provided to define the cartridge mounting portions, and an extended between the flanges 11*f* and 11*g* provided at the opposite longitudinal end portions of the rotary member unit to couple the flanges 11*f* and 11*g*. The partition plates 11*b*1 are extended in the axial direction of the rotary member unit 11. The partition plates 11*b*1 are provided with main assembly discriminating portions 11*m*1, 11*c*1, 11*c*1, 11*b*1 on the respective separation plates 11*f*, 11*g* at end portions adjacent a flange 11*g* at the driving force receiving portion.

On the other hand, as shown in FIGS. 38 and 50, the shutter 64(64*m*, 64*c*, 64*y*, 64*b*) of the developing cartridge D is provided with a cartridge discriminating portion 64M, 64C, 64Y or 64B for distinguishing the developing cartridges D (FIG. 38 indicate discriminating portion 64B). The discriminating portions 64M, 64C, 64Y, 64B are disposed at longitudinally different positions on the outer periphery of the cylindrical portions of the shutter 64 of the developing cartridge D. The discriminating portions 64M, 64C, 64Y, 64B are in the form of projections extending from the outer periphery of the shutter 64. The centers of the discriminating portions 64M, 64C, 64Y, 64B are on a line substantially passing through the center of the round hole 64*a* and perpendicular to a guide 70 which is in the form of a linear rib extending toward the center of the round hole 64*a* provided in the shutter 64, as seen in the longitudinal direction of the shutter 64. The discriminating portions 64M, 64C, 64Y, 64B are concentrated at an open end 64*h* of the shutter 64 faced to the developing roller 12 and adjacent the driving force reception side in the longitudinal direction.

As shown in FIG. 38, the shutter 64 has four seats 64*s* arranged at equal intervals in the longitudinal direction, to which blocks 64*r* are mountable to establish the discriminating portions 64M, 64C, 64Y, 64B. The seat 64*s* has block positioning holes 64*p*, 64*q* spaced in the circumferential direction of the shutter 64. The hole 64*p* is a round hole, and the hole 64*q* is elongated hole elongated in the circumferential direction of the shutter 64. The block 64*r* is substantially cubic and is provided, on a side which is not seen in FIG. 54 and which is opposed to a side opposing to the seat 64*s*, with projections engageable with the holes 64*p*, 64*q*. By engagement therebetween, the block 64*r* is correctly positioned and is fixed by bonding material.

The block 64*r* is mounted to one of the four seats 64*s* to provide a discriminating portion 64M, 64C, 64Y or 64B of the developing cartridge D. When the developing cartridge D provided with the discriminating portion 64M, 64C, 64Y or 64B is mounted to the mounting portion 14*m*, 14*c*, 14*y*, 14*b*, the discriminating portion 64M, 64C, 64Y, 64B of the developing cartridge D is engaged with the discriminating portion 11*m*1, 11*c*1, 11*y*1, 11*b*1 of the cartridge mounting portion 14, so that it may be permitted to enter the cartridge mounting portion 14*m*, 14*c*, 14*y* or 14*b*. However, to the cartridge mounting portion 14*y*, for example, any one of the developing cartridges Dm, Dc, Db is not mountable because any one of the discriminating portions 64M, 64C, 64B abuts the edge without the discriminating portion 11*y*1 of the separation plate 11*y*.

Similarly, the cartridge mounting portion 14*m* for the magenta color developing cartridge Dm rejects any one of the developing cartridges Dy, Dc, Db by the cartridge mounting portion 14*m*. The cartridge mounting portion 14*c* for the cyan color developing cartridge Dc rejects any one of the developing cartridges Dy, Dm, Db. The cartridge mounting portion for the black toner developing cartridge Db rejects any one of the developing cartridges Dy, Dm, Dc.

(Developing Frame)

Figure 31:
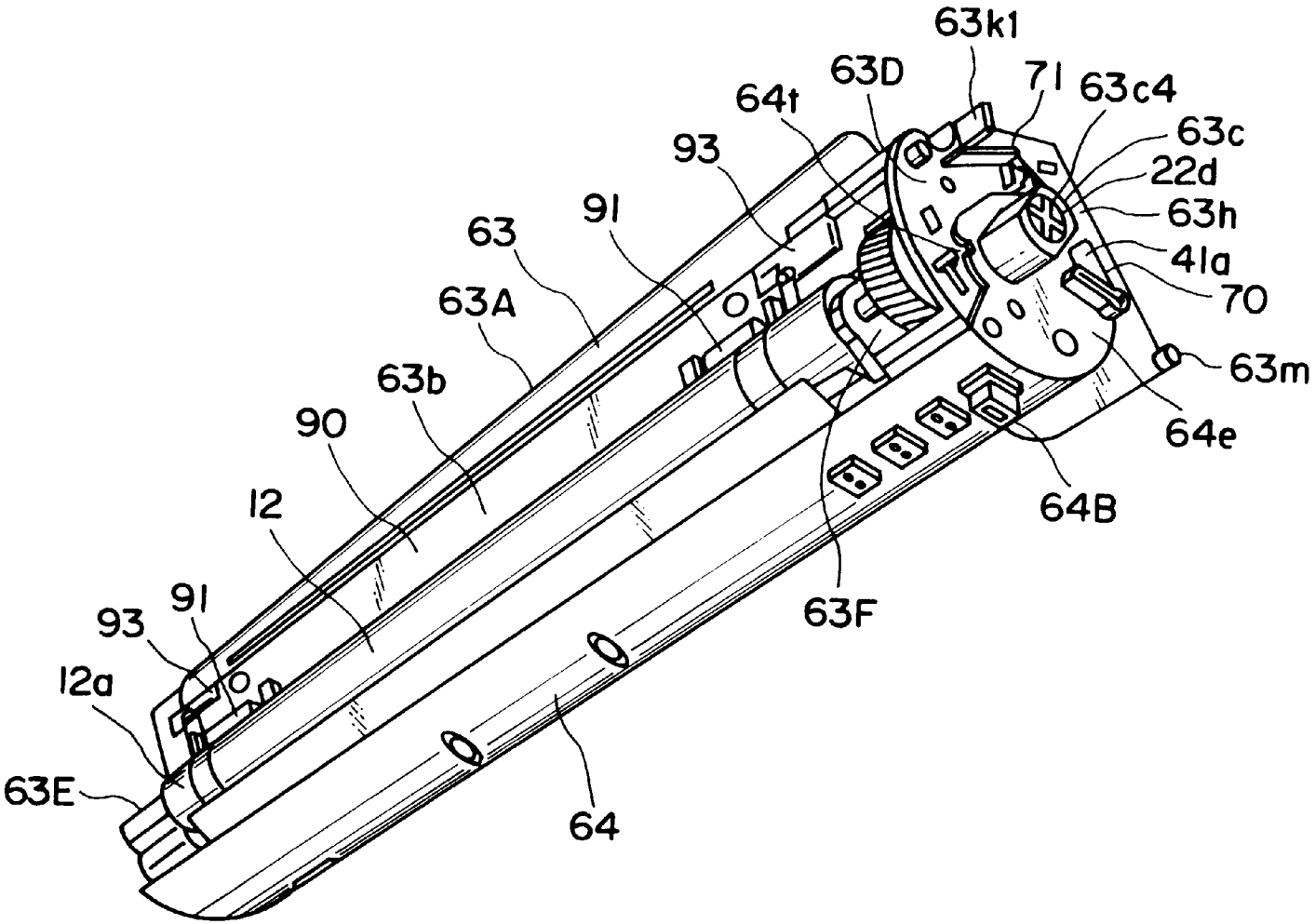
FIG. 31 is a perspective view of a developing cartridge in which a shutter is shown as being in its open position.

As shown in FIGS. 30, 31 and 32, the cartridge frame generally indicated by a reference numeral 63 is constituted by the developing frame(main cartridge frame) 63A, the developing frame, the cover frame 63C, the side covers (developer cartridge side covers) 63D, 63E, and the coupling frame 63F.

As shown in FIG. 30, the developing frame 63A and the toner frame 63B are welded together by ultrasonic welding at a triangular projections on a connecting surface 63*n* between the flanges 63Aa extended along the longitudinal direction at both of the lateral sides of the developing member supporting frame 63A and a flange 63Ba extended along the longitudinal direction of the toner frame 63B thus constituting a DT container unit DU.

The toner frame 63B and the cover frame 63C are coupled so as to face the openings 630 of the frames, thus constituting a toner container. To accomplish this flange 63Ba of the toner frame 63B has a L-shaped cross-section, and the upper surface thereof functions as a connecting surface 63*p*, and the flange 63Bb constitutes the connecting surface 63*p* and is formed to enclose the opening 630. The flange 63Cb enclosing the opening 630 of the cover frame 63C is welded by ultrasonic welding with the flange 63Bb of the toner frame 63B at the connecting surface 63*p*.

As shown in FIGS. 6, 7 as perspective views, the opposite longitudinal end portions of the thus welded developing frame 63A and toner frame 63B are covered by side covers 63D, 63E, and side cover 63E (first cover) is screwed to the developing frame 63A, and the side cover 63D (second cover) is screwed to the coupling frame 63F (bearing unit) fixed to the developing frame 63A. In this manner, the frames constitutes an integral cartridge frame 63.

Figure 44:
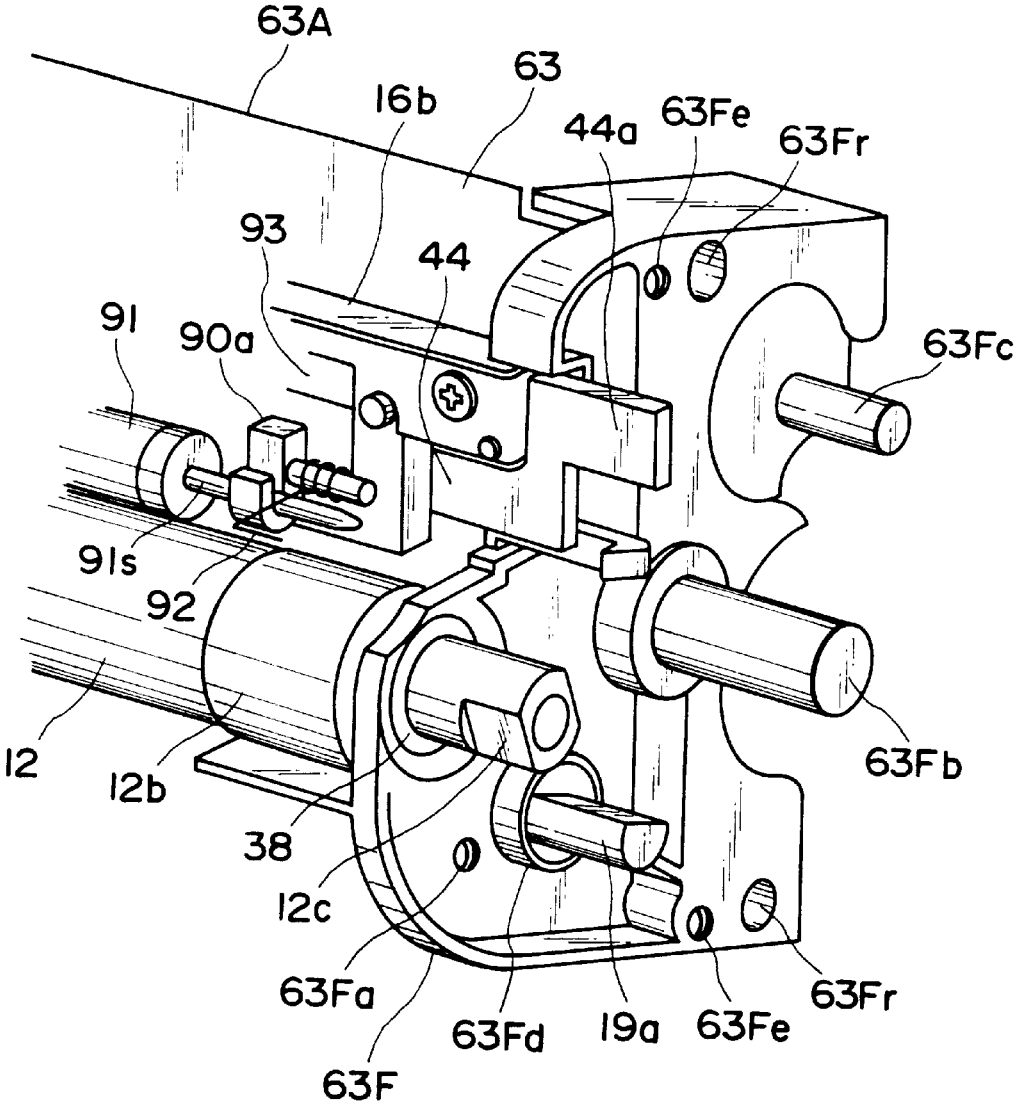
FIG. 44 is a perspective view of a coupling frame portion of a developing cartridge.
Figure 52:
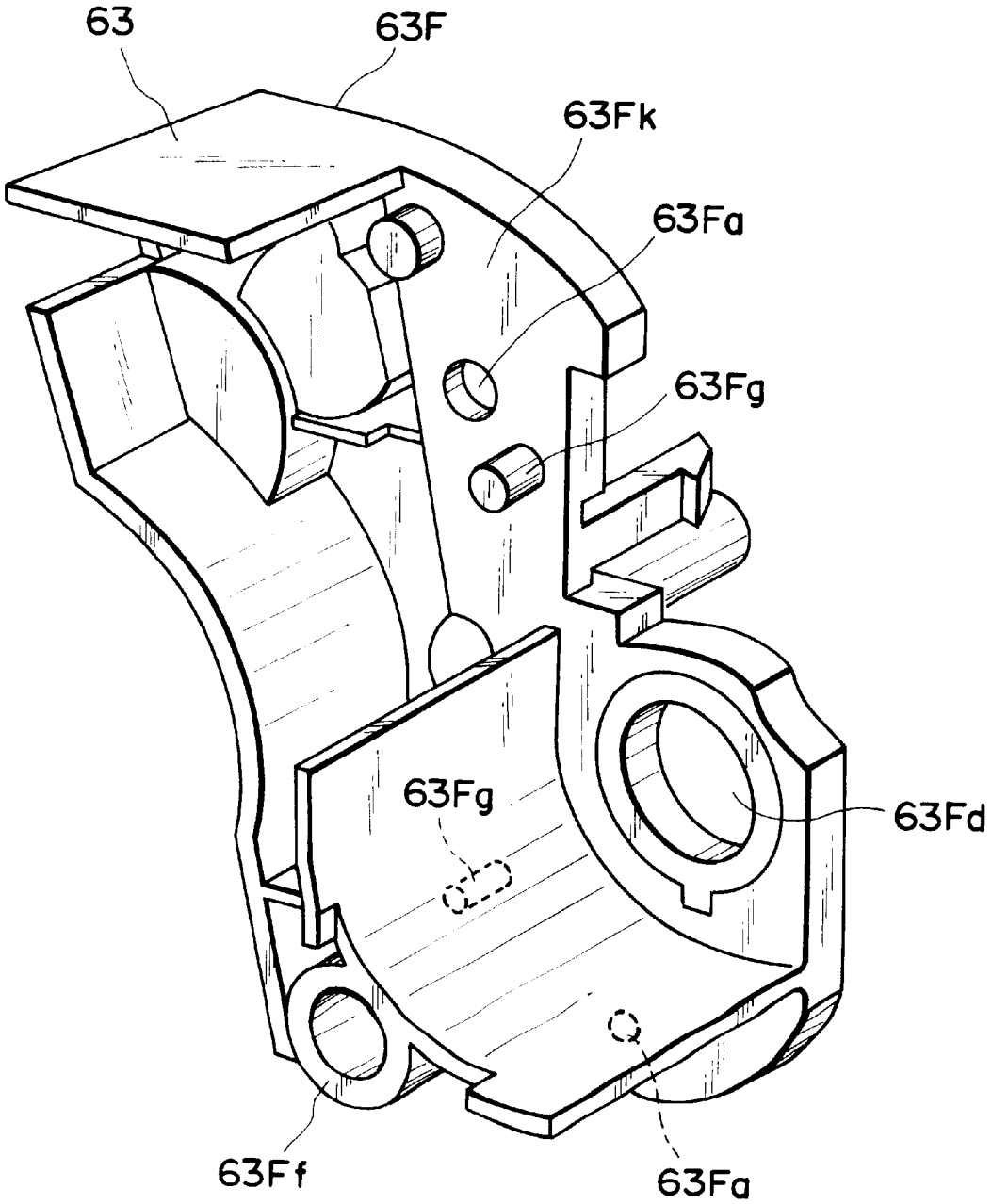
FIG. 52 is a perspective view of a cartridge frame.

As shown in FIG. 44 (perspective view), to the seat 63kA 1 (FIG. 44) at the driving force reception side end of the developing frame 63A, the coupling frame 63F is fixed by threading unshown small screws through the holes 63Fa into the screws 63Am at the end surface of the developing member supporting frame 63A. By this, the seat 63Ak1 at the driving force reception side of the developing member supporting frame 63A and the flat mounting surface 63Fk of the coupling frame 63F shown in FIG. 52 are contacted to each other. The configuration of the mounting surface 63Fk of the coupling frame 63F has substantially the complementary configuration with the seat 63Ak1 of the developing frame 63A so that they are closely nested. The mounting surface 63Fk is provided with a longitudinal cylindrical dowels 63Fg engageable with the positioning holes 63An, 63Ap of the seat 63Ak1 of the developing frame 63A.

Figure 34:
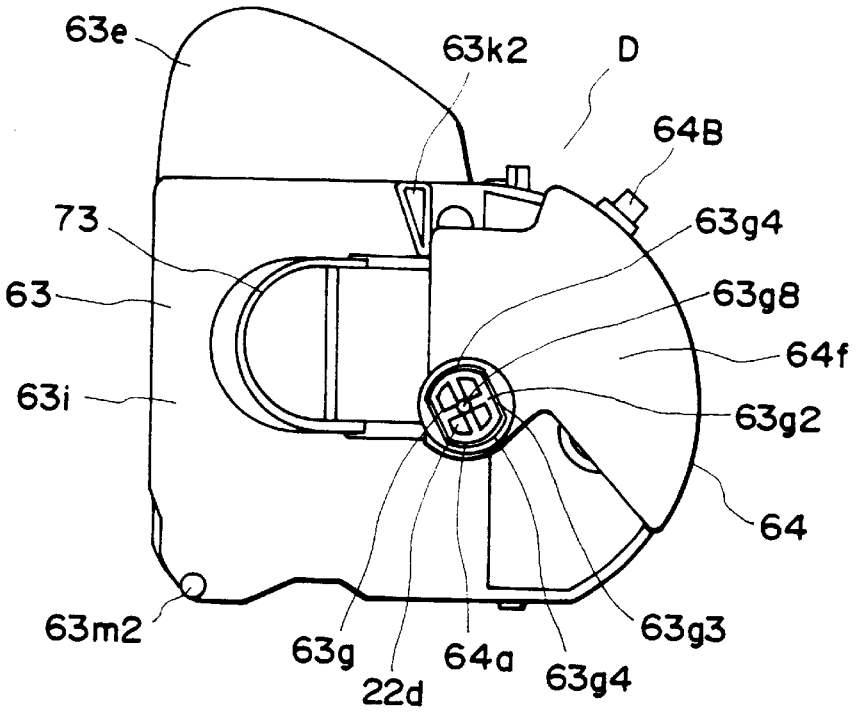
FIG. 34 is a side view of a non-driving side of a developing cartridge when the shutter is closed.
Figure 51:
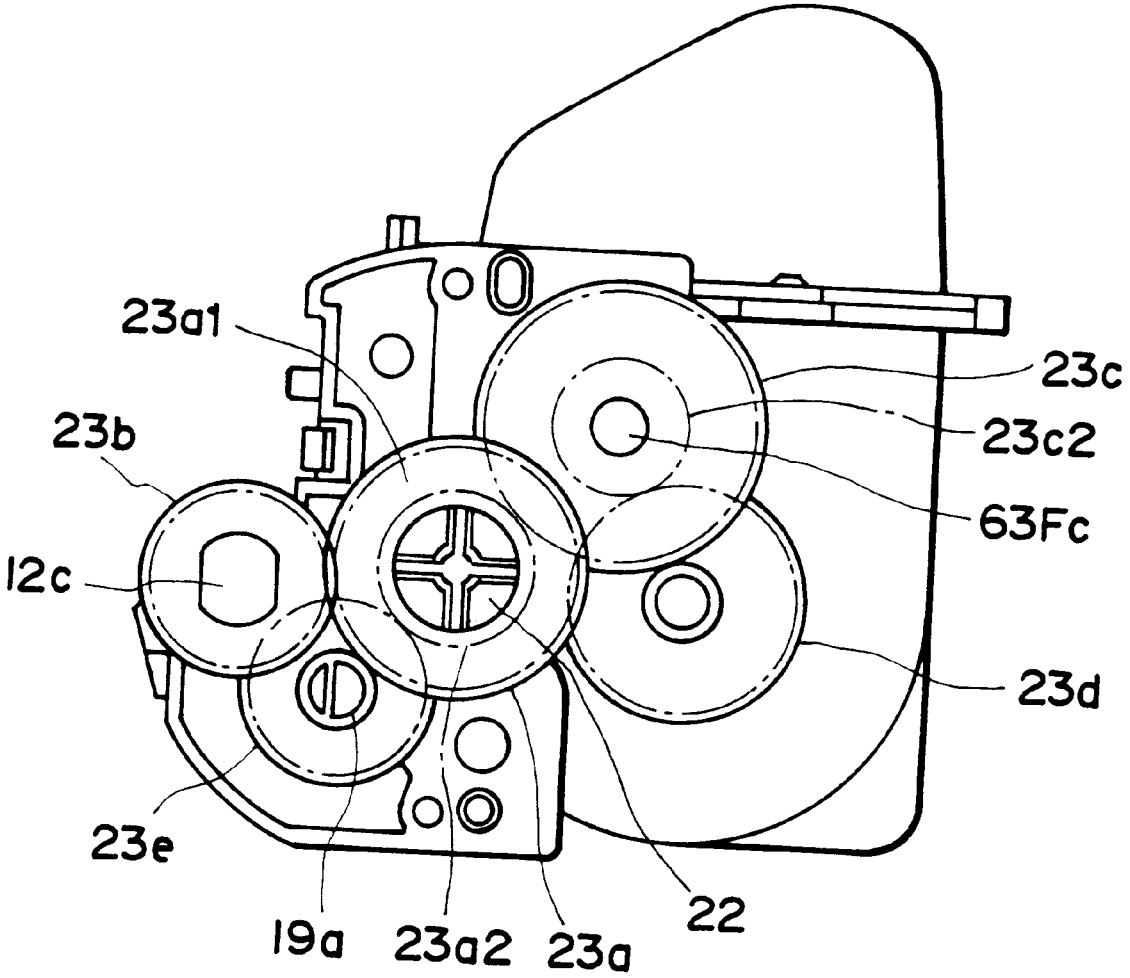
FIG. 51 is a side view of driving means of a developing cartridge.

As shown in FIG. 34, one end of the rotation shaft 12*c* of the developing roller 12 is supported on a developing roller bearing 38 engaged into the coupling frame 63F. The projected shaft 63Fb supporting the driving force receiving member 22 is integrally molded with the coupling frame 63F. A projected shaft 63Fc rotatably supporting stepped an idler gear 23*c* including a small gear 23*c*2 engaged with the gear 23*d* integral with a journal 33 supporting the toner feeding member 15, is integrally provided (FIG. 51). There is provided a hole 63Fd through which the rotation shaft 19*a* of the application roller 19 is penetrated. The coupling frame 63F is provided with a screw 63Fe for mounting the side cover 63D.

The description will be made as to a support at the other end of the developing roller 12 and a toner seal 27.

(Side Cover at Non-driving Side)

Figure 45:
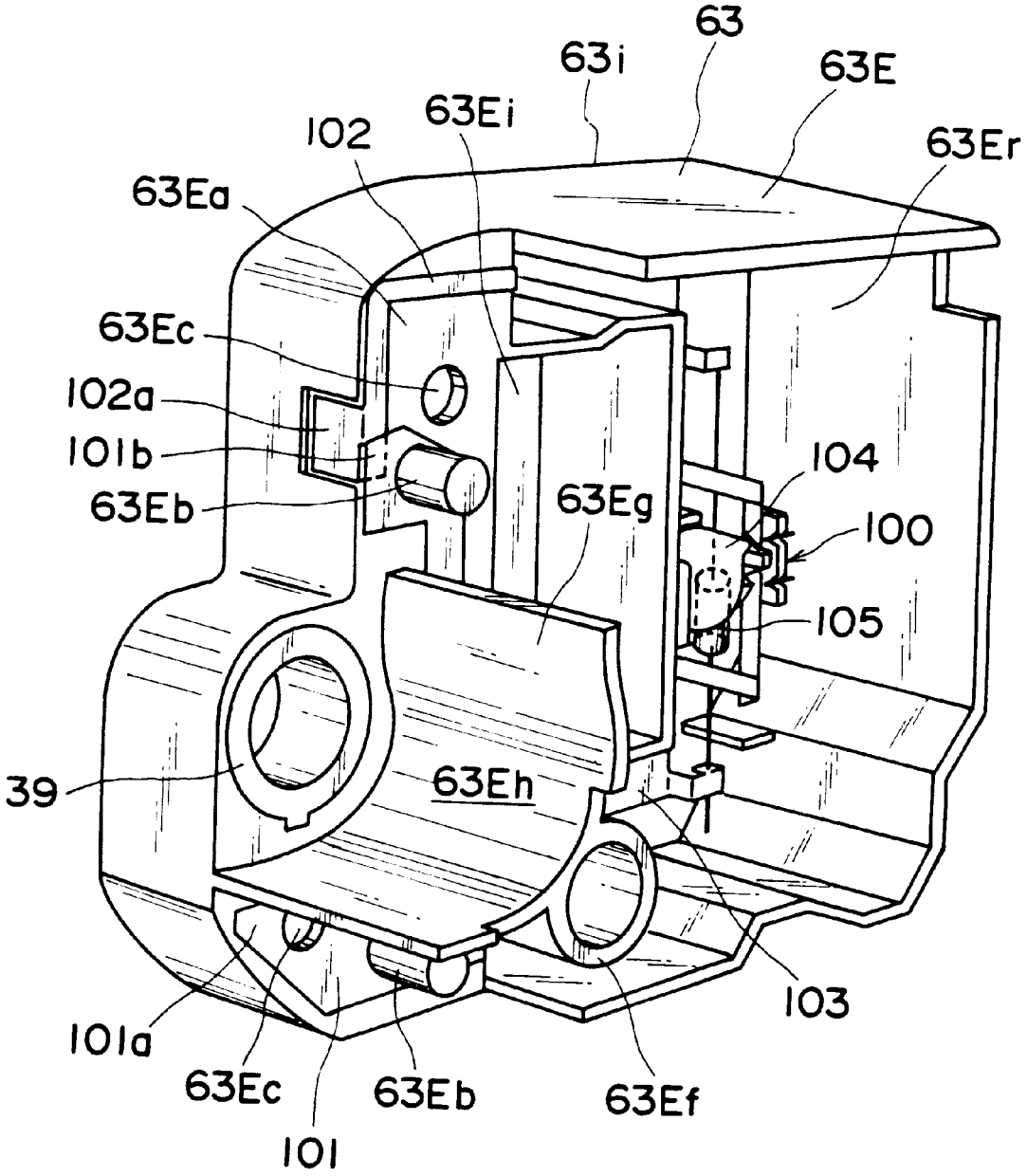
FIG. 45 is a perspective view of a non-driving side cover.

As shown in FIG. 45, a side cover 63E (first side cover) provided at the opposite side from the driving side has a configuration covering the longitudinal end surfaces of the toner frame 63B and the developing frame 63A There is a flat mounting surface 63Ea contacted to the side cover mounting seat 63Ak2 at the longitudinal end surface of developing frame 63A, the mounting surface 63Ea is provided with a cylindrical dowel 63Eb extending in the longitudinal direction and engageable with the positioning holes 63An, 63Ap of the seat 63Ak2 of the developing frame 63A. At the position aligned with the female screw 63Am of the developing frame 63A, a hole 63Ec is formed in the longitudinal direction to fix the side cover 63E to the developing member supporting frame 63A by threading an unshown small screw into the screw 63Am through the hole 63Ec. A developing roller bearing 39 is provided in a hole of the side cover 63E to rotatably support the rotation shaft 12*c* of the developing roller 12 with the side cover 63E being mounted to the developing frame 63A.

From the mounting surface 63Ea, a cylindrical projected portion 63Ef is projected in the longitudinal direction, and the free end of the projection 63Ef presses the shaft gasket 35 of the rotation shaft 19*a* of the application roller 19 to the shaft mounting portion 63Aq of the rotation shaft 19*a* of the application roller 19 of the developing frame 63A. A cover portion 63Eg for covering the outer periphery of the projected end of the rotation shaft 12*c* of the developing roller 12. The cover portion 64Eg has an inner surface 63Eh which is the same as the seal surface of the elastic seal member 32 shown in FIG. 41 (perspective view of the end portion of the application roller), when mounted, it is flush with the seal surface.

Figure 35:
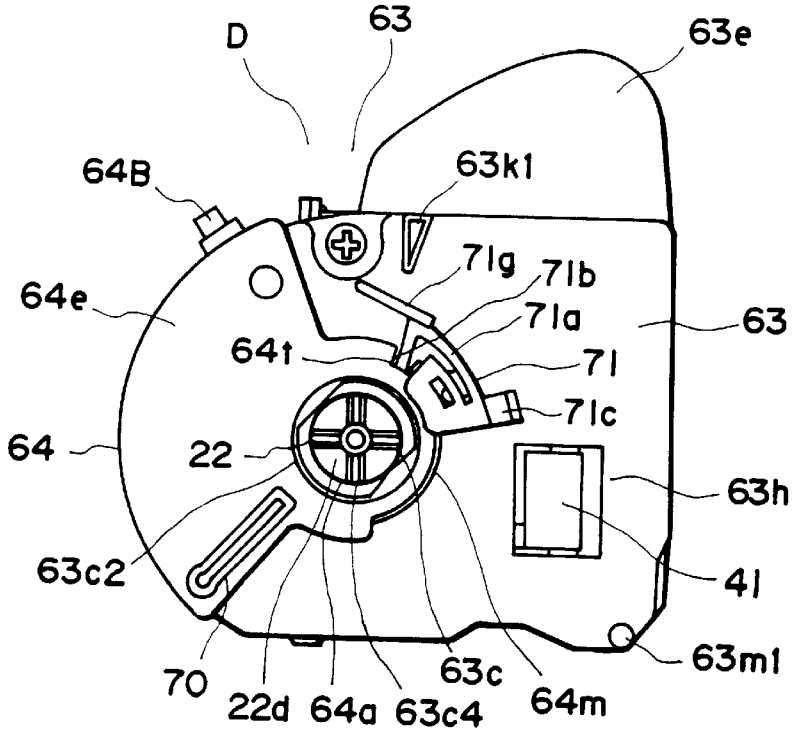
FIG. 35 is a side view of a driving side of a developing cartridge when the shutter is closed.
Figure 36:
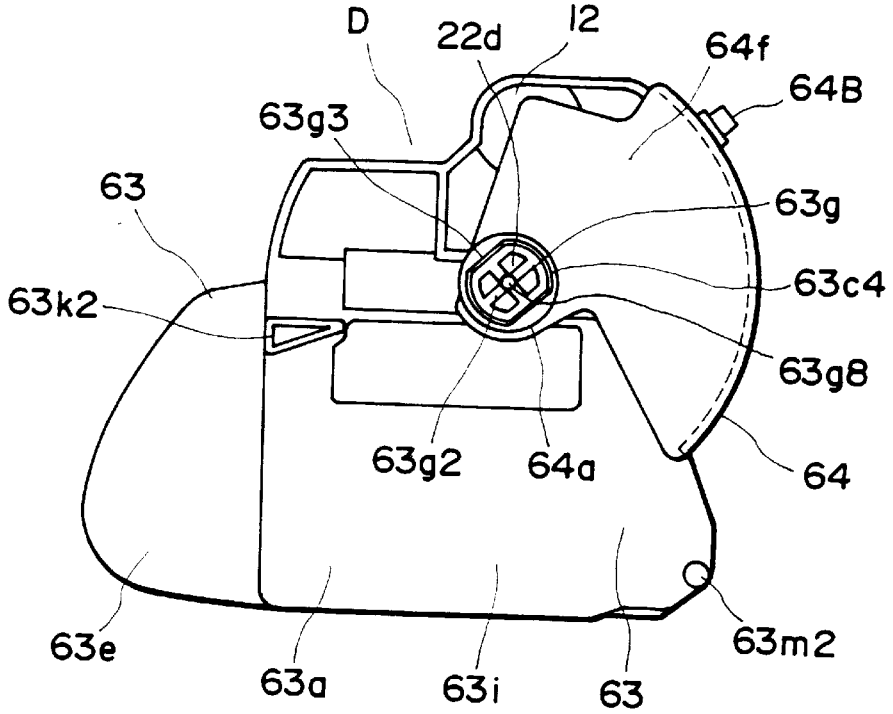
FIG. 36 is a side view of a non-driving side of a developing cartridge wherein the shutter is opening.

The side cover 63E is provided with a toner seal opening 63Ei which extends in the longitudinal direction and through which an end of the toner seal 27 is penetrated to allow the toner seal 27 to be pulled out of the developing cartridge D. The toner seal opening 63Ei is rectangular, having a long side along the lateral direction of the toner seal 27, and the length of the vertical side of the toner seal opening 63Ei thereof in FIG. 35 is larger than the width of the toner seal pulling grip 73 (FIG. 34).

Figure 42:
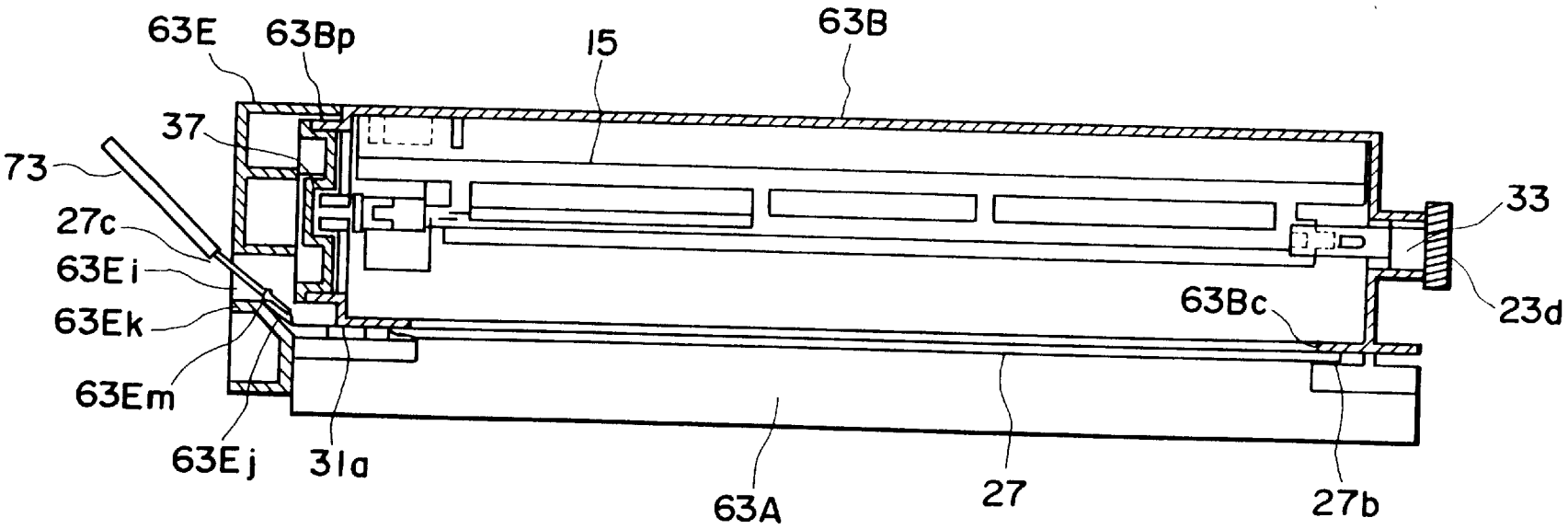
FIG. 42 is a horizontal sectional view of a toner frame.
Figure 43:
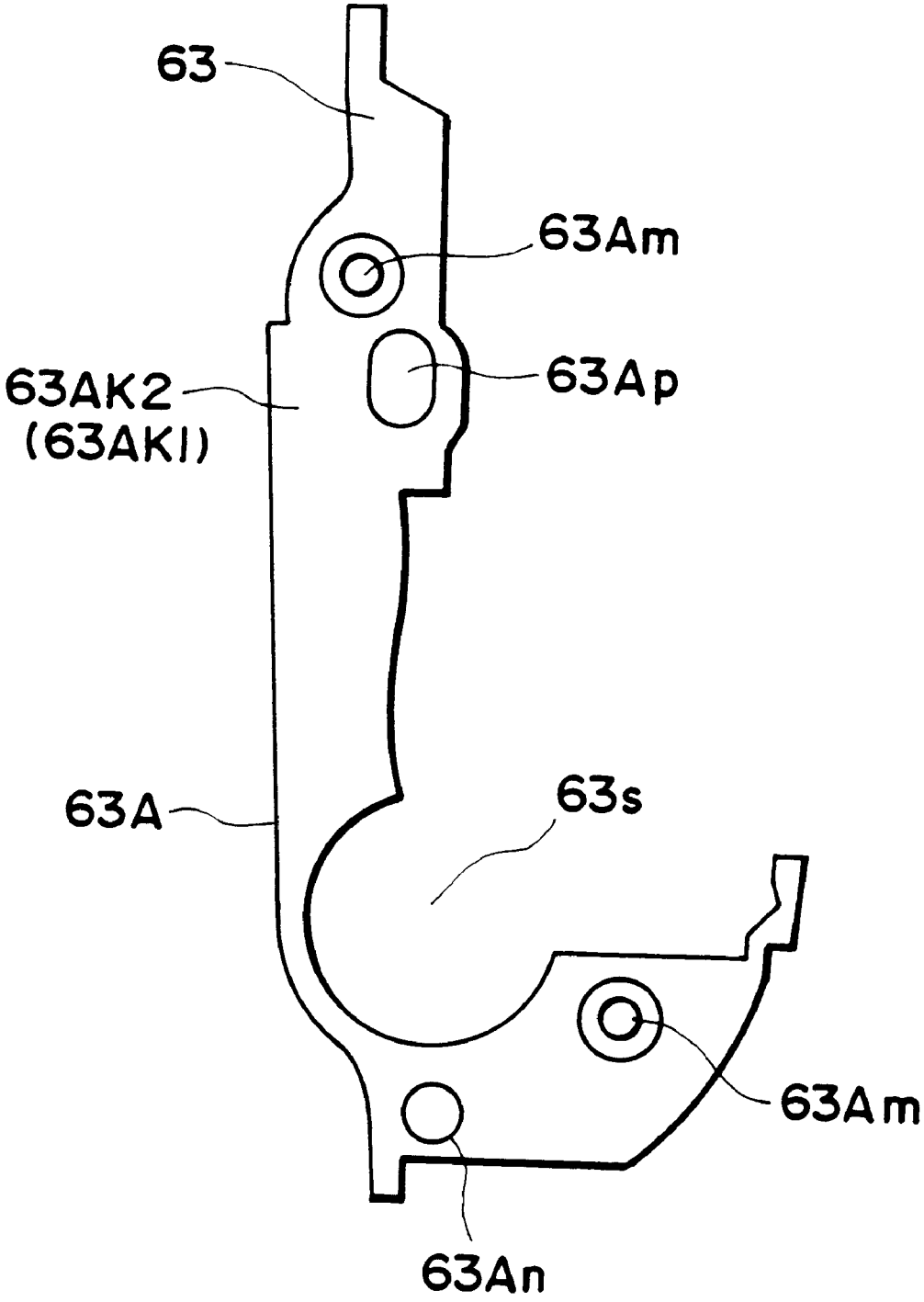
FIG. 43 is a side view of a longitudinal end portion of a developing cartridge.

FIG. 42 is a horizontal sectional view of the toner frame 63B including the toner supply opening 63Bc. The toner seal 27 is stuck on the entire circumference of the edge of the toner supply opening 63Bc, and then turned at the portion 27*b*, and is overlaid on the toner seal portion stuck on the entire circumference of the edge of the toner supply opening 63Bc, and the end 27*c* thereof is bonded to the toner seal pulling grip 73. The end 27*c* of the toner seal 27 and the grip 73 are in the toner seal opening 63Ei, and is extended out of the developing cartridge D.

As shown in FIG. 42, the inside of the toner seal opening 63Ei is provided with an inclined surface 63Ej for guiding the toner seal. The inclined surface 63Ei is a flat surface, and is inclined toward the side having the toner frame 63B. Therefore, the toner seal 27, as shown in FIG. 42, is guided by the inclined surface 63Ej and is pulled out upwardly (inclined) from the portion of the toner frame 63B (toward the toner supply port 63Bp side). The side cover 63E has a flat surface 63Ek which is parallel with the parallel with the toner seal 27 mounting surface 63B of the toner frame 63B and which continues from the inclined surface 63Ej. The inclined toner seal discharging surface 63Ej is not limited to the flat surface, but may be a curved surface having a generating line crossing with the toner seal 27.

When the grip 73 is pulled outwardly, the toner seal 27 is pulled outwardly through the toner seal opening 63Ei so that folded or turned portion 27*b* moves to the left in FIG. 42, and the toner seal 27 is peeled off the edge of the toner supply opening 63Bc from the turned portion 27*b*. By completely pulling out the toner seal 27, the toner supply opening 63Bc is fully opened. By doing so, the toner in the toner frame 63B can be supplied to the developer chamber 63At of the developing member supporting frame 63A (FIG. 30). When the toner seal 27 is pulled out, it is stretched between the corner 63Bm sealed by the end seal 31*a* of the toner frame 63B and the corner portion 63Em formed by the flat surface 63Ek and the inclined toner seal discharging surface 63Ej which is the inner wall of the toner seal opening 63Ei of the side cover 63E. Therefore, the toner seal 27 which is folded back at the front side of the toner seal supply opening 63Bc, is stretched along the toner seal surface at the edge of the opening 63Bc. thus, it is gradually peeled off at the folded portion 27*b* in one direction from the folded portion to the end seal 31*a*. Therefore, the direction in which the user pulls the toner seal 27 through the toner seal opening 63Ei of the side cover 63E can be limited, and therefore, pulling in improper direction (which may result in the end seal 31*a* torn or on leakage of the toner) can be prevented.

The embodiment is summarized as follows:

A side cover for a developing cartridge which is detachably mountable to a main assembly 30 of an electrophotographic image forming apparatus and which is for developing a latent image formed on an electrophotographic photosensitive member 1, wherein said developing cartridge includes a developing roller 12 for developing the latent image formed on the electrophotographic photosensitive member, a toner accommodating portion 63*a* for accommodating toner to be used for development with the developing roller 12, wherein the toner accommodating portion 63*a* includes a toner supply opening 63Bc for supplying the toner accommodated therein to said developing roller 12, a toner seal 27 for sealing the toner supply opening 63Bc, said toner seal 27 unseals the toner supply opening 63Bc by being pulled out prior the start of use to permit supply of the toner accommodated in the toner accommodating portion 63*a* to the developing roller 12, a shaft support portion for rotatably supporting a shaft 12*c* at one end of the developing roller 12 (e.g. Developing roller bearing 39), a toner seal opening 63Ei for guiding the toner seal 27 to the outside when the toner sealing openings 63Bc and 63Ae of the toner accommodating portion 63*a* are opened.

The developing cartridge side cover further includes an engaging portion (e.g. Cylindrical projected portion 63Ef) for engagement with one end of the shaft 19*a* of the application roller 19 for depositing the toner on the peripheral surface of the developing roller 12.

The developing cartridge side cover 63E further includes an urging force receptor portion (e.g. Spring receptor surface) for receiving an urging force from an elastic member (e.g. Compression coil spring) provided on the main assembly 30 of the apparatus for positioning relative to the main assembly 30 of the apparatus, when the developing cartridge D is mounted to the main assembly 30 of the apparatus, and a contact portion (e.g. Boss 63*m*2) for stopping rotation of the developing cartridge by the urging force received by the urging force receptor portion.

The developing cartridge side cover 63E further comprises a shaft mounting portion (e.g. Hole 63Eq) for mounting a shaft (e.g. Projected portion 63*g*) functioning as a pivot when the developing cartridge D is mounted to the main assembly 30 of the apparatus.

The developing cartridge side cover 63E is of an integrally molded plastic resin material.

A griping portion is provided at one longitudinal end of the toner seal 27, and is in the form of a grip (e.g. Grip 73) of plastic resin material mounted to one longitudinal end of the toner seal 27.

Figure 40:
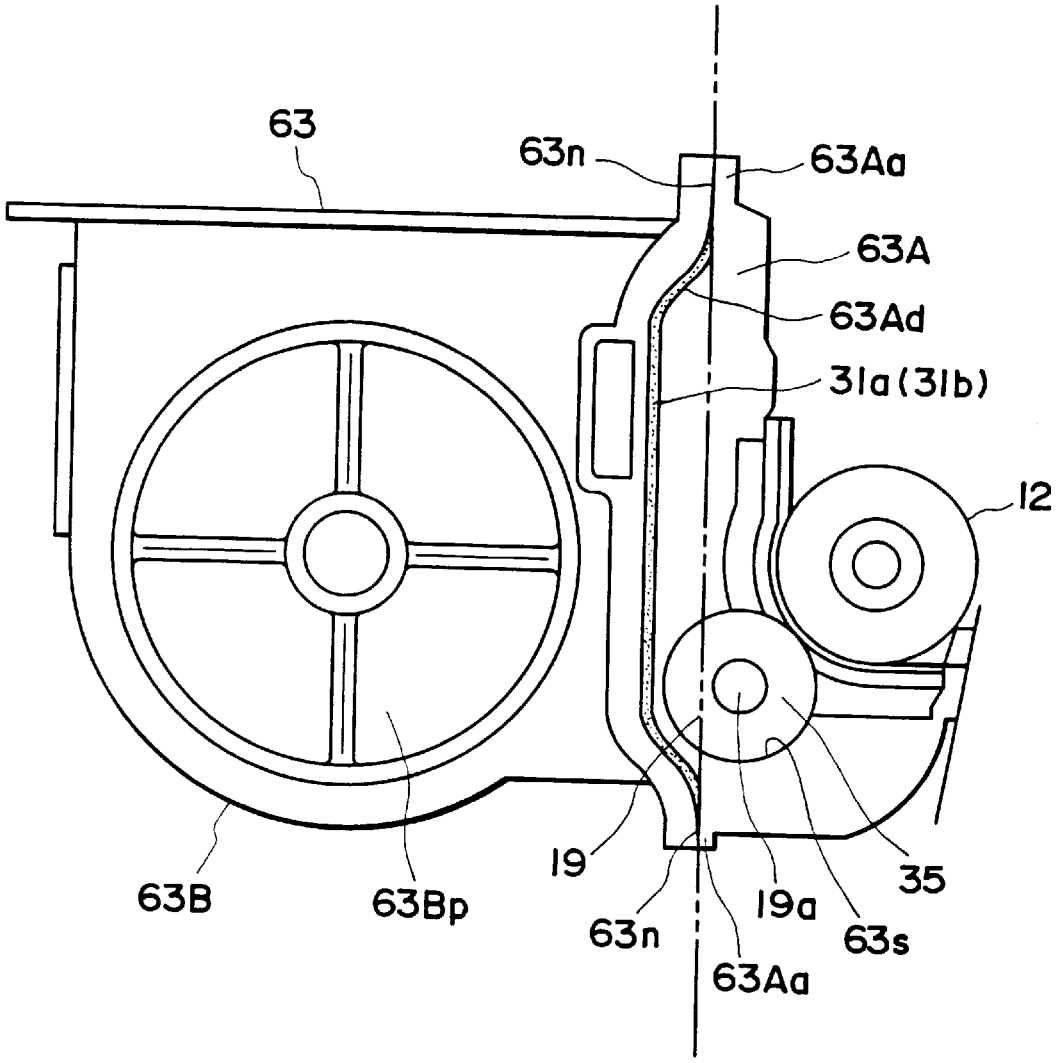
FIG. 40 is a side view of a developing member supporting frame.

The developing cartridge side cover 63E includes a cover portion 63Er for covering a toner cap 37 (FIG. 42) mounted to the toner filling opening to seal toner filling opening (e.g. A toner supply opening 63Bp ((FIG. 40)) for permitting supply of the toner into the toner accommodating portion 63*a*.

The developing cartridge side cover 63E includes a voltage generating circuit 100 for supplying electric energy to the charging roller 91.

(Voltage Generating Circuit to the Charging Roller)

Figure 55:
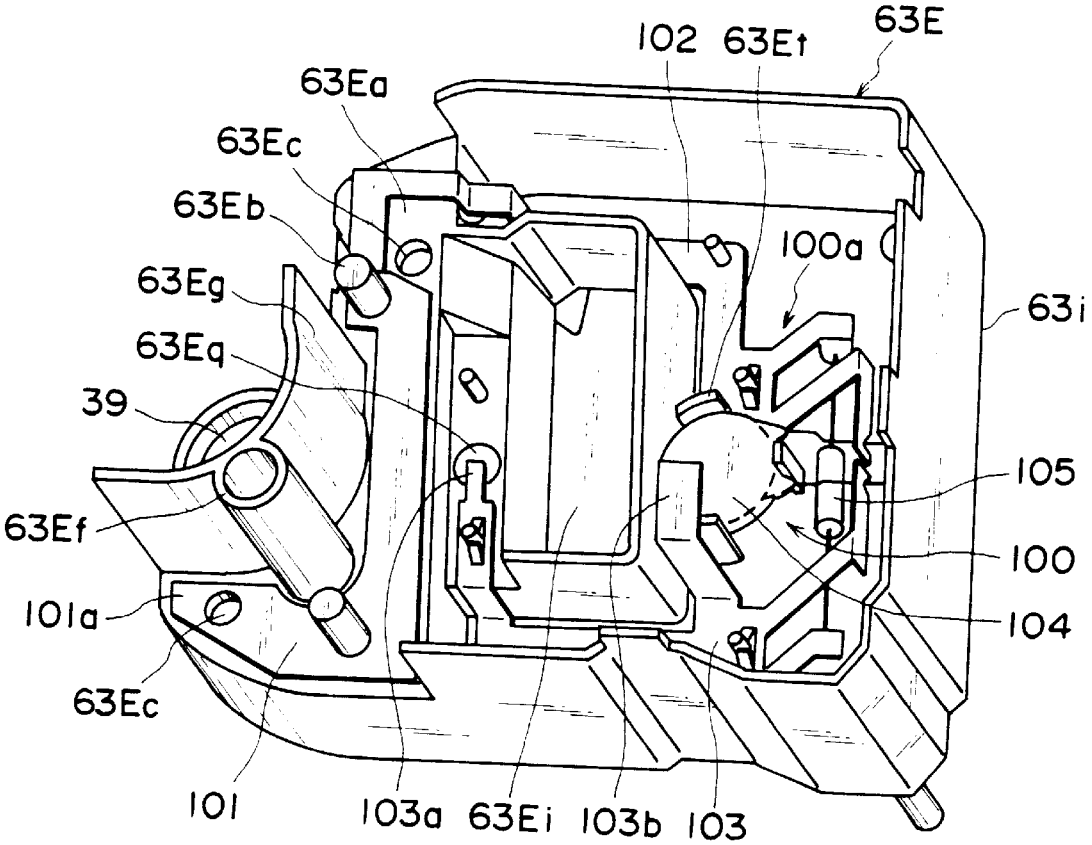
FIG. 55 is a perspective view of an inner side of a side cover of a non-driving side cover.

As shown in FIGS. 45 and 55, the voltage generating circuit 100 is disposed inside the 100 of the voltage generating circuit with a ground connecting metal plate 103 and a bias supply connecting metal plate 102 and a bias supply plate 101. The bias supply connecting metal plate 102 and the connecting metal plate 103 are mounted to the back side of the side cover 63E by press-fitting, heat crimp or the like. The ground connecting plate of metal 103 has a grounding contact portion 103*a* on a hole 63Eq into which the projected portion 63*g* as the shutter pin is inserted. The grounding contact portion 103*a* will be described.

On the other hand, the voltage generating circuit 100 is supplied with a developing bias voltage through the bias supply connecting metal plate 102. The voltage generating circuit 100 is connected to an electroconductive portion 63*g*8 of the projected portion 63*g* through the grounding contact portion 103*a* as a ground portion of the ground connecting metal plate. A bent portion 102*a* of the bias supply connecting metal plate 102 is contacted to an electroconductive plate 93 of the charging roller shown in FIG. 58 when the side cover 63E is mounted to the developing frame 63A and the toner frame 63*b*. The electric connection is established between the electroconductive spring 92 of metal and the electroconductive plate 93 of the charging roller through the shaft 91*s* of the charging roller 91, so that bias supplied to the bias supply connecting metal plate 302 is supplied to the voltage generating circuit 100.

In FIG. 55, the voltage generating circuit 100 includes a capacitor (capacitor element) 104 and a resistance (resistance element) 105 as electrical elements The capacitor 105 is received by a receiving portion 63Et provided integrally on the side cover 63E, and is retained by an electrical element pushing portion 103*b* of the ground connecting metal plate 103 so that it is prevented from rising.

The capacitor 104 of the voltage generating circuit 100 and the resistance 105 thereof are connected in parallel by the bias supply connecting metal plate 102 and the ground connecting plate 103 to constitute a voltage generation portion 100*a* for generating a voltage to be applied to the charging roller 91.

The voltage generating circuit 100 of such a structure is supplied with a developing bias supplied through a rectifying circuit 41E provided on the side cover 63D at a driving side which will be described hereinafter, through bias supply connecting metal plate 102, by which a voltage (bias) to be supplied to the charging roller is generated at the voltage generation portion 100*a* using the bias voltage.

In such a developer cartridge D (Dm, Dc, Dy), the voltage generating circuit 100 is provided inside the side cover 63E mounted at one longitudinal end side of the developer cartridge D(Dm, Dc, Dy) having the voltage generation portion 101*a* and the grounding contact portion 103*a*, so that bias voltage can be supplied to the charging roller 91 without increasing the number of high voltage contacts.

By doing so, the decrease of reliability due to increase of the number of the high voltage contacts can be avoided, and increase of the area required by the contacts can be also avoided, so that developer cartridge D(Dm, Dc, Dy) can be downsized Additionally, the voltage generating circuit 100 is disposed on the side cover 63E at the non-driving side where the space is relatively wide, so that no additional projections for mounting the circuits are required on the outer surface of the developer cartridge D(Dm, Dc, Dy), and therefore, it is advantageous from the ornamental standpoint of the developer cartridge.

Since the capacitor 104 and the resistance 105 and other electrical elements in the voltage generating circuit 100 are electrically connected through the bias supply connecting metal plate 102 and the ground connecting metal plate 103, wiring for connection of the electrical elements are not required, and therefore, the assembling property of the developer cartridge D(Dm, Dc, Dy) is remarkably improved.

The resistance 105 is disposed in parallel with the capacitor 104 in the voltage generating circuit 100. Therefore, even if the rotary member unit 11 rotates with the capacitor 104 electrically charged upon stop, and the developing bias contact (high voltage contact) 41 at the main assembly 30 developing bias contact is rendered off, the resistance 105 discharges the electricity stored in the capacitor 104. Therefore, when the developing bias contact 41 is rendered on for development, no electric charge remains in the capacitor 104, so that no noise due to the remaining charge flowing to the main assembly 30 is liable.

(Grounding Contact of the Charging Roller)

Figure 56:
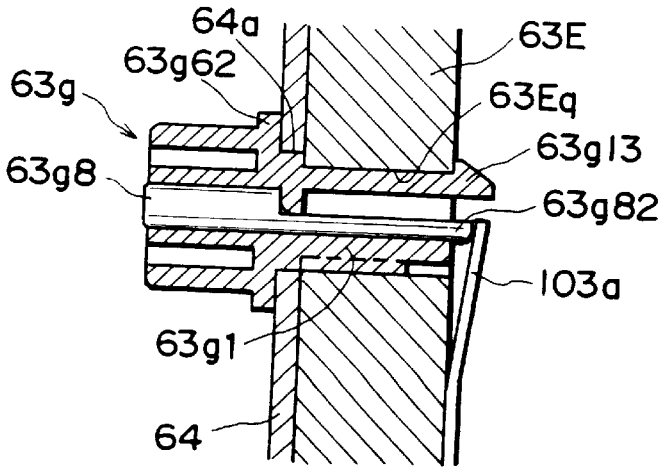
FIG. 56 in an illustration of connection between the shutter pin and a grounding metal plate in a voltage generating circuit.

The description will be made as to the grounding contact portion 103*a* for the charging roller 91. When the projected portion 63*g* as the shutter pin is inserted into the hole 63Eq of the side cover 63Eq, as shown in FIG. 55, the flat portion of the D cutting portion 63*g*82 of the electroconductive portion 63*g*8 of the projected portion 63*g* as shown in FIG. 56, is contacted to the grounding contact portion 103*a* of the ground connecting plate. By this, the ground of he voltage generating circuit 100 is electrically grounded by an unshown ground portion of the main assembly 30 through the electroconductive portion 63*g*8 of the projected portion 63*g*. In other words, the electroconductive portion 63*g*8 functions as a grounding contact for the charging roller 91.

Thus, in this embodiment, when the developer cartridge D(Dm, Dc, Dy) is mounted to the rotary member unit 11, the grounding is effected through the electroconductive portion 63*g*8 of the projected portion 63*g* by the main assembly 30 side ground portion, and therefore, there is no need of using a grounding contact for the voltage generating circuit 100 between the developer cartridge D(Dm, Dc, Dy) and the main assembly 30 of the apparatus, so that voltage generating circuit 100 can be electrically grounded at low cost.

The side cover in the above-described embodiment is summarized as follows. A side cover for a developing cartridge which is detachably mountable to a main assembly of an electrophotographic image forming apparatus, said cartridge including: a cartridge frame, a toner accommodating portion for accommodating the toner; a rotatable developing member (12) for carrying the toner on its peripheral surface to develop an electrostatic latent image formed on an electrophotographic photosensitive member (photosensitive drum 1); a charging member (91) for electrically charging the toner to deposit the toner on the peripheral surface of the developing member; a bias contact (101*b*) for receiving, from the main assembly of the apparatus, a bias voltage to be supplied to the charging member (91) when the developing cartridge is mounted to the main assembly of the apparatus; and a grounding contact (103*a*) for electric grounding between the main assembly of the apparatus and the charging member (91) when the developing cartridge is mounted to the main assembly of the apparatus; wherein the side cover is demountably mounted to the cartridge frame to a longitudinal end of the cartridge frame, and constitute a part of the cartridge frame;

The side cover is provided with a capacitor (104) and a resistance (105) which are parts of a circuit connecting electrically the grounding contact (103*a*) and the charging member (91), when the side cover is mounted to the cartridge frame.

The mounting process of the side cover 63E are summarized as follows.

A mounting method for a developing cartridge D side cover for a developing cartridge D for developing a latent image formed on the electrophotographic photosensitive member 1, said developing cartridge D being detachably mountable relative to a main assembly 30 of electrophotographic image forming apparatus, including:

(a) a developing frame preparing step of preparing a developing frame 63A including a developing roller mounting portion (e.g. Recess 63*s*) for mounting a developing roller for developing a latent image formed on the electrophotographic photosensitive member;

(b) a toner frame preparing step of preparing a toner frame Including a toner accommodating portion 63*a* for accommodating toner to be used for development by said developing roller 12, wherein said toner accommodating portion 63*a* has a toner supply opening 63Bc for supplying the toner accommodated therein to said developing roller 12.

(c) a developing cartridge side cover preparing step of preparing a developing cartridge side cover having a shaft support portion (e.g. Developing roller bearing 39) for rotatably supporting a shaft at one end of said developing roller 12, and having a toner seal opening 63E for directing said toner seal 27 to outside, when the toner supply opening 63Bc and 63Ae are unsealed;

(d) a coupling step of coupling said developing frame 63A and said toner frame 63B;

(e) a side cover mounting step of mounting said developing cartridge side cover 63E to one longitudinal end of said developing frame and said toner frame, while said toner seal 27 is extended from said toner seal opening 63E1 to outside.

In the method, said developing cartridge side cover 63E is fixed to said developing frame 63A by screws.

In the method, said coupling step couples said developing frame 63A and said toner frame 63B by ultrasonic welding.

In the method, said coupling step couples said developing frame and said toner frame by snap fitting, and/or by snap clip.

By integrally molding the shaft support member for the bearing 39 for the developing roller 12 and the side cover 63E, the number of parts can be reduced.

(Side Cover at the Driving Force Reception Side (Developing Bias Contact))

Figure 46:
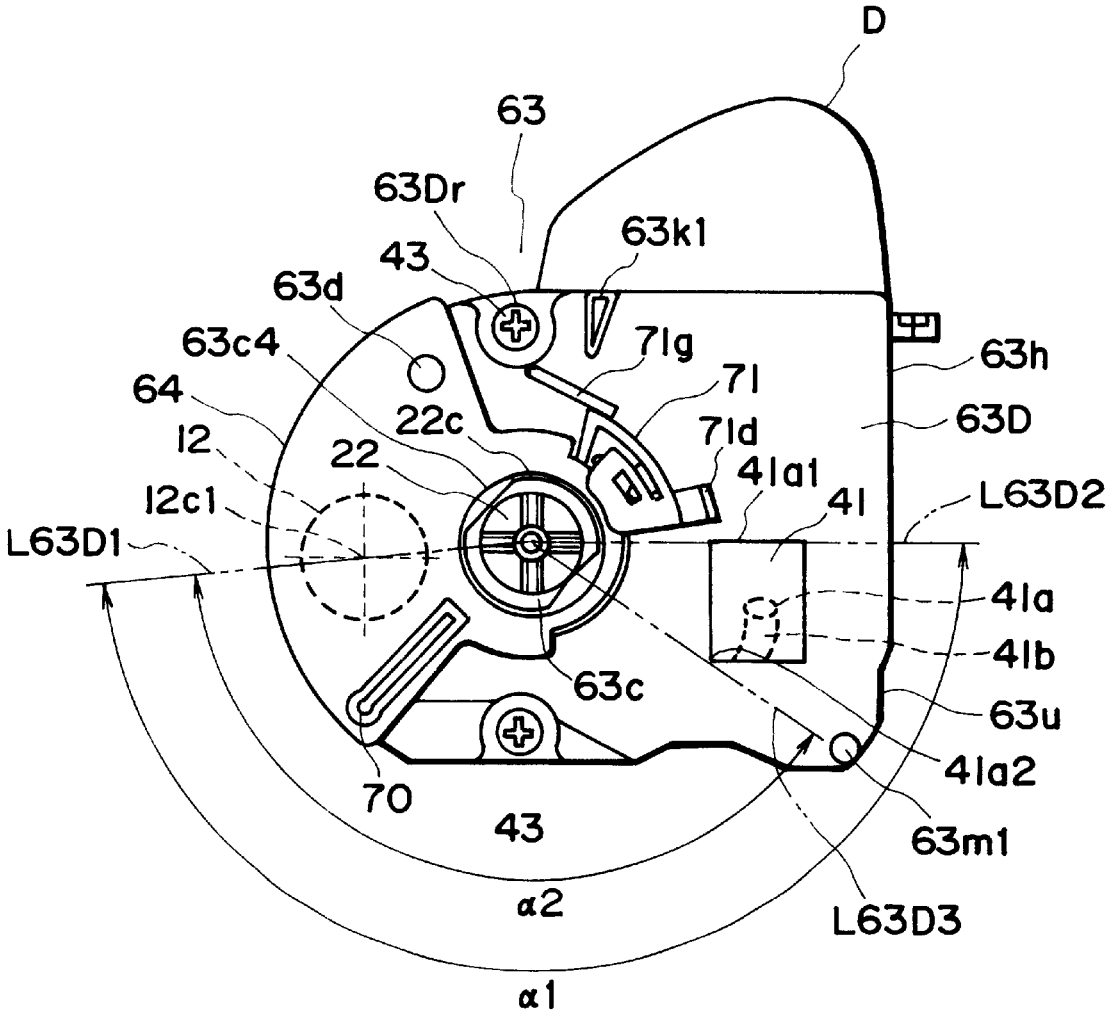
FIG. 46 is a side view of a driving side cover.

As shown in FIG. 46, the side surface 63*h* of the side cover 63D provided at the driving force reception side of the developing cartridge D constitutes a flat surface substantially perpendicular to the longitudinal direction when the developing cartridge D has been assembled. The side surface 63*h* has an integral cylindrical projected portion 63*c* enclosing the driving force receiving member 22.

The free end of the projected portion 63*c* and the free end (in the axial direction) of the driving force receiving member 22 are substantially on a flat surface parallel with the side surface 63*h*.

The side surface 63*h* has a developing bias contact 41 which is flush with the side surface 63*h* and exposed there. The configuration of the developing bias contact 41 is substantially rectangular, and one side 41*a*1 thereof is on a line L63D2 passing through the center of rotation 22*c* of the driving force receiving member 22. The line L63D2 passing through the center of rotation 22*c* of the driving force receiving member 22 is at approx. $\alpha 1$=approx. 175° away, in the counterclockwise direction, from a line L63D1 connecting the center 12*c*1 (center of rotation of the developing roller 12) of the rotation shaft 12*c* of the developing roller 12 and the center of rotation 22*c* of the driving force receiving member 22 as seen from the outside of the side cover 63D having the developing bias contact, in the longitudinal direction of the developing roller 12. An angle $\alpha 2$ formed between the line L63D3 connecting the center of rotation 22*c* of the driving force receiving member 22 and the corner 41*a*2 of a side opposed to the side 41*a*1 of the developing bias contact 41 and a line L63D1 connecting the centers of rotation 12*c*1 and 22*c* of the developing roller 12 and the driving force receiving member 22 is 140°. The developing bias contact 41 is disposed in a region of 140° to 175° in the counterclockwise direction relative to the line L63D1 connecting the center of rotation 12*c*1 of the developing roller 12 and the center of rotation 22*c* of the driving force receiving member 22, as seen from the side cover 63D of the cartridge frame 63 which has the developing bias contact 41, in the longitudinal direction of the developing roller 12.

Because the developing bias contact 41 is disposed in such a region, the portion to be contacted to the main assembly developing bias contact member (contact pin, unshown) provided in the main assembly of the apparatus, is in the region. Therefore, a portion of the developing bias contact other than the contacting portion may be out of the region. However, further preferably, all the region of the developing bias contact 41 is in the position within the region.

The developing bias contact 41, when the developing cartridge D is mounted to the rotary unit 11, is contacted to the developing bias contact pin 42 provided on the flange 11*g* of the rotary unit 11 and projected by elastic force in the axial direction from the wall surface 11*a*. In FIG. 46, the portion enclosed by the broken lines 41*a*, define the portion contacting to the contact pin 42 during the development. In FIG. 46, the portion enclosed by the broken lines 41*b*, define the portion rubbing with the contact pin 42 during the development. The developing cartridge D, when it is mounted to the rotary unit, and the rotary unit is rotated for positioning, the spacer rollers 12*a*, 12*b* at the opposite ends of the developing roller 12 are abutted to the photosensitive drum 1. The developing cartridge D is supported by the arcuate ribs 26*a*, 59*e* of the rotary unit supporting the projected portions 63*c*, 63*g* of the cartridge frame 63 against the spring force of the compression coil spring, and pivots about the center of rotation 22*c* of the driving force receiving member 22 (centers of the projected portions 63*c*, 63*g*) Since the developing bias contact 41 is disposed in the above-described region, the developing bias contact pin 42 projected from the rotary unit is not out of the developing bias contact 41 despite the pivoting action. Therefore, the developing bias contact pin and the developing bias contact 41 are in sliding contact with each other during the rotational positioning operation in the developing process operation, so that no electric conduction defect occurs due to foreign matter sandwiched between the contact pin 42 and the contact 41. The developing bias contact pin is not contacted to the surface of the synthetic resin material of the side 63*h* of the developing cartridge D during the rotation of the rotary unit 11, and therefore, the 63*h* is not scraped.

During the developing operation, through the contact pin and the developing bias contact 41, the developing roller 12 is supplied with a developing bias voltage which is an AC voltage having a peak-to-peak voltage of 2000V and a frequency of 2000 Hz biased with a DC voltage of −400V.

The developing bias contact 41 of the developing cartridge D mounted to the rotary unit 11 has a substantially rectangular shape, and the center portion of the rectangular is contacted to the developing bias contact pin provided in the rotary unit 11.

The driving force receiving member 22, the developing bias contact 41 and the positioning projection (pin) 63*d* are substantially aligned on a line.

As described in the foregoing, the developing cartridge D of this embodiment is summarized as follows.

A developing cartridge D comprises: a driving force receiving member 22 for receiving a driving force for rotating the developing roller 12 from the main assembly of the apparatus; wherein said driving force receiving member 22 is exposed from a portion (e.g. side cover 63D) of said cartridge frame, provided at one longitudinal end portion; a developing bias contact 41 for receiving a developing bias voltage to be applied to the developing roller 12 from the main assembly of the apparatus when mounted to the main assembly of the electrophotographic image forming apparatus, wherein the developing bias contact 41 is exposed from a portion (e.g. the side cover 63D) of the cartridge frame provided at the one longitudinal end portion of f developing roller 12.

The developing bias contact 41 is within a range of 140° to 175° from a line L63D1 connecting a center of rotation of said developing roller and a center of rotation of said driving force receiving member in a center of rotation as seen from an outside of such a portion (63D) of said cartridge frame as has said developing bias contact 41, in a longitudinal direction of said developing roller.

The developing bias contact 41 is substantially rectangular, and substantial center portion of the rectangular shape is contacted to a developing bias contact pin provided in the main assembly, so that developing bias contact receives a developing bias to be applied to said developing roller from the main assembly through said developing bias contact pin.

A short side of the rectangular shape is extended along a line L63D2 which is at approx. 175° from the line connecting the center 12C1 of rotation of said developing roller 12 and the center 22*c* of rotation of said driving force receiving member 22 in the counterclockwise direction.

The developing bias contact 41 is disposed at such a position that corner portion of the rectangular shape contacts a line L63D1 positioned at approx. 145° from the line connecting the center 12*c*1 of rotation of said developing roller 12 and the center of rotation of said driving force receiving member 22 in the counterclockwise direction.

The developing cartridge D further comprises a developing blade 15 for regulating an amount of the toner deposited on a peripheral surface of said developing roller 12.

Figure 48:
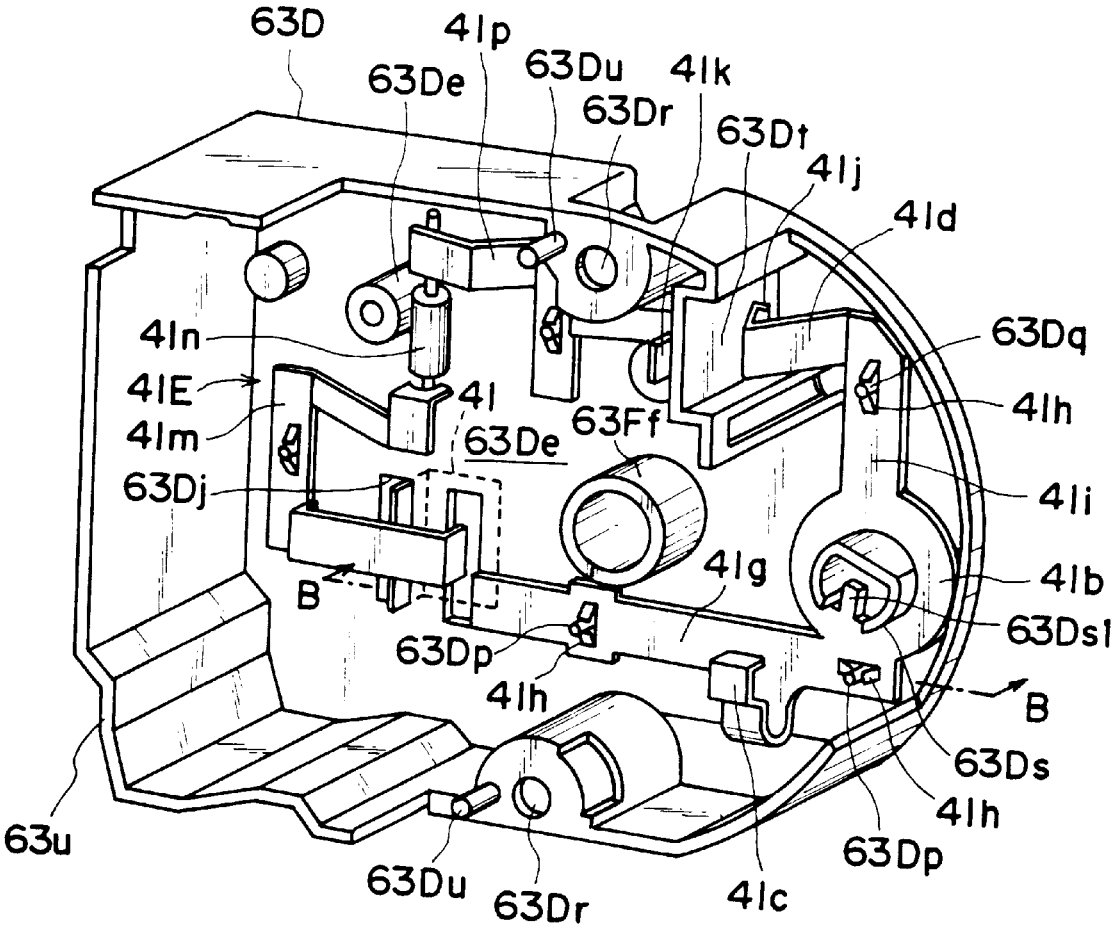
FIG. 48 is a perspective view of an inside of the driving side cover.
Figure 49:
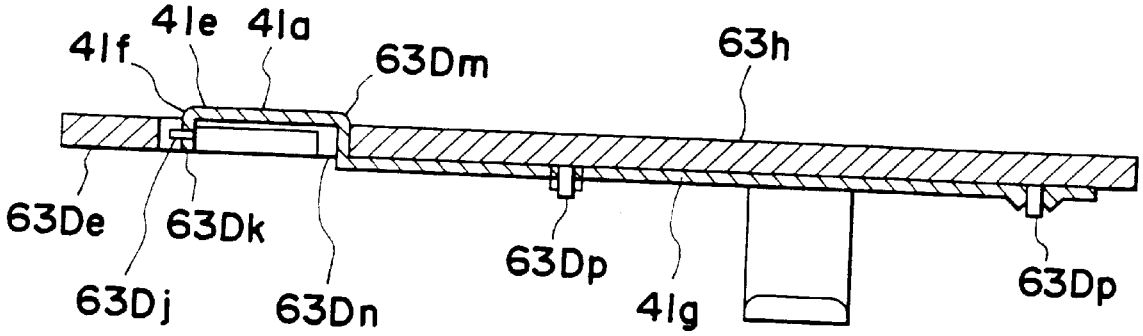
FIG. 49 is a sectional view taken along a line B—B of FIG. 48.
Figure 50A:
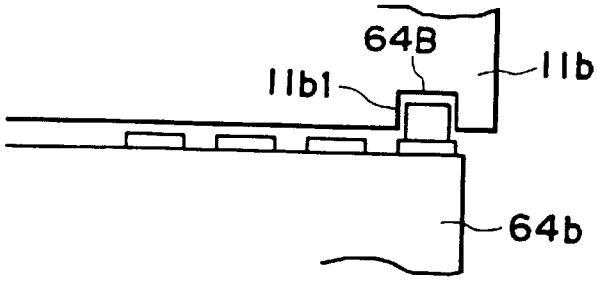
FIG. 50 ((*a*), (*b*), (*c*), (*d*)) is schematic top plan views of a developing cartridge discriminating means.
Figure 50B:
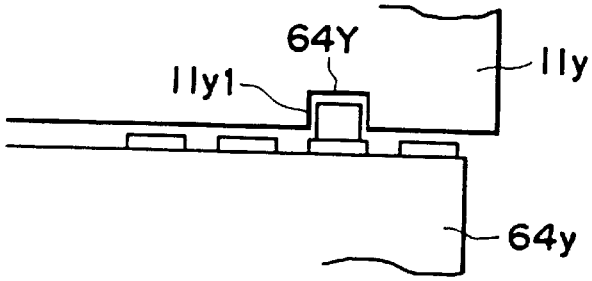
Figure 50C:
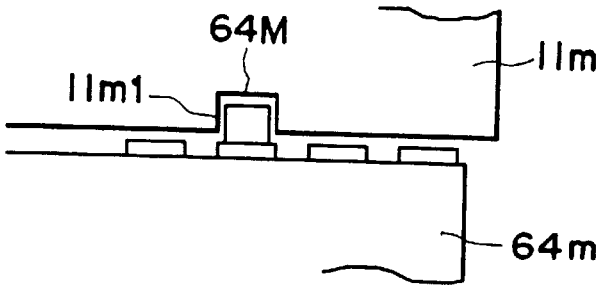
Figure 50D:
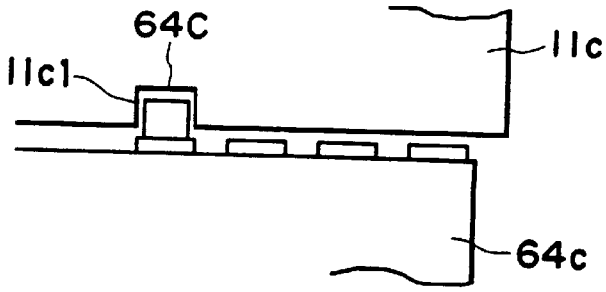

The toner accommodated in said toner accommodating portion 63*a* is yellow color toner, magenta color toner or cyan color toner, and said developing cartridge further comprises an application roller 91 for depositing the toner on a peripheral surface of said developing roller 12, and a charging roller 91 for applying the charge to the toner on the peripheral surface of the developing roller 12, wherein the bias received from the main assembly is applied to said developing roller 12, said developing blade 16 and said application roller 19. As shown in FIG. 48, the bias received from the main assembly is applied to the metal plate 16*a* of the developing blade 16 through the first leaf spring portion (41*d*). It is supplied to the application roller 19 through the second leaf spring portion (41*c*). The contact portion (41*k*) of the electroconductive plate 2(41*p*) and the contact plate (93) of the charging roller are connected through the electroconductive plate 1(41*m*) contacted to the bias contact 41 (rectifying circuit 41E), the diode (41*n*) and the electroconductive plate 2(41*p*), and the bias voltage is applied to the charging roller through the contact spring (92) and the shaft (91*s*). The voltage is applied to the shaft portion (12*c*) of the developing roller 12 through the coil spring (46) as a developing bias contact spring, wherein the developing bias contact 41, the first leaf spring portion (41*d*) and the second leaf spring portion (41*c*) constitute an integral metal member.

The toner accommodated in said toner accommodating portion 63*a* is black color toner, wherein the bias received from the main assembly by said developing bias contact 41 is applied to said developing roller 12, and not to said developing blade 16.

As described in the foregoing, the developing cartridge D includes the developing cartridge side cover 63D having, as a portion of the cartridge frame 63, the opening for exposing the driving force receiving member 22 and a developing bias contact mounting portion for mounting the developing bias contact 41 The side cover 63D of the developing cartridge includes the urging force receptor portions (spring receptor portions) 63*k*1, 63*k*2 for receiving the urging force of the compression coil spring 11*d* provided in the rotary unit 11 of the main assembly 30 of the apparatus when the developing cartridge D is mounted to the main assembly 30 of the electrophotographic image forming apparatus, and the abutment portions in the form of bosses 63*m*1, 63*m*2 for contacting to the rotary unit 11 of the main assembly 30, for regulating the rotation of the developing cartridge D rotated by the force received by the urging force receptor portions 63*k*1, 63*k*2. The developing bias contact 41 is located at a position retracted from the free end 63*c*3 of the cylindrical portion 63*c*2 having the opening for exposing the driving force receiving member 22 and the urging force receptor portions 63*k*1, 63*k*2 in the longitudinal direction of the developing roller 12.

The side cover 63D is securely fixed to the coupling frame 63F by screws 43 threaded through the hole 63Dr s of the side cover 63D into the screws 63Fe (FIG. 44). The dowel 63Du of the side cover 63D is engaged with a hole 63Fr of the coupling frame 63F to accomplish relative positioning between the cover 63D and the frame 63F. One of the holes is elongated.

Figure 47:
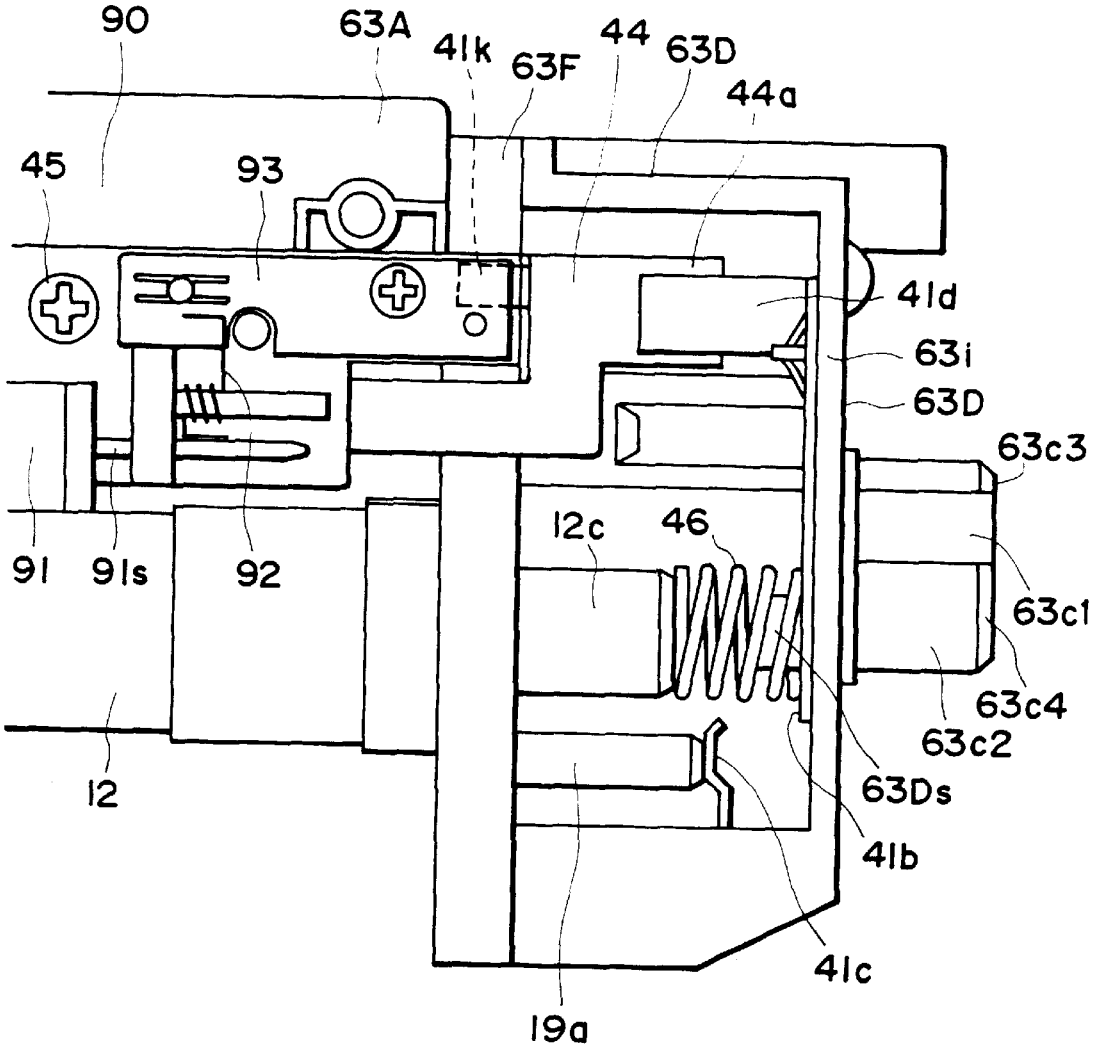
FIG. 47 is a front view of an end with the shutter of the developing cartridge being removed.

As shown in FIG. 47, the inside of the side cover 63D is provided with a spring holding projection 63Ds projected in the axial direction toward the end of the rotation shaft 12*c* of the developing roller 12, and around the spring holding projection 63Ds a contact portion 41*b* is provided. An application roller contact portion 41*c* contacted to the end of the rotation shaft 19*a* of the application roller 19 is provided as a second leaf spring portion in the form of a cantilever. In the case of the color developing cartridges Dy, Dm, Dc, the developing blade 16 is elastic, and in order to urge the blade supporting metal plate 16*a* (flexible thin plate), a confining plate 44 is overlapped on the blade supporting metal plate 16*a* and is engaged with and positioned by a dowel 63Aw integrally formed with the developing member supporting frame 63A. Small screws 45 are threaded through holes of the plate 44 into the developing member supporting frame 63A. The plate 44 is extended to a neighborhood of the back side of the side surface 63*i* of the side cover 63D at the driving force reception side, and the free end 44*a* thereof is overlapped with the developing blade contact portion 41*d* of the developing bias contact 41. As shown in FIG. 48 the developing blade contact portion 41*d* is inclined toward the free end 44*a* of the plate 44, and the free end 44*a* of the plate 44 is abutted to the inclined surface, by which the developing blade contact portion 41*d* is bent. In other words, the developing blade contact portion 41*d* functions a first leaf spring portion. A second leaf spring portion is provided by the charging roller contact portion 41*k* contacted to the charging roller electroconductive plate 93 through the electroconductive spring 92 of metal to the shaft 91*s* of the charging roller 91.

The contact 41, the inner developing bias contact portion 41*b*, the application roller contact portion 41*c*, the developing blade contact portion 41*d*, are formed as integral metal sheet to constitute the developing bias contact member. Therefore, the developing roller 12, the developing blade 16 and the application roller 19 are maintained at the same potential. The material of the developing bias contact member may be phosphor bronze, belium bronze, stainless steel or the like. The contact portion (41*k*) for the charging roller contact plate is connected to the developing bias contact (41) through the rectifying circuit 41E (electroconductive plate (41*m*), diode (41*n*) and electroconductive plate 2(41*p*)).

Between the inner developing bias contact portion 41*b* and the end surface of the rotation shaft 12*c* of the developing roller 12, a developing bias contact spring 46 in the form of a metal compression coil spring is compressed.

In the case of the black developing cartridge Db, the plate 16*a* supporting the elastic blade 16*c* of the developing blade 16 is rigid and in the form of a strip, and therefore, no confining plate 44 used in the above-described color developing devices Dy, Dm, Dc is not used. Therefore, the developing blade contact portion 41*d* of the black developing cartridge Db and the developing blade 16 re electrically isolated, so that developing blade contact portion 41*d* does not function. Thus, the developing roller 12 of the black developing cartridge Db is supplied with the developing bias, but the developing blade 16 is not supplied with it.

Figure 41:
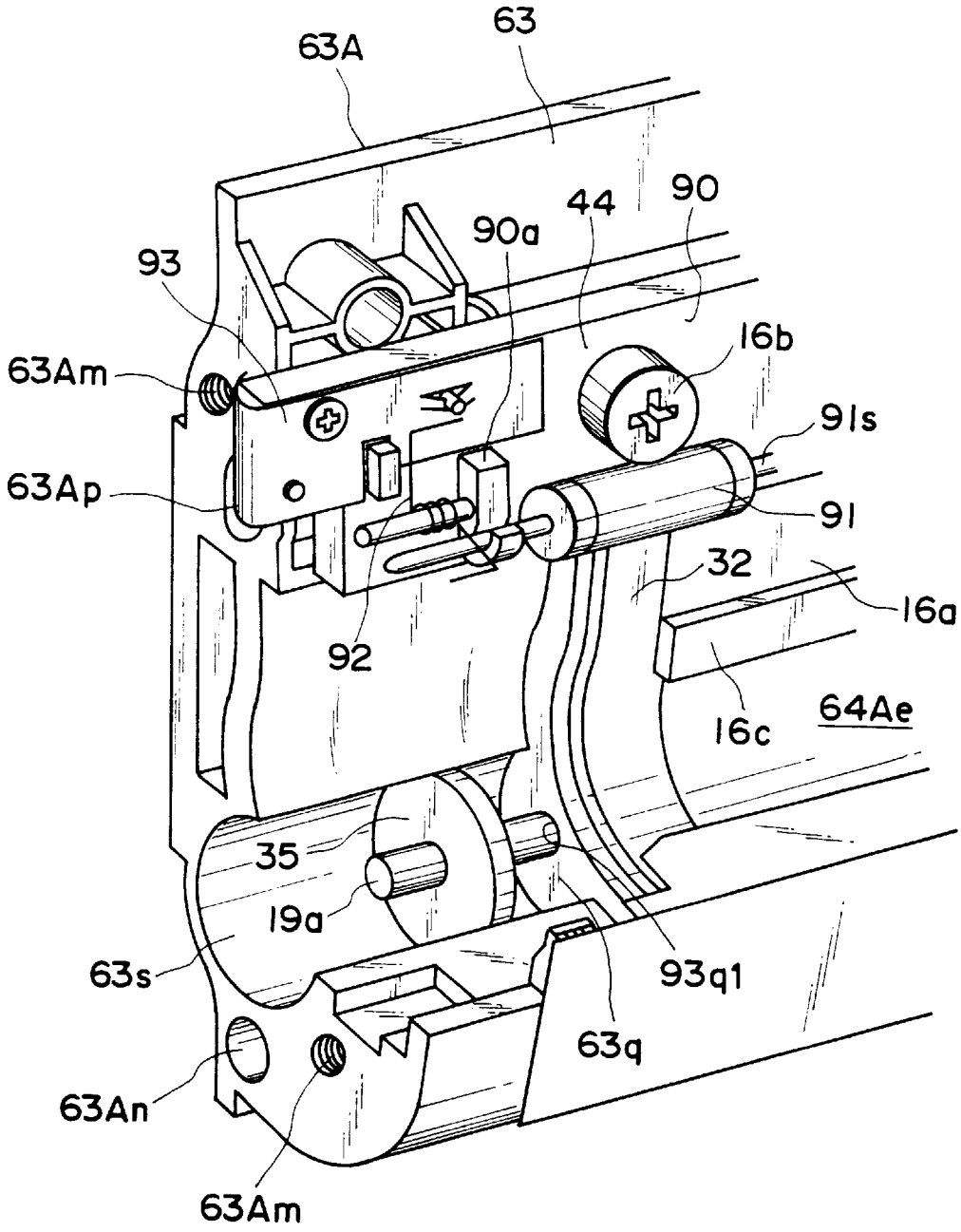
FIG. 41 is a perspective view of an end of developing member supporting frame.

As shown in FIG. 47 showing the inside of the side cover 63D at the driving force reception side, the back side 63De parallel with the side surface 63*h* of the side cover 63D is flat, and is contacted by the inner developing bias contact portion 41*b*. As shown in FIG. 42 (B—B sectional view of FIG. 41), the connection between the inner contact portion 41*b* and the outer exposed portion 41*a* is such that one end portion 41*e* of the outer exposed portion 41*a* is bent to provide a bent portion 41*f* which is provided with a hole, which in turn is engaged with a dowel 63Dk in the elongated hole 63Dj penetrating between the side surface 63*h* and back side 63De. An elongated hole 63Dn parallel with the elongated hole 63Dj is provided, and the other side of the outer exposed portion 41*a* is bent into the inside through the elongated hole 63Dn, and the conductive plate portion 41*g* extended along the back side 63De of the side cover 63D is contacted to the back side 63De. As shown in FIG. 41, it continues to and flush with the outer circumference portion of the inner contact portion 41*b*. A dowel 63Dp projected at the back side 63De of the side cover 63D is engaged with the hole 41*h*, with the reverse, of the conductive plate portion 41*g*. In FIG. 48, a hole 41*h*, with the reverse, of the conductive plate portion 41*i* flush with the upper part of the contact portion 41*b* is engaged with the dowel 63Dq projected from the inside of the side cover 63D. The conductive plate portion 41*i* is contacted to the back side 63De of the side cover 63D. A blade contact portion 41*d* is inclinedly and integrally extended from the conductive plate portion 41*i* as if it is bent by more than 90 degrees as shown in FIG. 48. The free end portion of the blade contact portion 41*d* is folded into a contact end 41*j* to suppress wearing, and the contact end is contacted to the wall surface 63Dt provided on the back side 63De of the side cover 63D.

Designated by 63Ds is a supporting portion for supporting a magnet provided in the inside of the developing roller 12 of the black developing cartridge. Designated by 63Ds1 is an urging portion for urging a magnet with the elastic force of the molded portion in the thrust direction.

The application roller contact portion 41*c* is extended downwardly from a part of the bottom edge of the lower, and the end portion thereof is bend upwardly to provide a contact portion 41*c*.

With this structure, the developing bias applied to the outer exposed portion 41*a* of the developing bias contact 41 is applied to the developing roller 12 through the inner developing bias contact portion 41*b*, the developing bias contact spring 46 and the developing roller shaft 12*c*, and is also applied to the rotation shaft 19*a* of the application roller 19 contacted to the application roller contact portion 41*c* to provide the same potential as the developing roller 12 with the application roller 19. The developing bias applied to the outer exposed portion 41*a* is applied to the developing blade 16 through the plate 44 contacted to the developing blade contact portion 41*d*, so that same potentials are provided for the developing roller 12 and the developing blade 16. In addition, the developing bias applied to the outer exposed portion 41*a* is applied to the charging roller 91 through the rectifying circuit 41E.

Since the developing bias is applied to the developing roller 12, the developing blade 16, the application roller 19 and the rectifying circuit 41E by the developing bias contact member 41 which is an integral member, so that no contact portion exists and therefore electrical stabilization is accomplished.

In the black developing cartridge Db, the voltage is not applied to the developing blade 16. It does not have an application roller.

As regards the developing bias contact, the developer cartridge with the developing bias contact pivots in the rotary unit about the center of rotation of the driving force receiving member 22 (pressure for urging the developing roller to the photosensitive drum). During the rotation, the disengagement between the developing bias contact pin projected from the rotary unit of the main assembly and the developing bias contact of the developing cartridge is prevented. By this, the outer wall of the developing cartridge (surface of the side cover) is prevented from being scraped, or the conduction defect stemming from the foreign matter introduced between the developing bias contact and the pin can be prevented.

In the foregoing, the side cover 63D covers all of the application roller gear 23*e*, the stirring gear 23*d*, the stepped idler gear 23*c* and developing roller gear 23*b* or the like engaged with the driving gear 23*a*. However, the side cover 63D does not receive external force for the driving of the developing cartridge D.

Since the cylindrical projected portion around the opening for the driving force receiving portion and the contact mounting portion are at the same side of the same member, which is to be positioned, then the positional accuracy of the contact relative to the main assembly of the apparatus and the drive input portion can be enhanced.

The side cover 63D of this embodiment is used for a developing cartridge detachably mountable to a main assembly of an electrophotographic image forming apparatus for developing a latent image formed on the photosensitive member.

It comprises an opening (e.g. an opening 63*c*4 provided in a cylindrical portion 63*c*2 as a projected portion) for exposing said driving force receiving member 22.

It also comprises a developing bias contact mounting portion for mounting said developing bias contact.

The developing cartridge side cover 63D further comprises an urging force receptor portion (e.g. spring receptor portion 63*k*) for receiving urging force of a spring member (e.g. compression coil spring 11*d*) provided in the main assembly 30 of the apparatus when the developing cartridge is mounted to the main assembly 30 of the electrophotographic image forming apparatus, and an abutment portion (e.g. boss 63*m*) for contacting to the main assembly 30 to limit the rotation of the rotation developing cartridge D which is rotated by the force received by said urging force receptor portion.

The urging force receptor portion is in the form of a flat plate projected, and said abutment portion is in the form of a projected column.

The opening 63*c*4 for exposing the driving force receiving member is formed in the cylindrical portion projected so as to enclose the driving force receiving member 22.

The developing cartridge D is provided with a shutter 64 movable between a close position for covering the exposed portion of the developing member (e.g. developing roller 12) and a retracted position retracted from the close position, and said cylindrical portion 63*c*2 rotatably mounts one longitudinal end of said shutter 64.

The developing cartridge side cover 63D has a mounting portion 71C for mounting a locking member 71 for locking said shutter 64 at the close position.

The developing cartridge side cover 63D is provided with bores 63Dr for demountably mounting the developing cartridge side cover 63D to the coupling frame 63F for supporting the coupling member 22*d* as the driving force receiving member 22. The coupling frame 63F is mounted to the developing frame 63A including a mounting portion for the developing roller 12.

The developing cartridge side cover 63D covers the gear (e.g. developing roller gear 23*b*) for transmitting driving force received by the coupling member 22*d* as the driving force receiving member from the main assembly 30, to the developing member in the form of a developing roller 12, when its mounted to the developing frame 63A through the coupling frame 63F.

When the developing cartridge side cover 63D is mounted to the developing frame 62A, it is mounted to the developing frame 63A with the coupling frame 63F supporting the coupling member 22*d* as the driving force receiving member sandwiched therebetween.

The developing cartridge side cover 63D is an integrally molded plastic resin material.

The mounting method of the developing cartridge side cover 63D comprises:

A mounting method of a side cover of a developing cartridge for a developing cartridge for developing a latent image formed on the electrophotographic photosensitive member, said developing cartridge being detachably mountable to a main assembly of an electrophotographic image forming apparatus, said method comprising the steps of:

(a) preparing a developing frame 63A including a developing member mounting portion for mounting a developing member (e.g. developing roller 12) for developing a latent image formed on the photosensitive member;

(b) preparing a coupling frame 63F for supporting a driving force receiving member 22 for receiving driving force for rotating said developing member from the main assembly 30 of the apparatus when mounted to the main assembly 30 of the electrophotographic image forming apparatus;

(c) preparing a developing cartridge side cover 63Da having an opening 63*c*4 for exposing said driving force receiving member 22, and a developing bias contact 41 for receiving a developing bias to be applied to said developing member from the main assembly 30 when the developing cartridge D is mounted to the main assembly 30;

(d) mounting the coupling frame 63F to the developing frame 63A;

(e) mounting the developing cartridge side cover 63D to the coupling frame 63F such that developing bias contact 41 is electrically connected to the developing member and that driving force receiving member 22 is exposed through the opening 63*c*4 of the developing cartridge side cover 63D.

In the coupling frame mounting step, the coupling frame 63F is mounted to the developing frame 63A by screws, and in the developing cartridge side cover mounting step, the developing cartridge side cover 63D is mounted to the coupling frame 63F by screws.

In the embodiment, the side cover 63E and the developing member supporting frame 63A are screwed, but the connecting method may be another, for example, snap-fit and/or snap clip is usable.

According to the foregoing embodiment, the developing cartridge turns about the center of rotation in the rotary unit (by the pressure for abutting the developing roller to the drum during the development). The possible disengagement between the contact pin projected from the main assembly of the apparatus and the contact of the developing cartridge, the scraping of the outer wall of the developing cartridge and/or the conduction defect due to foreign matter therebetween can be prevented.

(Assembling Method of Developing Cartridge)

Referring to FIGS. 57 to 64, an assembling method of the developing cartridge according to this embodiment is as follows.

Figure 57:
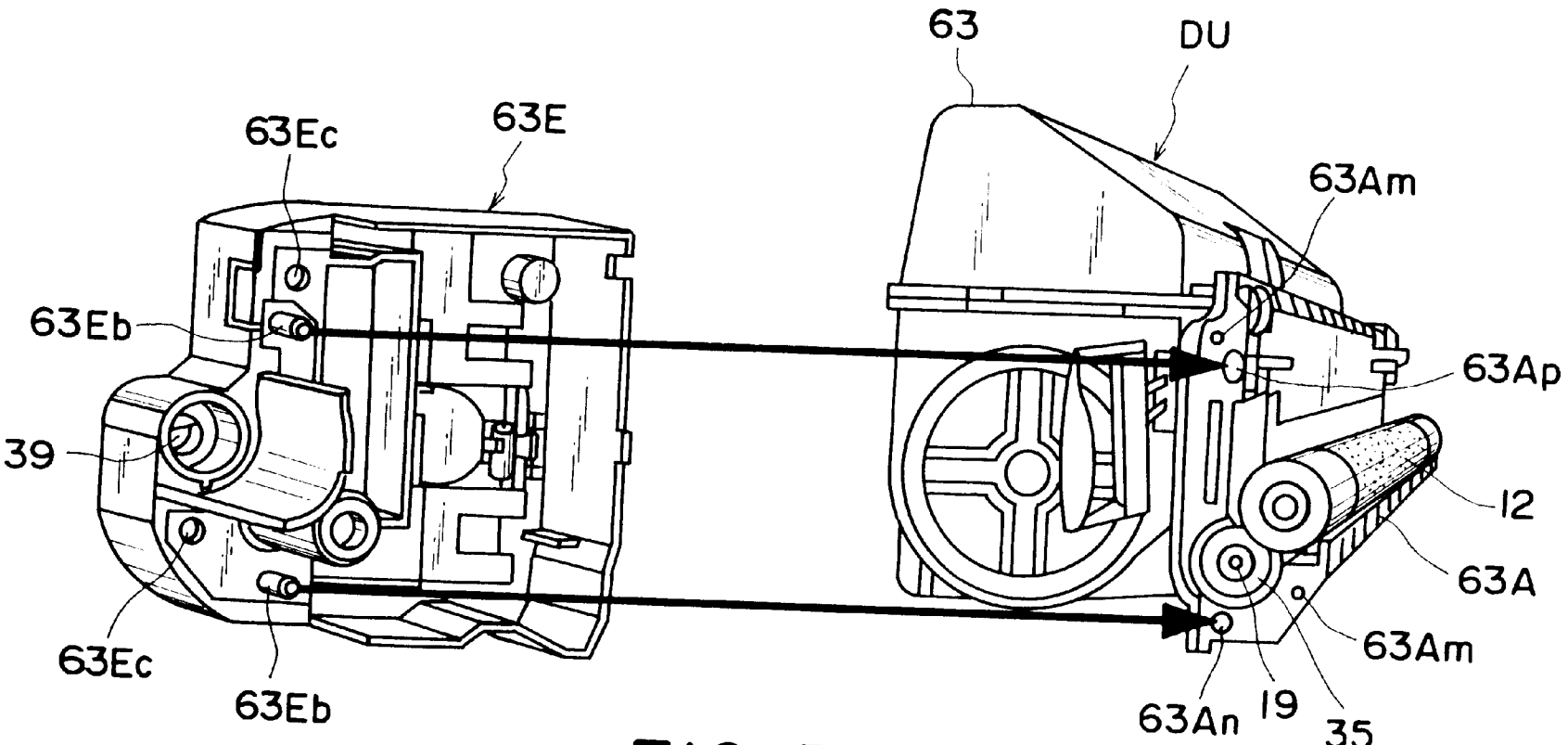
FIG. 57 is an illustration of mounting of a side cover to a non-driving side of a DT container unit.
Figure 58:
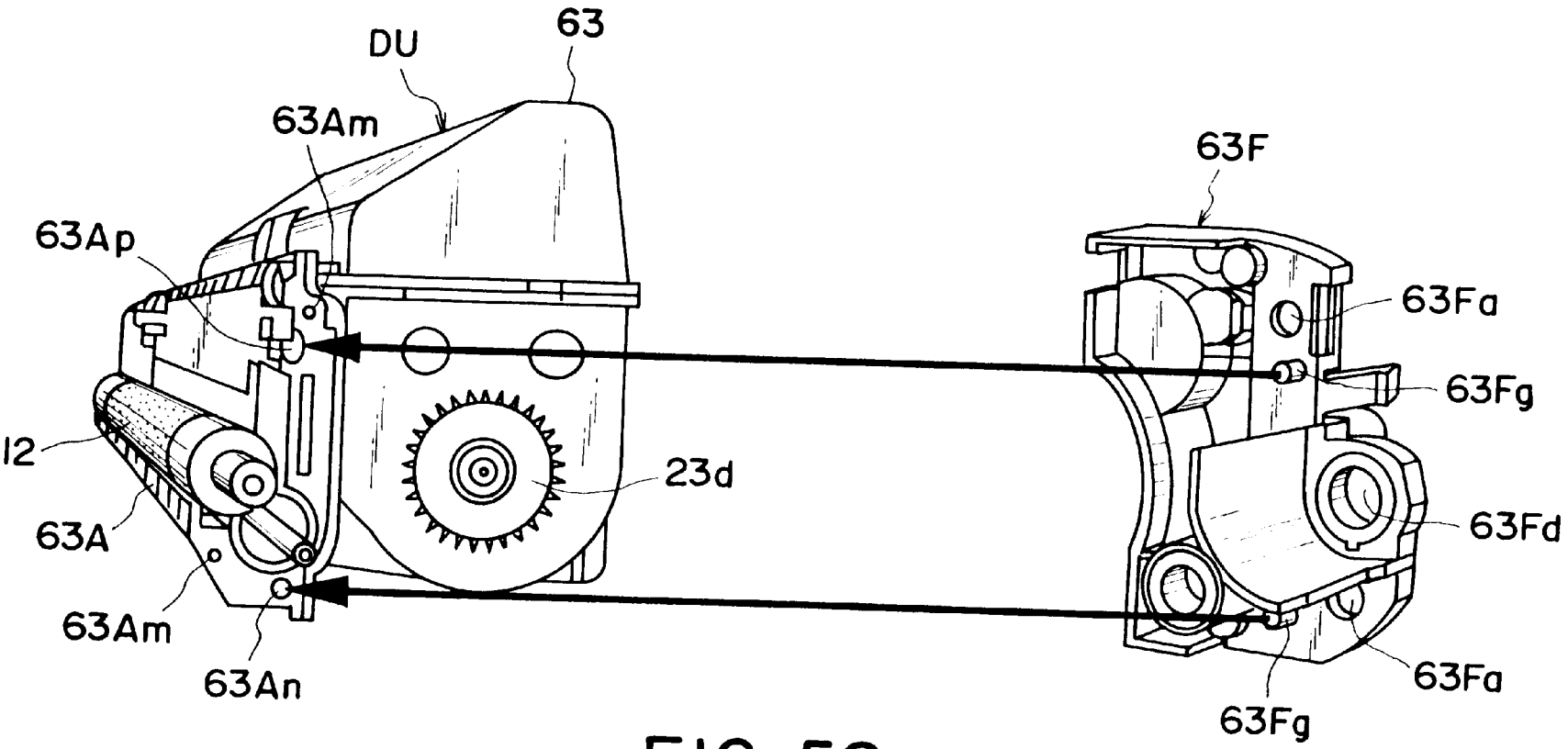
FIG. 58 is an illustration of mounting of a coupling frame to a DT container unit.
Figure 59:
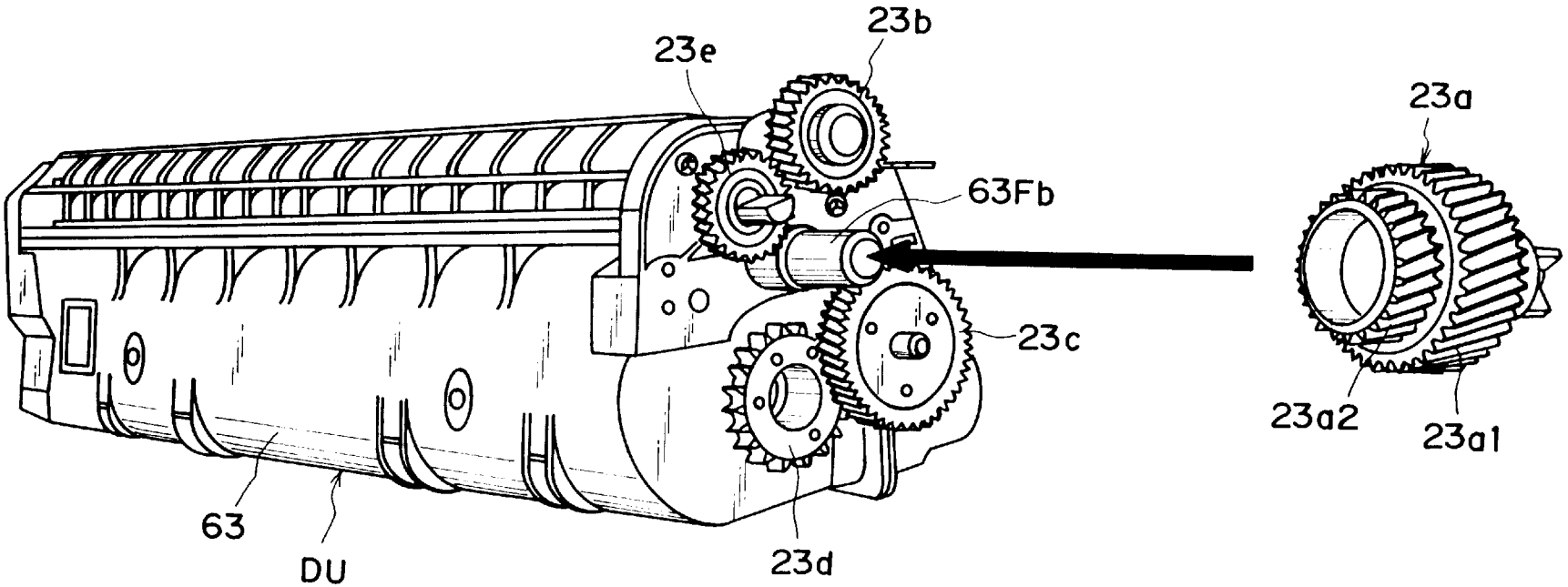
FIG. 59 is an illustration of mounting of gears to a DT container unit.
Figure 60:
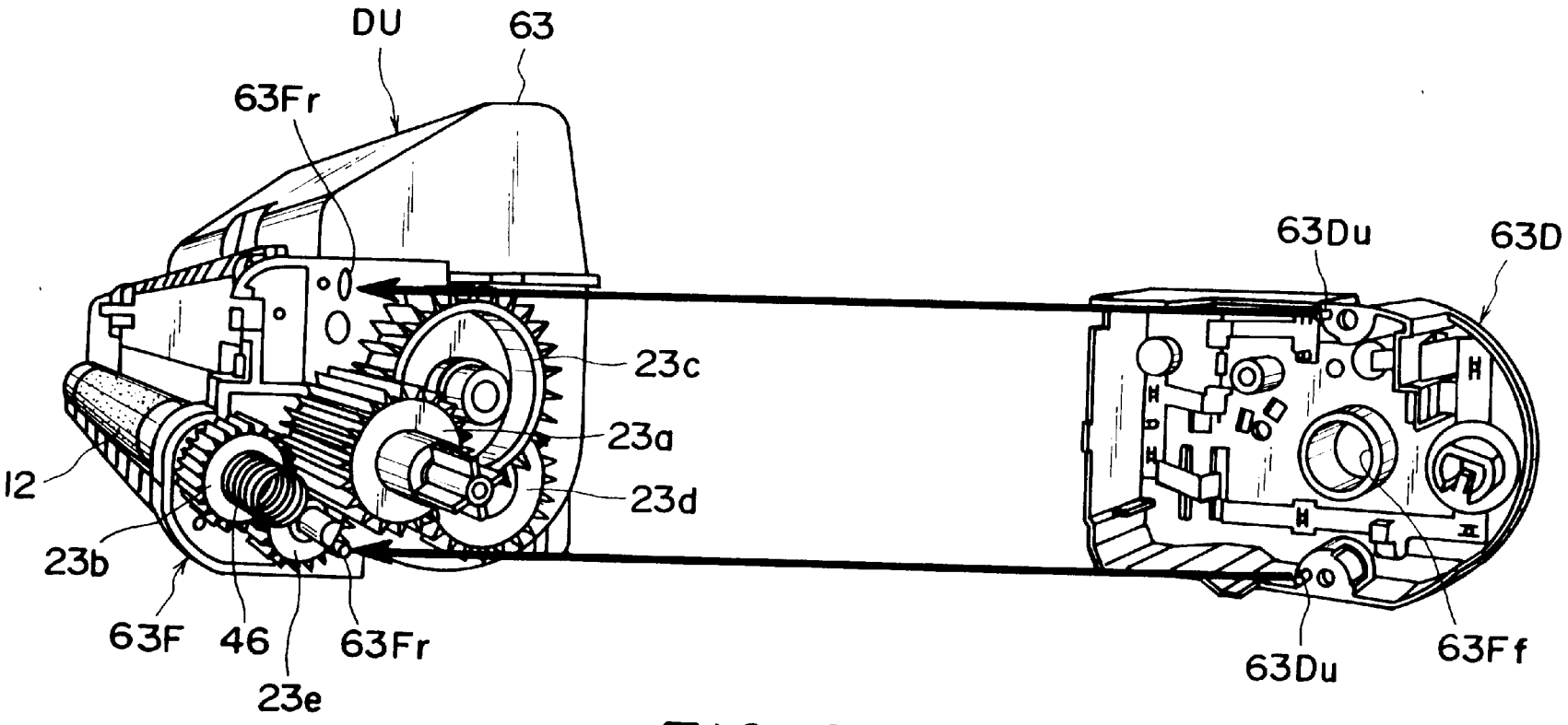
FIG. 60 is an illustration of mounting of a side cover to a driving side of a DT container unit.

(a) preparing a DT container unit DU having a toner frame 63 having a toner accommodating portion 63*a* accommodating the toner and a developing frame 63A connecting with the toner frame 63, as shown in FIG. 57;

(b) setting the toner application roller 19 to the developing frame 63A, wherein the toner application roller 19 is effective to apply the toner to the developing roller 12;

(c) setting a developing blade 16 (unshown) to the developing frame 12 after the steps of (c) and (b), wherein the developing blade 16 is effective to regulate the amount of the toner deposited on the developing roller 12;

(d) engaging the shaft 12*c* provided at one end of the developing roller 12 into a hole 39 of the first side cover 63E after the step (c); mounting the shaft provided at one end of the toner application roller 19 to the first side cover; inserting the dowel 63Eb of the first side cover 63E into the positioning holes 63Ap, 63Am of the container unit DU, so that first side cover 63E to the DT container unit DU;

(e) engaging the shaft 12*c* provided at the other end of the developing roller 12 to a hole 63Fd of the bearing unit (coupling frame) 63F, after the step (c), as shown in FIG. 58; mounting the shaft provided at the other end of the toner application roller 19 to the bearing unit; inserting the dowel 63Fg of the bearing unit 63F into the positioning holes 63Ap, 63An of the DT container unit DU, so that the bearing unit 63F is mounted to the DT container unit DU;

(f) after the step of (e), as shown in FIG. 59, mounting, to the bearing unit 63F, the developing roller gear 23*b*, the stepped idler gear 23*c*, the stirring gear 23*d*, the application roller gear 23*e* and the stepped driving gear 23*a*, after the step of (e), as shown in FIG. 59; and (g) inserting the dowel 63Du of the second side cover 63D into the hole 63Fr of the DT container unit DU, after the step of (f), as shown in FIG. 60, so that second side cover is mounted to the DT container unit DU.

The step (c) is carried out after the step (b), since if the blade 16 is set before the application roller 19, the free end of the blade 16 obstruct setting of the application roller 19. The end seal 32 preferably sandwiches the end of the blade 16 with the end of the developing roller 12 to prevent the toner leakage. Therefore, it is preferred that end seal 32 is mounted to the developing frame before step (c).

The shaft of the developing roller and the shaft of the application roller, are supported by a side cover at one end, rather than supporting them using bearing units at each end, and then covering them by side covers, so that structure is simple, and the assembling step is efficient. The toner seal mounting step for mounting the toner seal 27 between the toner frame 63B and the developing frame 63A of the DT container unit DU, is provided wherein the toner seal is effective to prevent the leakage of the toner from the toner accommodating portion 63*a*, and the toner seal 27 is to be removed by the user prior to start of use of the developing cartridge D.

The toner deposition step for depositing the toner onto the peripheral surface of the toner application roller 19 is carried out before the toner application roller 19 is mounted to the DT container unit DU.

The toner application roller 19 is mounted to the DT container unit DU by inserting the shaft 19*a* thereof at one end into the hole 63*q*1 provided in the DT container unit DU and engaging the shaft 19*a* at the other end with the hole 63Fd of the bearing unit 63F in the step of mounting of the bearing unit.

In the step of mounting the developing blade, the developing blade 16 is mounted to the DT container unit DU by screws 16*b*.

In the step of mounting of the first side cover, the first side cover 63E is mounted to the DT container unit by threading screws into the female screws 63Am of the DT container unit UD (FIG. 57).

In the step of mounting of the bearing unit, the bearing unit 63F is mounted to the DT container unit UD by threading screws into the female screws 63Fe of the DT container unit UD.

In the gear mounting step, the stepped driving gear 23*a*, the developing roller gear 23*b* are mounted by engagement of a holes in the gears 23*a*, 23*b* with the projected shafts 63Fc, 63*fc* (dowel provided to the bearing unit 63F).

The toner accommodating portion is supplied with toner through a toner supply port 63Bc formed adjacent one longitudinal end of the toner frame 63B, and after the toner is supplied, the toner supply port(toner supply opening) 63Bc is closed by a cap (toner cap) 37.

To the DT container unit UD, a charging roller 91 is mounted, and the charging roller 91 has a function of applying charge to the toner, wherein the charging roller 91 is mounted after the developing blade mounting step.

Figure 61:
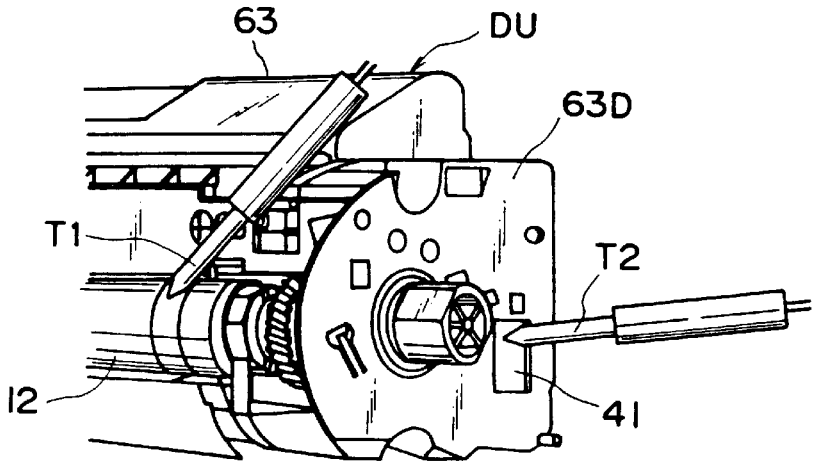
FIG. 61 is an illustration of conduction check of developing bias voltage supplied to the DT container unit.

The developing cartridge D assembled through the steps (a)–(g) is subjected to a conduction check of the sleeve. As shown in FIG. 61, a lead T1 end of a tester is contacted to a bare aluminum surface of the developing roller 12, and the other lead T2 end of the tester is contacted to the developing bias contact 41 of the second side cover 63D to check whether the read of the tester indicates a value lower than a predetermined resistance value.

Then, the conduction of the developing roller of the developing cartridge D is checked. As shown in FIG. 62, (*a*), one end of the lead T1 of the tester is contacted to the developing bias contact 41 of the second side cover 63D, and then as shown in Figure (b) of the Figure, the end of the other lead T2 is contacted to the rotation shaft 12*c* of the developing roller 12 to check the read is within a predetermined range.

After the conduction checks for the sleeve and the developing roller are completed, the round hole 64*a* of the shutter 64 is aligned with a driving shaft (projected portion) 63*c* projected out of the second side cover 63D. Then, the projected portion 63*g* as the shutter pin is snapped into the round hole 64*a* of the shutter 64 while the shutter 64 is nipped by the first side cover 63E.

By this, the assembling of the developing cartridge is completed.

(Exchanging Method of Developing Blade)

Referring to FIGS. 57 to 64, the description will be made as to exchanging method of the exchanging method, namely, reassembling of the developing cartridge after it is disassembled.

The method includes the following steps:

(a) a first side cover dismounting step of dismounting the first side cover 63E from the DT container unit DU having the toner frame 63B provided with the toner accommodating portion 63*a* for accommodating the toner and the developing frame 63A connected with the toner frame 63B, wherein the hole 39 of the first side cover 63E is disengaged from the shaft 12*c* at one end of the developing roller 12, and the shaft of the application roller 19 is disengaged from the first side cover 63E, by which the first side cover 63E is removed from the DT container unit DU (FIG. 57);

(b) removing the second side cover 63D from the DT container unit DU (FIG. 60);

(c) removing the developing roller gear 23*b*, the stepped idler gear 23*c*, the stirring gear 23*d*, the application roller gear 23*e*, the stepped driving gear 23*a* from the bearing unit (cartridge frame) 63F after the step (b) (FIG. 59);

(d) a bearing unit dismounting step of dismounting the bearing unit 63F from the DT container unit DU, wherein the bearing unit 63F the hole 63Fd of the bearing unit 63F is disengaged from the shaft 12*c* of the developing roller 12 at the other end, and the shaft of the application roller 19 is disengaged from the bearing unit 63F, by which the bearing unit 63F is removed from the DT container unit DU (FIG. 58), after the step (c);

(e) developing roller dismounting step of dismounting the developing roller 12 from the developing frame 63B after the step (e);

(f) a developing blade dismounting step of dismounting the developing blade 16 mounted to the developing frame 63B after the step (e), wherein the developing blade 16 is effective to regulate the amount of the toner deposition d on the peripheral surface of the developing roller;

(g) an application roller mounting step of dismounting the toner application roller 19 from the developing frame 63B after the step (f), wherein the toner application roller 19 is effective to apply the toner to the developing roller 12;

(h) an application roller setting step of setting the toner application roller 19 to the developing frame 63B after the step (g), wherein the toner application roller 19 is effective to apply the toner to the developing roller 12;

(i) a developing blade setting step of setting a new developing blade to the 63B after the step (h), wherein the developing blade functions to regulate the amount of the toner deposited on the peripheral surface of the developing roller;

(j) a first side cover mounting step of mounting the first side cover 63E to the DT container unit DU by engaging the shaft 12*c* of the developing roller 12 with a hole 39 of the first side cover 63E at one end of the roller (FIG. 57);

(k) a bearing unit mounting step of mounting the bearing unit 63F to the DT container unit DU by engaging the shaft 12*c* of the developing roller 12 with the hole 63Fd of the bearing unit 63F at the other end (FIG. 58) after the step(i); a gear mounting step of mounting the developing roller gear 23*b*, the stepped idler gear 23*c*, the stirring gear 23*d*, the application roller gear 23*e* and the stepped driving gear 23*a* to the bearing unit 63F after the steps of (l) and (k) (FIG. 59); and (m) a second side cover mounting step of mounting the second side cover 63D to the DT container unit DU so as to cover the developing roller gear, the stepped idler gear 23*c*, the stirring gear 23*d*, the application roller gear 23*e*, and the stepped driving gear 23*a* after the step(1) (FIG. 60).

The shaft of the developing roller and the shaft of the application roller, are supported by a side cover at one end, rather than supporting them using bearing units at each end, and then covering them by side covers, so that structure is simple, and the assembling step is efficient. Therefore, the exchange of the developing blade operation is easy.

There is provided a toner seal mounting step of mounting a toner seal 27 between the toner frame 63B of the DT container unit DU and the developing frame 63A, wherein the toner seal functions to prevent the leakage of the toner from the toner accommodating portion 63*a*, and the toner seal 27 is removed by the user before the star of use of the developing cartridge D.

There is further provided a toner deposition step of depositing the toner on the peripheral surface of the toner application roller 19 prior to mounting thereof to the DT container unit DU.

The toner application roller 19 is mounted to the DT container unit DU by inserting the shaft 19*a* of the toner application roller 19 into the hole 63*q*1 of the DT container unit DU at one end of the application roller 19 and by engaging the shaft 19*a* with the hole 63Fd of the bearing unit 63F in the bearing unit mounting step.

In the developing blade mounting step, the developing blade 16 is mounted to the DT container unit DU by screws 16*b*.

In the first side cover mounting, the first side cover 63E is mounted to the DT container unit by threading the screws into the female screws 63Am of the DT container unit UD.

In the bearing unit mounting step, the bearing unit 63F is mounted to the DT container unit UD by threading screws into the female screw 63Fe of the DT container unit UD.

In the gear mounting step, the stepped driving gear 23*a* and the developing roller gear 23*b* are mounted by engaging the holes of the gears 23*a* and 23*b* with the projected shafts 63Fc, 63*fc* (dowel provided on the bearing unit 63F).

In the exchanging method of the developing blade, the toner is supplied into the toner accommodating portion 63*a* through the toner supply port 63Bc formed at one longitudinal end of the toner frame 63B, and then after the toner is supplied, the toner supply port (toner supply opening) 63Bc is closed by a cap (toner cap) 37.

In the exchanging method of the developing blade, the DT container unit UD is provided with the charging roller 91 mounted thereto, and the charging roller 91 functions to apply electric charge to the toner, wherein the charging roller 91 is mounted after the developing blade mounting step.

In the exchanging method of the developing blade, the toner is refilled into the toner accommodating portion.

In the exchanging method of the developing blade, the developing roller 12 is reused.

In the exchanging method of the developing blade, the toner application roller is reused.

While the invention has been described with reference to the structures disclosed herein, it is not confined to the details set forth and this application is intended to cover such modifications or changes as may come within the purposes of the improvements or the scope of the following claims.

What is claimed is:

1. An assembling method of a cartridge detachably mountable to a main assembly of an image forming apparatus and having a developing device, said method comprising the steps of:

preparing a container unit provided with a developing frame;

mounting a toner-supplying roller to the developing frame, wherein the toner-supply roller is effective to supply the toner to a developing roller, and the developing roller is effective to carry the toner to a developing position;

mounting a toner-layer-thickness-regulating member to the developing frame, wherein the toner-layer-thickness-regulating member is effective to regulate the thickness of a layer of the toner applied on a developing roller;

supporting a first shaft portion of the developing roller at one longitudinal end thereof and a first shaft portion of the toner-supplying roller at the one longitudinal end of the developing roller by a side cover, and mounting the side cover to the container unit, after the step of mounting the toner-supplying roller and after the step of mounting the toner-layer-thickness-regulating member; and supporting a second shaft portion of the developing roller at the other longitudinal end thereof and a second shaft portion of the toner-supplying roller at the other longitudinal end of the developing roller by a bearing unit, and mounting the bearing unit to the container unit, after the step of mounting the toner-supplying roller and after the step of mounting the toner-layer-thickness-regulating member.

2. A method according to claim 1, further comprising the step of mounting a gear for transmitting a driving force to the developing roller to the second shaft portion of the developing roller on the bearing unit after the step of mounting the bearing unit.

3. A method according to claim 2, further comprising the step of mounting a second side cover to the container unit so as to cover the gear after the step of mounting the gear.

4. A method according to claim 1, wherein before the step of mounting the toner supplying roller, the container unit is constituted by the developing frame, the toner frame for accommodating the toner and connected with the developing frame.

5. A method according to claim 1, wherein the step of mounting the toner layer thickness regulating member to the developing frame is carried out after the step of mounting the toner supplying roller.

6. A method according to claim 4, further comprising a step of mounting, to the container unit, an unsealable seal member covering an opening for permitting supply of the toner into the developing frame from the tuner frame.

7. A method according to claim 1, further comprising a step of depositing the toner on a peripheral surface of the toner supplying roller prior to the step of mounting the toner supplying roller.

8. A method according to claim 4, further comprising steps of supplying the toner through a toner supply port of the toner frame extended in a longitudinal direction thereof and closing the toner supply port after the step of the toner supply.

9. A method according to claim 1, further comprising a step of mounting, to the container unit, a charging member for applying electric charge to the toner carried on the developing roller so as to be in contact with the developing roller at a longitudinal end, after the step of mounting the toner layer thickness regulating member.

10. A method according to claim 1, wherein said cartridge is a developing cartridge for effecting a developing operation to an image bearing member provided in the main assembly of the image forming apparatus.

11. A disassembling method of a cartridge having a developing device, said cartridge being detachably mountable to a main assembly of an image forming apparatus, said method comprising the steps of:

removing a side cover from a container unit, which comprises a toner frame for accommodating toner and a developing frame connected to the toner frame;

said step including removing, from the side cover, a first shaft portion of a developing roller supported by the side cover at one longitudinal end thereof and a first shaft portion of a toner-supplying roller at the one longitudinal end of said developing roller, wherein the developing roller is effective to carry the toner to a developing position, and the toner-supplying roller is effective to supply the toner to the developing roller;

removing a bearing unit from the container unit, said bearing-unit removing step including the step of removing, from the bearing unit, a second shaft portion of the developing roller supported by the bearing unit at the other longitudinal end of said developing roller and a second shaft portion of the toner-supplying roller at the other longitudinal end of said developing roller;

removing the developing roller from the developing frame after the step of removing the side cover and after the step of removing the bearing unit; and removing a toner-layer-thickness-regulating member from the developing frame after the step of removing the developing roller, wherein the toner-layer-thickness-regulating member is effective to regulate a thickness of a layer of the toner carried on the developing roller.

12. A method according to claim 11, further comprising a step of removing a gear for transmitting a driving force to the developing roller, mounted to the second shaft portion of the developing roller on the bearing unit, prior to the step of removing the bearing unit.

13. A method according to claim 12, further comprising a step of a second side cover mounted to the container unit to cover the gear, prior to the step of removing the gear.

14. A method according to claim 11, further comprising the step of removing the toner supply roller from the developing frame after the step of removing the developing roller.

15. A method according to claim 14, wherein the toner supplying roller is removed from said developing frame after the toner regulating member is removed from the developing frame.

16. A method according to claim 11, wherein said cartridge is a developing cartridge for effecting a developing operation to an image bearing member provided in the main assembly of the image forming apparatus.

* * * * *

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

ON THE TITLE PAGE [57] ABSTRACT:

Line 3, "device, the method including" should read --device includes--; and
Line 7, "to the" should read --to a--.

COLUMN 1:

Line, 24, "and" should read --an--.

COLUMN 2:

Line 1, "illustrations" should read --an illustration--;
Line 38, "17, (a)," should read --17(a)--;
Line 40, "(b)" should read --FIG. 17(b)--;
Line 42, "18, (a)," should read --18(a)--; and
Line 44, "(b)" should read --FIG. 18(b)--.

Figure 54A:
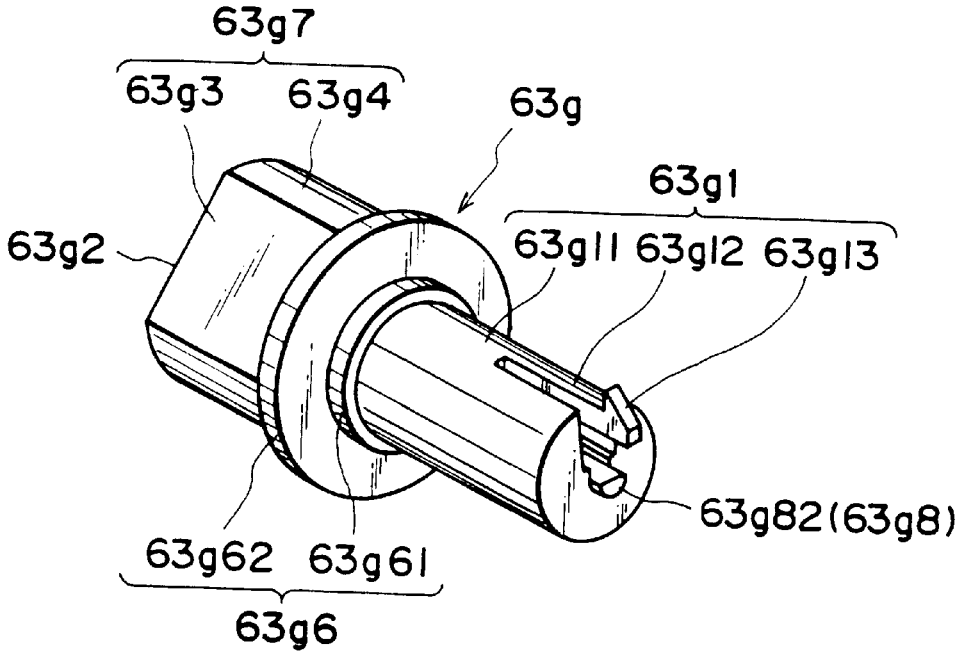
FIG. 54 is a perspective view of a shutter pin.
Figure 54B:
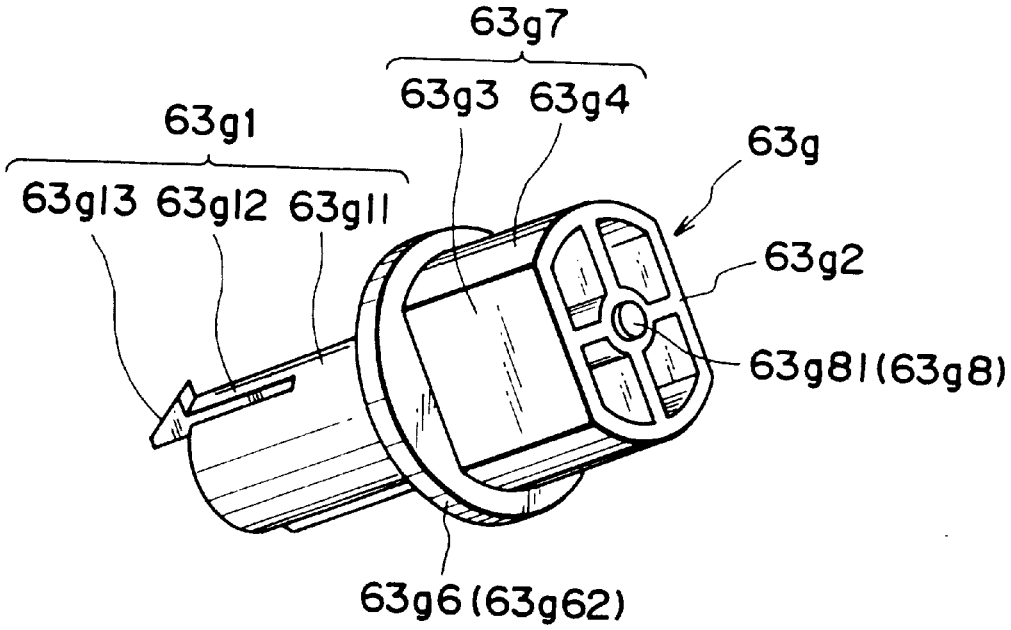

COLUMN 3:

Line 27, "end of" should read --end of a--;
Line 44, "FIG. 50 ((a), (b), (c), (d))" should read --FIGS. 50(a) - 50(d)"-- and "is" should read --are--;
Line 45, "developing cartridge" should read --developing-cartridge--;
Line 50, "FIG. 54 is a perspective view" should read --FIGS. 54(a) and 54(b) are perspective views--; and
Line 54, "in" should read --is--.

Figure 62A:
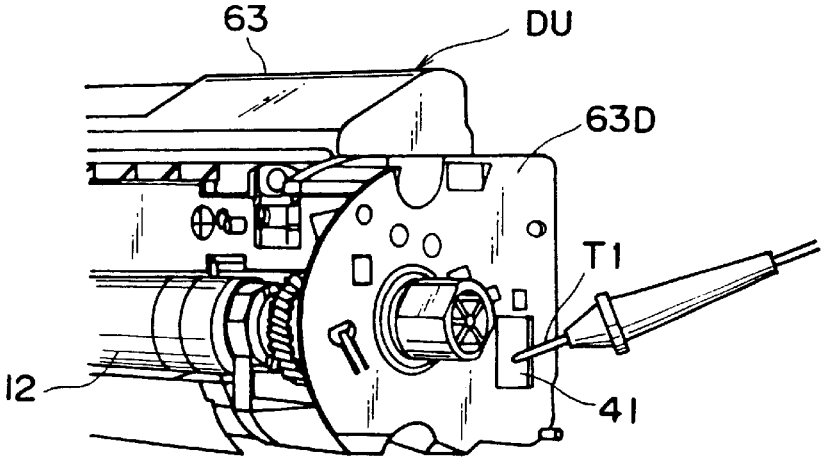
FIG. 62 is an illustration of conduction check of developing bias to a developing roller in a DT container unit.
Figure 62B:
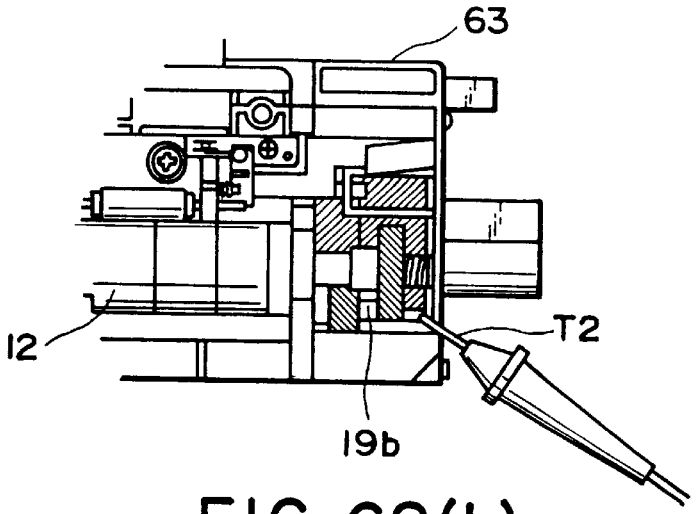
Figure 63:
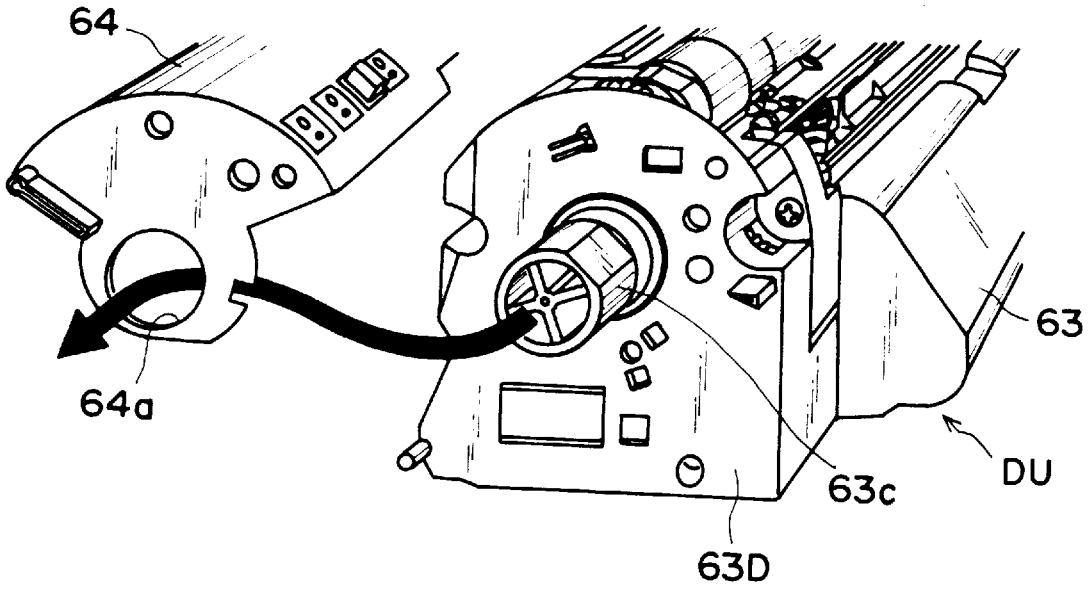
FIG. 63 is an illustration of mounting of a shutter to a driving force receiving member of a DT container unit.
Figure 64:
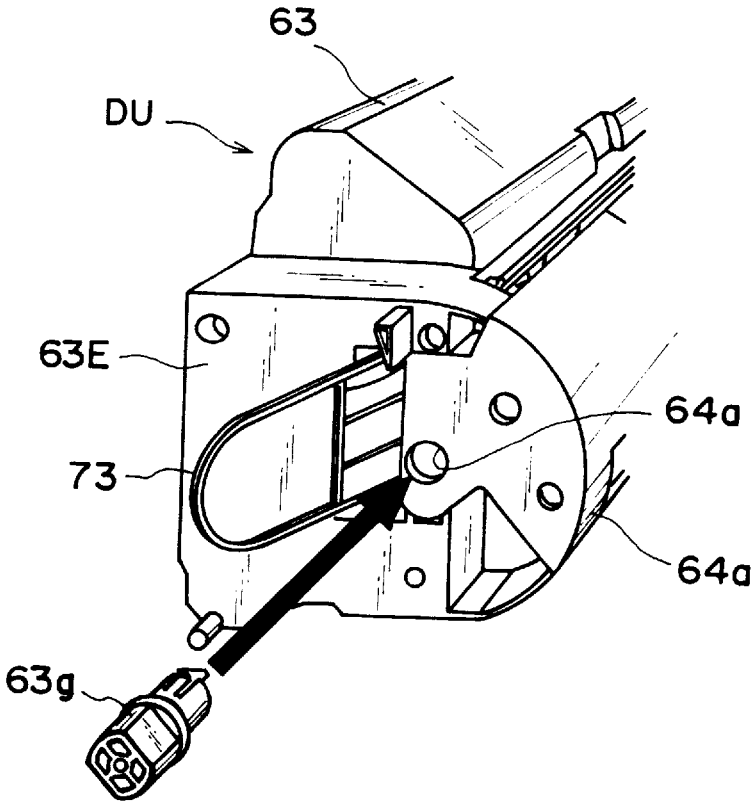
FIG. 64 is an illustration of mounting of a shutter to a DT container unit using a shutter pin.

COLUMN 4:

Line 1, "FIG. 62 is an illustration" should read --FIGS. 62(a) and 62(b) are illustrations-- and "conduction" should read --a conduction--;
Line 4, "driving force" should read --driving-force--;
Line 20, "FIGS." should read --FIG.--;
Line 23, "FIGS." should read --FIG.--;
Line 24, "12," should read --12--;
Line 24, "in" should be deleted; and
Line 31, "The description will be made as to a" should read --A description will be provided as to the--;
Line 48, "The description will be made" should read --A description will be provided--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 8:

Line 24, “12 is” should read --12--.

COLUMN 9:

Line 30, “abutts” should read --abuts to--; and
Line 63, “is positioning” should read --is positioned--.

COLUMN 12:

Line 7, “hen” should be deleted;
Line 24, “D, ; are” should read --D,--;
Line 61, “17, (a), (b), and FIGS. 18, (a)” should read --17(a) and 17(b), and FIGS. 18(a)--;
Line 62, “and (b).” should read --18(b).--;
Line 64, “17(a),” should read --17(a) and--;
Line 65, “18, (a),” should read --18(a) and--; and
Line 67, “are” should read --is--.

COLUMN 13:

Line 5, “63h” should read --63b--;
Line 41, “omitted)” should read --omitted).--;
Line 53, “locking; engaging” should read --locking-engaging--; and
Line 57, “contactsa” should read --contacts a--.

Figure 17B:
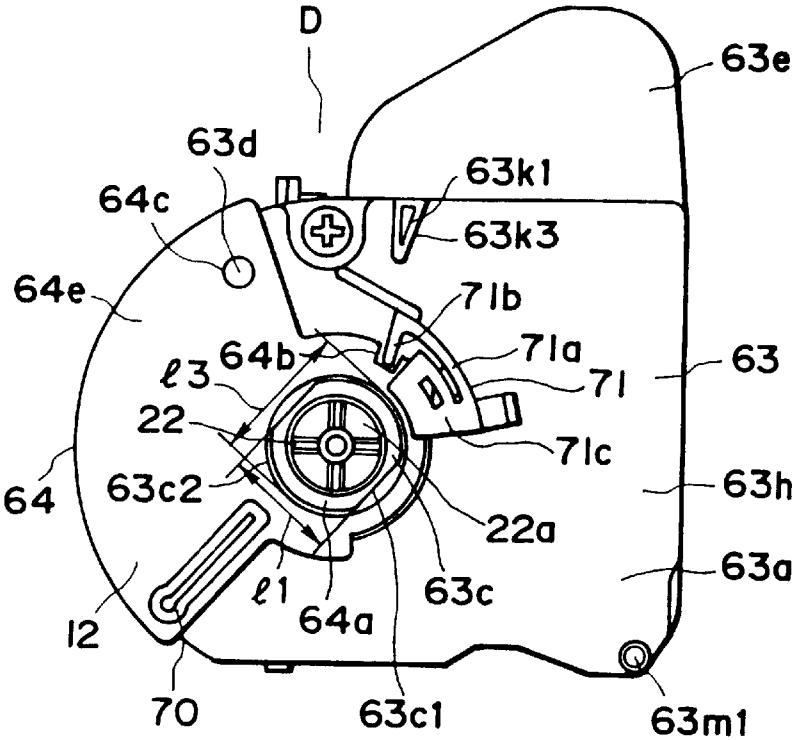
FIG. 17, (*a*), is a side view of the other end of the developing cartridge shown in FIG. 15 (shutter is closed), and (*b*) is a side view of one end of a developing cartridge shown in FIG. 15 (shutter is closed).
Figure 17A:
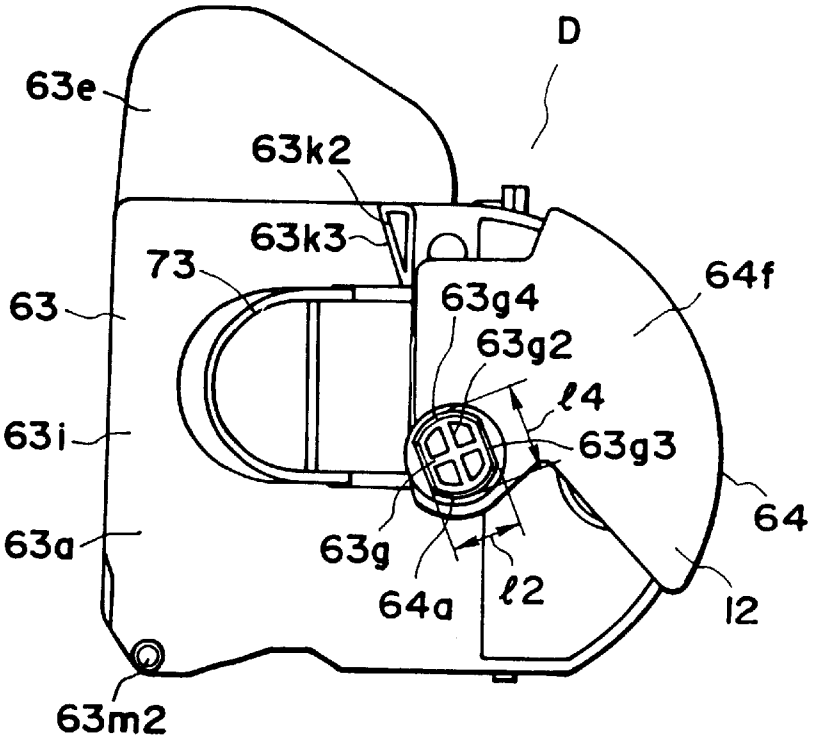
Figure 18B:
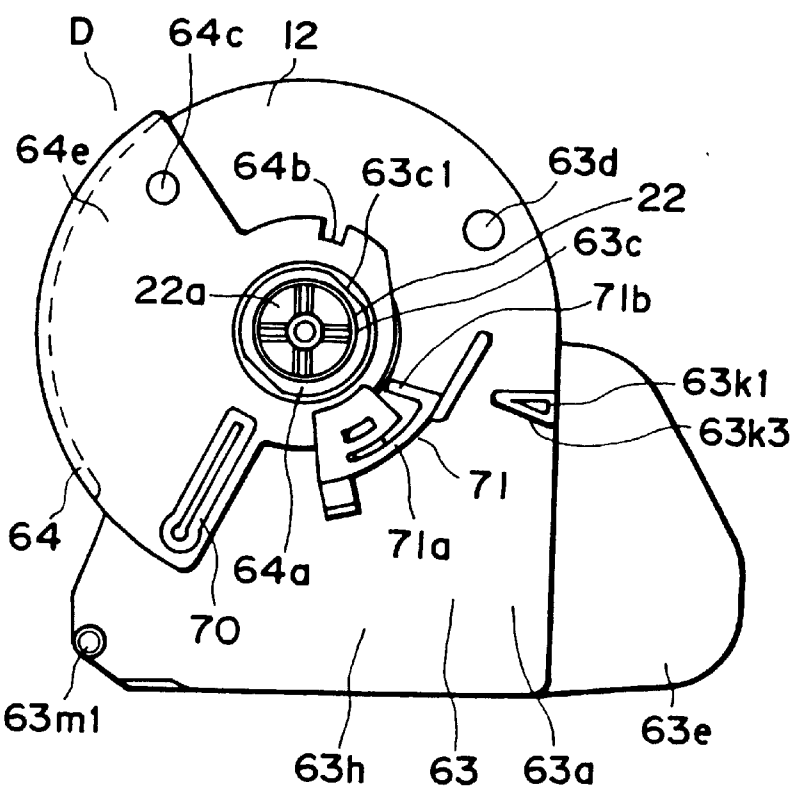
FIG. 18, (*a*), is a side view of the other end of the developing cartridge shown in FIG. 15 (shutter is open), and (*b*) is a side view of one end of a developing cartridge shown in FIG. 15 (shutter is open).
Figure 18A:
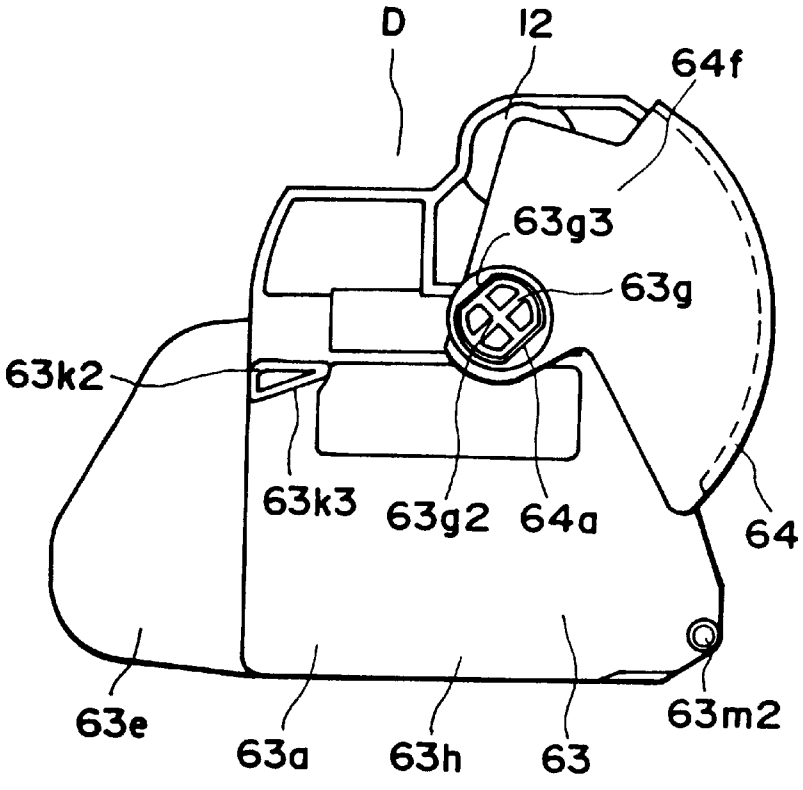

COLUMN 14:

Line 8, “17, (a),” should read --17(a),--; and
Line 23, “FIG. 17,” should read --FIGS. 17(a) and 17(b),--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 15:

Line 1, “59a,” should read --59a--;
Line 2, “FIG. 22” should read --FIG. 22.--;
Line 14, “26d” should read --26d.--;
Line 46, “63m,;” should read --63 ml--;
Line 47, “63h, i” should read --63h and 63i--;
Line 53, “63k,;” should read --63kl--; and
Line 54, “are” should read --is--.

COLUMN 16:

Line 12, “a” should read --the--;
Line 25, “matter,;” should read --matter,--;
Line 27, “from” should read --from being--;
Line 29, “of” should read --of the--.

COLUMN 17:

Line 10, “shaft 10” should read --shaft 10.--;
Line 14, “63h, i” should read --63h and 63i--;
Line 18, “63h, i” should read --63h and 63i--;
Line 35, “of made” should read --made of--;
Line 39, “apparatus,” should read --apparatus, and the charging member (91) when the developing cartridge is mounted to the main assembly of the apparatus, wherein the--;
Line 40, “is” should be deleted;
Line 42, “driving; force” should read --driving-force--;
Line 43, “driving” should read --a driving--;
Line 44, “and” should be deleted; and “said” should read --the--;
Line 45, “30, the” should read --30, and--;
Line 48, “made of said” should read --of the--;
Line 50, “material,;” should read --material,--;
Line 53, “said” should read --the--;
Line 54, “said” should read --the--;
Line 55, “said” should read --the--;
Line 56, “said” should read --the--;
Line 57, “said” should read --the--;
Line 58, “said” should read --the--; and “64e” should read --64e,--;

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 17: (*Continued*)

Line 59, "said" should read --the--;
Line 60, "said" should read --the--; and "said" should read --the--;
Line 61, "said" should read --the--; and
Line 62, "of" should read --made of--.

COLUMN 18:

Line 8, "is" should be deleted;
Line 9, "contacted to" should read --contacts--;
Line 11, "locking engaging" should read --locking-engaging--; and "shutter " should read --shutter- --;
Line 16, "that" should read --that the--;
Line 17, "locking" should read --locking- --;
Line 18, "shutter engaging" should read --shutter-engaging--;

COLUMN 19:

Line 20, "said" should read --and the--;
Line 21, "provided on said rotatable member. said guide 70 is" should be deleted;
Line 46, "(FIG. 17, (b))" should read --(FIG. 17(b))--;
Line 48, "(FIG. 17," should read --(FIG. 17(a))--;
Line 49, "(a))" should be deleted;
Line 51, "A" should read --The--;
Line 53, "a" should read --the--;
Line 57, "17, (b))" should read --17(b))--;
Line 59, "a" should read --the--; and
Line 60, "17, (a))" should read --17(a))--.

COLUMN 20:

Line 18, "said" should read --the--;
Line 29, "said" should read --the--;
Line 47, "mounted" should read --mount--;
Line 51, "device," should read --device, a--; and
Line 56, "of" should read --on--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 21:

Line 12, “devel-” should read --the develo- --;
Line 27, “cart ridge” should read --cartridge--;
Line 28, “30 It” should read --30. It--;
Line 32, “urging” should read --an urging--; and
Line 40, “urging” should read --an urging--.

COLUMN 22:

Line 11, “its” should read --their--;
Line 12, “are contacted to said” should read --contact the--; and
Line 16, “cartridge” should read --the cartridge--.

COLUMN 23:

Line 13, “that” should read --that the--;
Line 19, “assembly,” should read --assembly--;
Line 20, “that” should read --that a--; and
Line 49, “the description will be made” should read --a description will be provided--.

COLUMN 24:

Line 54, “6386” should read --63g6--; and
Line 55, “to” should read --in relation to--.

COLUMN 25:

Line 7, “a diameter” should read --a larger diameter--;
Line 49, “The description will be made” should read --A description will be provided--; and
Line 67, “ends” should read --end--.

COLUMN 26:

Line 11, “A1.” should read --A1).--;
Line 33, “is electronically contacted” should read --contacts--; and
Line 34, “with” should be deleted.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 27:

Line 35, “FIGS. 32 and 32,” should read --FIGS. 31 and 32--.

COLUMN 28:

Line 5, “the description will be” should read --a description will be provided--;
Line 6, “made” should be deleted;
Line 14, “portion” should read --portions--;
Line 23, “11b1” should read --11b--;
Line 25, “11b1” should read --11b--;
Line 30, “64 (64m, 64c, 64y, 64b)” should read --64 (64M, 64C, 64Y, 64B)--;
Line 33, “indicate” should read --indicates--;
Line 47, “faced to” should read --facing--; and
Line 48, “driving force” should read --driving-force--.

COLUMN 29:

Line 9, “cartridge mounting” should read --cartridge-mounting--;
Line 12, “cartridge mounting” should read --cartridge-mounting--;
Line 26, “at a” should read --at--;
Line 34, “this” should read --this,--;
Line 49, “constitutes” should read --constitute--;
Line 51, “driving force” should read --driving force--; and
Line 58, “are contacted to” should read --contact--.

COLUMN 30:

Line 42, “12.” should read --12 is provided.--; and
Line 45, “when” should read --and when--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 31:

Line 7, “with the parallel” should be deleted;
Line 25, “63Ej” should read --63Ej,--;
Line 27, “seal 27” should read --seal 27,--;
Line 30, “thus,” should read --Thus,--;
Line 34, “in” should read --in an--;
Line 36, “torn or on” should read --being torn or in--;
Line 47, “wherein” should read --(wherein--;
Line 49, “12,” should read --12),--;
Line 50, “said” should read --(the--;
Line 51, “unseals” should read --unsealing--;
Line 52, “prior” should read --prior to--;
Line 54, “12,” should read --12),--;
Line 56, “Developing” should read --developing--;
Line 60, “developing cartridge” should read --developing-cartridge--;
Line 65, “developing cartridge” should read --developing-cartridge--; and
Line 66, “urging force” should read --urging-force--; and “Spring” should read --spring--.

COLUMN 32:

Line 1, “Compression” should read --compression--;
Line 5, “Boss” should read --boss--;
Line 7, “developing cartridge” should read --developing cartridge--;
Line 8, “Hole” should read --hole--;
Line 9, “Projected” should read --projected--;
Line 12, “developing cartridge” should read --developing-cartridge--;
Line 14, “griping” should read --gripping--;
Line 15, “Grip” should read --grip--;
Line 18, “developing cartridge” should read --developing-cartridge--;
Line 20, “toner filling” should read --toner-filling--; and “opening” should read --openings--;
Line 21, “A” should read --a-- and “((FIG.” should read --(Fig.--;

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 32: (*Continued*)

Line 24, "developing cartridge" should read --developing-cartridge--;
Line 25, "age generating" should read --age-generating--;
Line 28, "voltage generating" should read --voltage-generating--;
Lines 29-30, "inside the 100 of the voltage generating circuit" should be deleted;
Line 31, "bias supply" (both occurrences) should read --bias-supply--;
Line 32, "bias supply" should read --bias-supply--;
Line 35, "ground connecting" should read --ground-connecting-- and "grounding" should read --grounding- --;
Line 37, "grounding" should read --grounding- --;
Line 39, "voltage generating" should read --voltage-generating--;
Line 43, "grounding" should read --grounding- --;
Line 44, "the ground" should read --the ground- --;
Line 45, "bias" should read --bias- --;
Line 54, "voltage generating" should read --voltage-generating--;
Line 55, "voltage generating" should read --voltage-generating--;
Line 59, "electrical" should read --electrical- --;
Line 60, "ground connecting" should read --ground-connecting--;
Line 64, "bias supply" should read --bias-supply--; and
Line 65, "voltage generation" should read --voltage-generation--.

COLUMN 33:

Line 1, "voltage generating" should read --voltage-generating--;
Line 4, "bias supply" should read --bias-supply--;
Line 5, "voltage" should read --voltage- --;
Line 7, "voltage" should read --voltage- --;

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 33: (*Continued*)

Line 10, "voltage generation" should read --voltage-generation--;
Line 11, "grounding contact" should read --grounding-contact--;
Line 15, "high voltage" should read --high-voltage--;
Line 18, "downsized" should read --downsized.--; and "voltage generating" should read --voltage-generating--;
Line 27, "bias supply" should read --bias-supply--;
Line 28, "ground connecting" should read --ground-connecting--;
Line 29, "are" should read --is--;
Line 33, "voltage generating" should read --voltage-generating--;
Line 34, "rotary member" should read --rotary-member--;
Line 35, "developing bias" should read --developing-bias--;
Line 37, "developing bias" should read --developing-bias--;
Line 39, "developing bias" should read --developing-bias--;
Line 44, "The description will be made" should read --A description will be provided--;
Line 51, "ground connecting" should read --ground-connecting--; and "he" should read --the--; and "voltage" should read --voltage- --;
Line 61, "side ground" should read --side-ground--;
Line 62, "voltage generating" should read --voltage-generating--;
Line 64, "voltage gener-" should read --voltage-gener- --; and
Line 67, "for" should read --is provided for--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 34:

Line 1, “cartridge” should read --cartridge,--;
Line 2, “apparatus, said” should read --apparatus. The--;
Line 3, “including:” should read --includes:--; and “frame,” should read --frame;--;
Line 19, “constitute” should read --constitutes--;
Line 20, “frame;” should read --frame.--;
Line 22, “(105)” should read --(105),--;
Line 33, “apparatus, including:” should read --apparatus. The method includes:--;
Line 34, “developing frame” should read --developing-frame--;
Line 39, “toner frame” should read --toner-frame--;
Line 40, “Including” should read --including--;
Line 46, “developing cartridge side cover” should read --developing-cartridge-side-cover--;
Line 47, “developing cartridge” should read --developing-cartridge--;
Line 48, “shaft support” should read --shaft-support--; and “Developing” should read --developing--;
Line 50, “toner seal” should read --toner-seal--;
Line 51, “to” should read --to the--;
Line 55, “side cover” should read --side-cover--; and
Line 56, “oping cartridge side cover” should read --oping-cartridge-side cover--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 35:

Line 22, “driving force” should read --driving-force--;
Line 23, “driving force” should read --driving-force--;
Line 28, “driving force” should read --driving-force--;
Line 30, “developing bias” should read --developing-bias--;
Line 33, “driving force” should read --driving-force--;
Line 35, “developing bias” should read --developing-bias--;
Line 38, “developing bias” should read --developing-bias--;
Line 41, “driving” should read --driving- --;
Line 47, “main” should read --main- --;
Line 48, “assembly developing bias” should read --assembly-developing-bias--;
Line 50, “developing bias” should read --developing-bias--;
Line 53, “developing bias” should read --developing-bias--;
Line 55, “developing bias” should read --developing-bias--;
Line 56, “is contacted to” should read --contacts--;
Line 57, “developing bias” should read --developing-bias--;
Line 60, “define” should read --defines--;
Line 61, “to” should be deleted;
Line 62, “define” should read --defines--;
Line 65, “is” should read --are--; and
Line 66, “positioning,” should read --positioning, and thus--.

COLUMN 36:

Line 5, “driving force” should read --driving-force--;
Line 8, “developing bias” should read --developing-bias--;
Line 9, “developing” should read --developing- --;
Line 11, “developing bias” (both occurrences) should read --developing bias--;

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 36: (*Continued*)

Line 12, "rotational" should read --rotational- --;
Line 13, "developing process" should read --developing-process--;
Line 14, "electric conduction" should read --electric-conduction--;
Line 16, "developing bias" should read --developing-bias--; and "is not contacted" should read --does not contact--;
Line 17, "to" should be deleted;
Line 21, "developing bias" should read --developing-bias--;
Line 22, "developing bias" should read --developing-bias--;
Line 27, "rectangular" should read --rectangle--;
Line 28, "is contacted to the developing bias" should read --contacts the developing-bias--;
Line 30, "driving force" should read --driving-force--; and "developing" should read --developing- --;
Line 35, "driving force" should read --driving-force--;
Line 38, "driving force" should read --driving-force--;
Line 40, "a" should read --and a--;
Line 41, "developing bias" should read --developing-bias--;
Line 45, "developing bias" should read --developing-bias--;
Line 51, "driving" should read --driving- --;
Line 54, "developing bias" should read --developing-bias--;
Line 56, "developing bias" should read --developing-bias--;
Line 58, "developing bias" should read --developing-bias--;
Line 59, "developing bias" should read --developing-bias--; and
Line 61, "developing bias" should read --developing-bias--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 37:

Line 1, “developing bias” should read --developing-bias--;
Line 2, “that” should read --that a--;
Line 5, “driving force” should read --driving-force--;
Line 24, “contacted to” should read --contacting--;
Line 30, “developing bias” should read --developing-bias--;
Line 42, “driving force” should read --driving-force--; and “developing bias” should read --developing-bias--;
Line 45, “urging force” should read --urging-force--;
Line 47, “compression coil” should read --compression-coil--;
Line 52, “to” should be deleted;
Line 54, “urging force” should read --urging-force--;
Line 55, “developing bias” should read --developing-bias--; and “driving” should read --driving- --;
Line 58, “urging force” should read --urging-force--; and
Line 62, “s of” should read --of--.

COLUMN 38:

Line 2, “spring holding” should read --spring-holding--;
Line 4, “spring holding” should read --spring-holding--;
Line 6, “application roller” should read --application-roller--; and “contacted to” should read --contacting--;
Line 12, “blade supporting” should read --blade-supporting--;
Line 14, “developing member” should read --developing-member--;
Line 16, “developing member” should read --developing-member--;
Line 20, “developing blade” should read --developing-blade--;
Line 21, “developing bias” should read --developing-bias--;

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 38: (*Continued*)

Line 22, "developing blade" should read --developing-blade--;
Line 24, "44 is abutted to" should read --44, and the free end 44a of the plate 44 abuts--;
Line 25, "ing blade" should read --ing-blade--;
Line 26, "developing blade" should read --developing-blade--; and "a" should read --as a-- ; and "leaf" should read --leaf- --;
Line 27, "leaf spring" should read --leaf-spring--;
Line 29, "charging roller" should read --charging-roller--;
Line 32, "developing bias" should read --developing-bias--;
Line 33, "application roller" should read --application-roller--; and "the develop-" should read --and the develop- --;
Line 34, "ing blade" should read --ing-blade--;
Line 35, "developing bias" should read --developing-bias--;
Line 38, "developing bias" should read --developing-bias--;
Line 40, "charging roller" should read --charging-roller--;
Line 41, "development bias" should read --development-bias--;
Line 44, "developing bias" should read --developing-bias--;
Line 46, "developing bias" should read --developing-bias--;
Line 47, "compression coil" should read --compression-coil--;
Line 54, "re" should read --are--;
Line 55, "developing blade" should read --developing-blade--;
Line 59, "FIG. 47" should read --FIG. 47,--;
Line 60, "driving force" should read --driving-force--; and
Line 62, "is contacted by" should read --contacts--; and "developing bias" should read --developing-bias--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 39:

Line 7, “is” should be deleted;
Line 8, “contacted to” should read --contacts--;
Line 9, “and” should read --and is--;
Line 10, “inner contact” should read --inner-contact--;
Line 12, “conductive plate” should read --conductive-plate--;
Line 17, “is contacted to” should read --contacts--;
Line 21, “blade contact” should read --blade-contact--;
Line 23, “is contacted to” should read --contacts--;
Line 30, “application roller” should read --application-roller--;
Line 35, “developing bias” should read --developing-bias--;
Line 37, “developing bias” (both occurrences) should read --developing-bias--;
Line 39, “application roller” should read --application-roller--;
Line 52, “developing bias” should read --developing-bias--;
Line 59, “developing bias” should read --developing-bias--; and “developer” should read --developer- --;
Line 60, “developing bias” should read --developing-bias--;
Line 61, “driving force” should read --driving-force--;
Line 64, “developing bias” should read --developing-bias--; and “pin” should read --pin,--; and
Line 66, “developing bias” should read --developing-bias--.

COLUMN 40:

Line 6, “application roller” should read --application-roller--; and “stepped” should read --stepped---;
Line 7, “developing roller” should read --developing-roller--;
Line 24, “developing bias” should read --developing-bias--;

It is certified that error appears in the above-identified patent and that said Letters Patent is hereby corrected as shown below:

COLUMN 40: (*Continued*)

Line 25, "developing bias" should read --developing-bias--;
Line 35, "urging force" should read --urging-force--;
Line 37, "urging force" should read --urging-force--;
Line 40, "driving force" should read --driving-force--;
Line 49, "developing cartridge" should read --developing-cartridge--;
Line 52, "developing cartridge" should read --developing-cartridge--;
Line 53, "developing car-" should read --developing-car- --;
Line 55, "driving force" should read --driving-force--;
Line 59, "developing cartridge" should read --developing-cartridge--;
Line 61, "driving" should read --driving- --; and
Line 64, "its" should read --it's--.

COLUMN 41:

Line 2, "driving force" should read --driving-force--;
Line 4, "developing cartridge" should read --developing-cartridge--;
Line 8, "for a developing cartridge" should be deleted;
Line 19, "driving force" should read --driving-force--;
Line 24, "developing cartridge" should read --developing-cartridge--;
Line 25, "driving force" should read --driving-force--;
Line 26, "developing bias" should read --developing-bias--;
Line 33, "developing bias" should read --developing-bias--;
Line 35, "that driving force" should read --the driving-force--;
Line 36, "developing" should read --developing- --; and
Line 38, "coupling frame" should read --coupling-frame--;
Line 40, "developing cartridge" should read --developing-cartridge--;
Line 41, "developing cartridge" should read --developing-cartridge--;
Line 44, "developing" should read --developing- --;
Line 45, "another, for example," should read --another method, for example, a--;
Line 58, "is as" should read --includes the following steps:--; and
Line 59, "follows." should be deleted.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 42:

Line 11, “63E” should read --63E is mounted--;
Line 34, “obstruct” should read --obstructs--;
Line 42, “that” should read --that the--;
Line 43, “step” should read --the step--; and “toner seal” should read
- -toner-seal--;

COLUMN 43:

Line 6, “holes” should read --hole--;
Line 9, “toner supply” should read --toner-supply--;
Line 11, “toner supply” should read --toner-supply--;
Line 19, “is contacted to” should read --contacts--;
Line 21, “is contacted to” should read --contacts--; and “developing” should read --developing- --;
Line 25, “FIG. 62, (a),” should read --FIG. 62(a),--;
Line 27, “developing bias” should read --developing-bias--;
Line 28, “Figure (b) of the Figure,” should read --Figure 62(b),--;
Line 29, “is contacted to” should read --contacts--;
Line 42, “the description will be made” should read --a description will be provided--;
Line 43, “exchanging method of the exchanging method,” should read --an exchange method,--;
Line 47, “side cover” should read --side-cover--; and
Line 61, “application” should read --application- --.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 44:

Line 7, “developing roller” should read --a developing-roller--;
Line 10, “developing blade” should read --developing-blade--;
Line 16, “application roller” should read --application-roller--;
Line 18, “toner application” should read --toner-application--;
Line 21, “application roller” should read --application-roller--;
Line 25, “developing blade” should read --developing-blade--;
Line 30, “side cover” should read --side-cover--;
Line 35, “bearing unit” should read --bearing-unit--;
Line 41, “stepped idler” should read --stepped-idler--;
Line 42, “application roller” should read --application-roller--;
Line 43, “stepped driving” should read --stepped-driving--;
Line 44, “(l)” should read --(i)--;
Line 45, “(m)” should read --(l)--;
Line 50, “step (1)” should read --step (k)--;
Line 54, “that” should read --that the--;
Line 56, “developing blade” should read --developing-blade--; and
Line 62, “star” should read --start--.

COLUMN 45:

Line 1, “toner application” should read --toner-application--;
Line 2, “toner” should read --toner- --;
Line 6, “developing blade” should read --developing-blade--;
Line 9, “side cover” should read --side-cover--;
Line 12, “bearing unit” should read --bearing-unit--;
Line 15, “gear mounting” should read --gear-mounting--;
Line 16, “developing roller” should read --developing-roller--;
Line 21, “toner supply” should read --toner-supply--;

Line 23, “toner supply” should read --toner-supply--;
Line 24, “DT” should read --D--; and
Line 28, “developing blade” should read --developing-blade--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 46:

Line 16, “toner supplying” should read --toner-supplying--;
Line 17, “the” (second occurrence) should read --a--;
Line 21, “toner layer thickness regulating” should read --toner-layer-thickness-regulating--;
Line 23, “toner supplying” should read --toner-supplying--;
Line 28, “tuner” should read --toner--;
Line 31, “toner supplying” should read --toner-supplying--; and “toner” should read --toner- --;
Line 34, “steps” should read --the steps--; and “toner supply” should read --toner-supply--;
Line 36, “toner supply” should read --toner-supply--; and “toner” (second occurrence) should read --toner-supplying step--;
Line 37, “supply.” should be deleted;
Line 40, “applying” should read --applying an--; and
Line 43, “toner layer thickness regulating” should read --toner-layer-thickness-regulating--.

UNITED STATES PATENT AND TRADEMARK OFFICE

CERTIFICATE OF CORRECTION

PATENT NO. : 6,381,430 B1
APPLICATION NO. : 09/386437
DATED : April 30, 2002
INVENTOR(S) : Kanji Yokomori et al.

It is certified that error appears in the above-identified patent and that said Letters Patent is hereby corrected as shown below:

COLUMN 48:

Line 2, "step of" should read --step of removing--;
Line 5, "toner supply" should read --toner-supplying--;
Line 8, "toner" should read --toner- --; and
Line 10, "toner regulating" should read --toner-layer-thickness-regulating--.

Signed and Sealed this

Nineteenth Day of September, 2006

JON W. DUDAS
*Director of the United States Patent and Trademark Office*